US007153645B2

(12) United States Patent
Morita

(10) Patent No.: US 7,153,645 B2
(45) Date of Patent: Dec. 26, 2006

(54) SILVER SALT PHOTO-THERMAL PHOTOGRAPHIC DRY IMAGING MATERIAL, AN IMAGE RECORDING METHOD AND AN IMAGE FORMING METHOD

(75) Inventor: Kiyokazu Morita, Kokubunji (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 0 days.

(21) Appl. No.: 10/899,420

(22) Filed: Jul. 26, 2004

(65) Prior Publication Data

US 2005/0032010 A1 Feb. 10, 2005

(30) Foreign Application Priority Data

Aug. 8, 2003 (JP) ..... 2003-289721

(51) Int. Cl.

| | |
|---|---|
| ***G03C 1/00*** | (2006.01) |
| ***G03C 1/005*** | (2006.01) |
| ***G03C 1/494*** | (2006.01) |
| ***G03C 5/16*** | (2006.01) |

(52) U.S. Cl. ..... 430/617; 430/618; 430/619; 430/620; 430/567; 430/351

(58) Field of Classification Search ..... 430/567, 430/618, 619, 620, 351

See application file for complete search history.

(56) References Cited

U.S. PATENT DOCUMENTS

| | | | | |
|---|---|---|---|---|
| 6,436,626 | B1 * | 8/2002 | Kawahara et al. | 430/619 |
| 6,699,649 | B1 * | 3/2004 | Nishijima et al. | 430/351 |
| 2002/0068246 | A1 | 6/2002 | Morita | |
| 2004/0043341 | A1 | 3/2004 | Morita et al. | |
| 2004/0101794 | A1 | 5/2004 | Usagawa et al. | |
| 2005/0048423 | A1 * | 3/2005 | Ohnuma | 430/567 |
| 2005/0064352 | A1 * | 3/2005 | Suzuki et al. | 430/619 |

FOREIGN PATENT DOCUMENTS

| | | |
|---|---|---|
| EP | 1 143 292 A2 | 10/2001 |
| EP | 1 241 520 A2 | 9/2002 |
| EP | 1 278 101 A2 | 1/2003 |
| EP | 1 327 909 A2 | 7/2003 |
| EP | 1 345 075 A2 | 9/2003 |
| EP | 1 398 663 A1 | 3/2004 |
| EP | 1 422 552 A2 | 5/2004 |
| EP | 04 01 8096 | 10/2004 |
| JP | 2003-66563 | 3/2003 |
| JP | 2003-315955 | 11/2003 |
| JP | 2003-330141 | 11/2003 |
| JP | 2004-37819 | 2/2004 |

* cited by examiner

*Primary Examiner*—Geraldine Letscher
(74) *Attorney, Agent, or Firm*—Lucas & Mercanti, LLP

(57) ABSTRACT

A silver salt photo-thermal photographic dry imaging material comprising on a support a light-sensitive layer containing light-insensitive silver salt of aliphatic carboxylic acid particles, a light-sensitive emulsion having light-sensitive silver halide grains, a silver ion reducing agent and a binder. The light-sensitive emulsion contains silver halide particles having diameters of from 0.001 μm to 0.050 μm in the ratio of 50% or more by weight in terms of silver of the entire light-sensitive silver halide grains contained, and the number average particle diameter of the light-insensitive silver salt of aliphatic carboxylic acid is from 0.01 μm to 0.60 μm.

14 Claims, 1 Drawing Sheet

SILVER SALT PHOTO-THERMAL PHOTOGRAPHIC DRY IMAGING MATERIAL, AN IMAGE RECORDING METHOD AND AN IMAGE FORMING METHOD

BACKGROUND OF THE INVENTION

The present invention relates to a silver salt photo-thermal photographic dry imaging material excellent in the high density, the light fastness of image and the tone of silver image, an image recording method and an image forming method employing that. Hitherto, in the field of the medical and the plate making for printing, exhausted waste liquid accompanied with the wet treatment causes problems from the viewpoint of the working efficiency. Recently, the reduction of the exhausted waste liquid is strongly demanded also from the viewpoints of the environment protection and the space saving. Consequently, the silver salt photo-thermal photographic dry imaging material capable of forming an image only by heating is made practicable and rapidly spread in the above fields.

The silver salt photo-thermal photographic dry imaging material, hereinafter referred to as thermally developable material or simply as light-sensitive material, is previously proposed such as that described in, for example, U.S. Pat. Nos. 3,152,904 and 3,457,075.

The thermally developable material is usually treated by a developing apparatus so called as a thermal developing apparatus which gives stable heating to the thermally developable material to form an image. A lot of such the heat developing apparatus has been supplied to the market accompanied with the rapidly spreading of the thermally developable material as above-mentioned.

There is a problem, however, that the fault of conveyance of the thermally developable material and the unevenness of the image density are caused by the changing of the slipping property between the thermally developable material and the conveying roller or the processing member depending on the environment such as temperature and humidity. Furthermore, it has been the problem that density of the silver image is changed during the storage for a prolonged period. It is found that these phenomena considerably occur in the thermally developable material for forming an image by thermal development after the imagewise exposure by laser light.

Recently, the miniaturization of the laser imager and the speed up of the treatment are demanded. For obtaining sufficient image density by the thermally developable material, even when developed by speedy treatment, it has been proposed to raise the covering power by employing silver halide having a small average particle size, to use a high reactive reducing agent such as a compound having a secondary or tertiary alkyl group, and to use a development accelerating agent such as phenol compounds, hydrazine compounds and vinyl compounds described in, for example, Japanese Patent Publication Open to Public Inspection, hereinafter referred to as Japanese Patent O.P.I. Publication, Nos. 11-295844 and 11-352627.

However, when the silver halide particles having the small average size are simply used for raising the covering power, the stability of the dispersion of the silver halide particles is conversely lowered and the transparency of the image is degraded, and degradation of the haze in the low density area is resulted. Moreover, problems rise when these techniques are applied that the variation of the density or printout during the storage for prolonged period is increased and the tone of the silver image is largely become different, for example made yellowish, from that of the image obtained by the usual light-sensitive material to be developed by the wet processing. Moreover, a problem is newly found that the tone at the high density area having a density of not less than 2.0 of the image is made reddish when the silver halide particles having the small average size are employed.

As the countermeasures to such the problems, for example, Japanese Patent O.P.I. Publication Nos. 11-288057, 11-231460 and 2001-264926 disclose techniques to control the tone of silver image by employing couplers or leuco dyes. In any method, however, the desired tone control can not be attained since the fog is raised during the storage for a prolonged period when the amount of the coupler or the leuco dye is increased.

SUMMARY OF THE INVENTION

The silver salt photo-thermal photographic dry imaging material comprises a support and a light-sensitive layer which is provided on the support and contains light-insensitive silver salt of aliphatic carboxylic acid particles, a light-sensitive emulsion containing light-sensitive silver halide grains, a silver ion reducing agent and a binder. The light-sensitive emulsion contains silver halide particles having diameters of from 0.001 μm to 0.050 μm in the ratio of 50% or more by weight in terms of silver of the entire light-sensitive silver halide grains contained in the imaging material, and the number average particle diameter of the light-insensitive silver salt of aliphatic carboxylic acid is from 0.01 μm to 0.60 μm.

DETAILED DESCRIPTION OF THE PREFERRED EMBODIMENT

Figure 1:
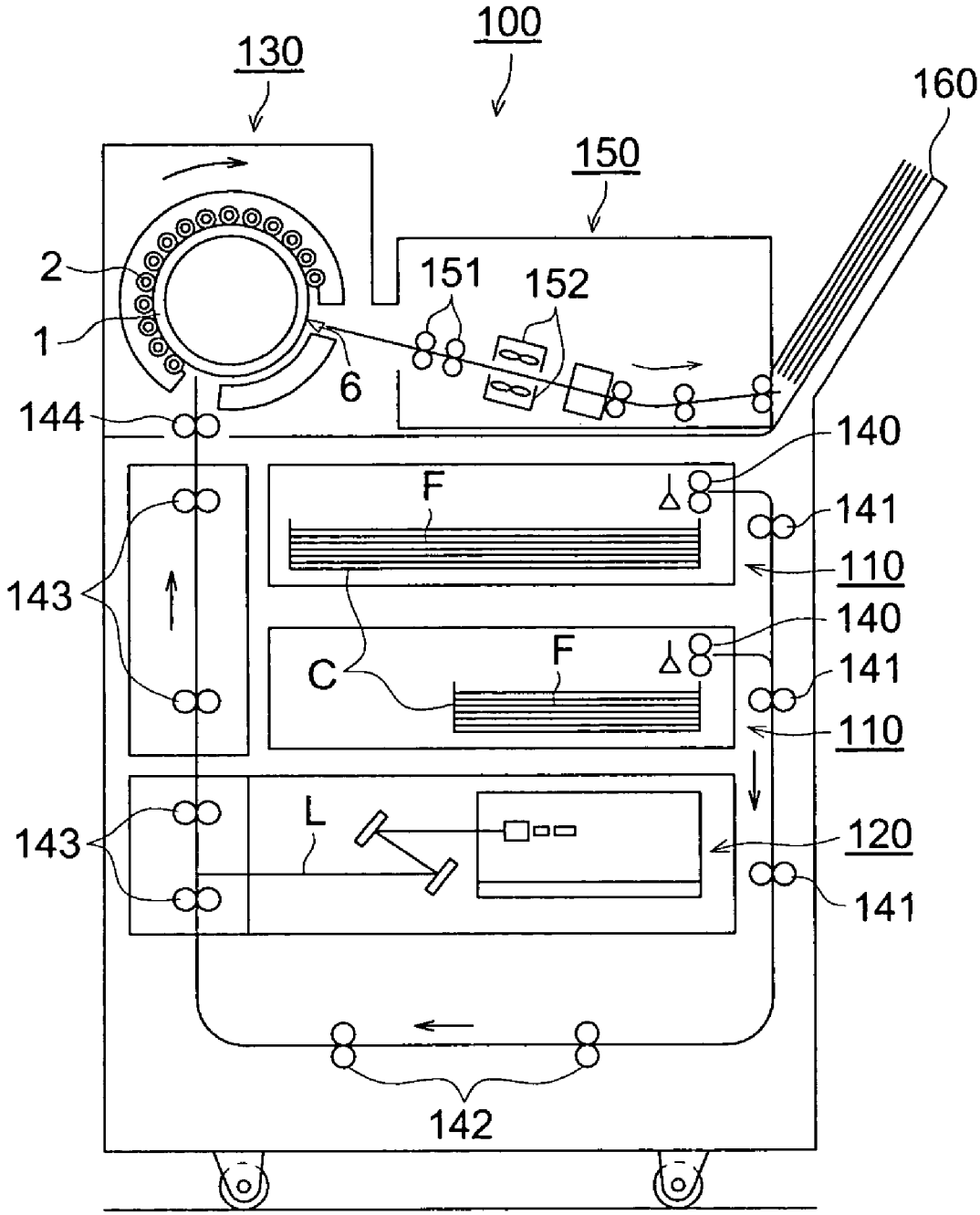
FIG. 1 is a cross section showing the constitution of an example of the thermal developing apparatus relating to the invention.

The detail of constitution of the invention is described below.

The silver salt photo-thermal photographic dry imaging material comprises a support and a light-sensitive layer which is provided on the support and contains light-insensitive silver salt of aliphatic carboxylic acid particles, a light-sensitive emulsion containing light-sensitive silver halide grains, a silver ion reducing agent and a binder.

First, the light-sensitive emulsion containing light-sensitive silver halide grains is described. One of the features of the light-sensitive emulsion in the silver salt photo-thermal photographic dry imaging material according to the invention is an emulsion in which 50% or more by weight in terms of silver of the entire light-sensitive silver halide grains contained in the imaging material is particles having diameters of from 0.001 μm to 0.050 μm, and the ratio of such the grains is preferably from 50 to 100% by weight, more preferably from 75 to 100% by weight and further preferably from 90 to 100% by weight.

In the invention, the size of the light-sensitive silver halide grains contained in the light-sensitive emulsion is from 0.001 to 0.050 μm, and more preferably from 0.01 to 0.05 μm, in average diameter. The grain diameter is defined by the diameter of a sphere having the same volume as that of the silver halide grain so called as the sphere equivalent diameter when the silver halide grain is regular crystal such as cubic or octahedral and a irregular crystal such as spherical or rod-shape. When the grain is a planar grain, the diameter is defined by the diameter of a circle having the area the same as the projection area of the principal surface of the grain.

The adding amount of the light-sensitive silver halide is preferably from 0.01 to 1 g/m$^2$, more preferably from 0.01 to 0.4 g/m$^2$, and further preferably from 0.01 to 0.2 g/m$^2$, in terms of the coated silver amount per square meter of the thermally developable material. By satisfying the above conditions of the grain size and the adding amount of the silver halide, the image density can be raised and the image quality can be improved by lowering of the haze or turbidity. When the grain diameter is less than 0.001 μm, the sensitivity is considerably lowered and the silver halide grains are coagulated in the course of the preparation process of the silver halide grains and the preparation process of the organic silver salt with the silver halide. As a result of that the grain diameter distribution is considerably spread and the haze cannot be reduced. The problem of haze rises when the grain diameter exceeds 0.05 μm. The objective function as the thermally developable material is made insufficient and the satisfactory photographic properties cannot be obtained when the coating amount of silver is less than 0.01 g/m$^2$ and the problem of haze rises when the amount exceeds 1.0 g/m$^2$.

As the light-sensitive silver halide to be used in the invention, silver chloride, silver chlorobromide, silver bromide, silver iodobromide and silver iodochloride may be employed without any limitation on the halide composition thereof. The distribution of the silver halide composition in the grain may be uniform, varied stepwise and varied continuously. A grain having a core/shell structure is preferably employed. The grain having two to five layered structure of silver halide composition is preferred and the grain having two to four layered structure is more preferable. A grain of silver chloride or silver chlorobromide on the surface of which silver bromide is localized can be also preferably employed.

For preparation of the silver halide grain, methods know in the field of arts such as those described in Research Disclosure No. 17029, June 1978, and U.S. Pat. No. 3,700,458 are usable. In the invention, a method is preferred in which a silver supplying compound and a halide supplying compound are added to a gelatin or another polymer solution to prepare light-sensitive silver halide, and then resultant is mixed with an organic silver salt.

The shape of the silver halide grain may be cubic, octahedral, planar, spherical, rod-shaped and potato like-shaped. In the invention, the cubic grain and the planar grain are preferred. The average aspect ratio of the planer grain is preferably from 100:1 to 2:1, preferably from 50:1 to 3:1. Moreover, a grain having a rounded corner is preferably employed. Though there is no limitation on the surface index (Millar index) of the outer surface of the silver halide grains, it is preferred that the occupying ratio of the [100] face is high, such the face shows high spectral sensitizing efficiency when a spectral sensitizing dye is adsorbed on the face. The ratio is preferably not less than 50%, more preferably not less than 65%, and further preferably not less than 80%. The ratio of the [100] face can be determined by the method described in T. Tani, J. Imaging Sci., 29, 165, 1985, utilizing the dependency of the adsorption of the spectral sensitizing dye on the [111] face and [100] face.

An iridium compound may be contained in the silver halide grain to be used in the invention. Though various iridium compounds can be employed as the water-soluble iridium compound, for example, iridium(III) halide compounds, iridium(IV) halide compounds, iridium complexes having a halogen, an amine or an oxalate as the ligand such as hexachloro-irridium(III) complex, hexachloro-irridium (IV) complex, hexammine-irridium(III) complex, hexammine-irridium(IV) complex, trioxalate-irridium (III) complex, trioxalate-irridium(IV) complex, hexacyano-irridium complex, pentachloronitrosyl-irridium are usable. In the invention, a tri-valent iridium compound and a tetra-valent iridium compound may be used in optional combination. Though these iridium compounds are employed in a state of dissolved in water or a suitable solvent, a usually utilizing method for stabilizing the iridium compound solution such as addition of a hydrogen halide solution such as hydrochloric acid, hydrobromic acid and hydrofluoric acid, or an alkali halide such as KCl, NaCl, KBr, and NaBr may be utilized. It is possible that silver halide grains previously doped with the iridium are added and dissolved on the occasion of the preparation of the silver halide in place of the use of the water-soluble iridium compound.

In the invention, the addition of the water-soluble iridium compound can be carried out at an optional time in the course of preparation of the silver halide emulsion grain and before the coating of the coating liquid containing the silver halide emulsion. Particularly, it is preferable that the iridium compound is added on the occasion of the silver halide emulsion preparation so as to be included in the silver halide grain. The adding amount of the water-soluble iridium compound is preferably from $1\times10^{-8}$ to $1\times10^{-3}$ moles, more preferably from $1\times10^{-8}$ to $5\times10^{-5}$ moles, and particularly preferably from $5\times10^{-8}$ to $5\times10^{-6}$ moles per mole of silver halide.

The silver halide grain relating to the invention can contain a salt or complex salt of a metal of Group VII or Group VIII (Groups 7 to 10) of the periodic table other than iridium, for example, rhodium, rhenium, ruthenium and osmium. These metal complexes may be employed singly or in combination of two or more kinds of the same or different metal complexes. The adding amount is preferably from $1\times10^{-9}$ to $1\times10^{-3}$ moles, and more preferably from $1\times10^{-8}$ to $1\times10^{-4}$ moles, per mole of silver. The complexes having the concrete structure described in Japanese Patent O.P.I. Publication No. 7-225449 can be employed. Water-soluble rhodium compounds can be used for containing rhodium in the silver halide grain. Examples of the rhodium compound include rhodium(III) halide compounds and rhodium complexes having halogen, amine and oxalate as the ligand such as heaxchrolor-hodium(III) complex, pentachloroaquo-rhodium(III) complex, tetrachlorodiaquo-rhodium(III) complex, hexabromo-rhodium (III) complex, hexammine-rhodium(III) complex and trioxalate-rhodium(III) complex. These rhodium compounds are used in a state dissolved in water or a solvent. For stabilizing the rhodium compound solution, a usually utilizing method for stabilizing the rhodium compound solution such as addition of a hydrogen halide solution such as hydrochloric acid, hydrobromic acid and hydrofluoric acid, or an alkali halide such as KCl, NaCl, KBr, and NaBr may be utilized. It is possible that silver halide grains previously doped with the rhodium are added and dissolved on the occasion of the preparation of the silver halide in place of the use of the water-soluble rhodium compound.

The adding amount of the water-soluble rhodium compound is preferably from $1\times10^{-8}$ to $5\times10^{-6}$ moles, and particularly preferably from $5\times10^{-8}$ to $1\times10^{-6}$ moles per mole of silver halide. The addition of the water-soluble rhodium compound can be carried out at an optional time in the course of preparation of the silver halide emulsion grain and before the coating of the coating liquid containing the silver halide emulsion. Particularly, it is preferable that the rhodium compound is added on the occasion of the silver halide emulsion preparation so as to be included in the silver halide grain.

Rhenium, ruthenium and osmium to be used in the invention are added in a state of water-soluble complex described in Japanese Patent O.P.I. Publication Nos. 63-2042, 1-285941, 2020852 and 2-20855. Hexa-coordinated complexes represented by the following formula are particularly preferred.

$[ML_6]^{n-}$

In the formula, M is Ru, Re or Os, L is a ligand and n is 0, 1, 2, 3 or 4.

In such the case, the counter ion is not important and ammonium or an alkali metal ion is employed. Examples of preferable ligand include a halide ligand, a cyanide ligand, a cyanate ligand, a nitrosyl ligand and thionitrosyl ligand. Though concrete examples of the complex usable in the invention are listed as follows, the invention is not limited thereto:

$[ReCl_6]^{3-}$, $[ReBr_6]^{3-}$, $[ReCl_5(NO)]^{2-}$, $[Re(NS)Br_6]^{2-}$, $[Re(NO)(CN)_5]^{2-}$, $[Re(O)_2(CN)_4]^{3-}$, $[RuCl_6]^{3-}$, $[RuCl_4(H_2O)_2]^{-}$, $[RuCl_5(H_2O)]^{2-}$, $[RuCl_5(NO)]^{2-}$, $[RuBr_5(NS)]^{2-}$, $[Ru(CO)_3Cl_3]^{2-}$, $[Ru(CO)Cl_5]^{2-}$, $[Ru(CO)Br_5]^{2-}$, $[OsCl_6]^{3-}$, $[OsCl_5(NO)]^{2-}$, $[Os(NO)(CN)_5]^{2-}$, $[Os(NS)Br_5]^{2-}$ and $[Os(O)_2(CN)_4]^{4-}$.

The adding amount of these compounds is preferably from $1\times10^{-9}$ to $1\times10^{-5}$ moles, and particularly preferably from $1\times10^{-8}$ to $1\times10^{-6}$ moles per mole of silver halide. The addition of these compounds can be carried out at an optional time in the course of preparation of the silver halide emulsion grain and before the coating of the coating liquid containing the silver halide emulsion. Particularly, it is preferable that the compound is added on the occasion of the silver halide emulsion preparation so as to be included in the silver halide grain.

For including the compound into the silver halide grains in the course of the grain formation the following methods can be applied: a method in which the powder or the aqueous solution of the metal complex together with NaCl or KCl is added to a solution of a water-soluble silver salt or a water-soluble halide to be used for forming the silver halide grains; a three solutions simultaneously mixing method in which the metal complex is added as the third solution is simultaneously mixing together with the silver salt solution and the halide solution, or a method in which the necessary amount of the metal complex in a state the solution is put into the reaction vessel on the occasion of the silver halide grains formation. The method is particularly preferable, in which the necessary amount of the metal complex in a state of the powder or the solution together with NaCl or KCl is added to the water-soluble halide solution.

To add the metal complex onto the surface of the grains, the necessary amount of the solution of the metal complex may be put into the reaction vessel just after the formation, in the course of or after the finish if the physical ripening, or in the course of the chemical ripening of the silver halide grain.

The silver halide grain to be employed in the invention may further contain atoms of metal such as cobalt, iron, nickel, chromium, palladium, platinum, thallium, copper and lead. In the cases of cobalt, iron, chromium and ruthenium, hexacyano complexes thereof are preferably employed. Concrete examples of such the complex include a ferricyanate ion, a ferrocyanate ion, a hexacyanocobaltate ion, a hexacyanochromate and a hexacyanoruthenium ion, but the complex of them is not limited to the above. The metal complex may be contained in the silver halide grain uniformly, localized at the core portion or at the shell portion in a higher concentration without any limitation. The content of such the metal complex is preferably from $1\times10^{-9}$ to $1\times10^{-4}$ moles per mole of silver halide. The metal complex may be added into the silver halide grain by adding the metal in a form of metal salt such as simple salt, double salt or complex salt on the occasion of the formation of the silver halide grain.

Though the light-sensitive silver halide grain may be desalted by methods known in the field of the art such as a noodle method, a flocculation method, the desalting may be omitted in the invention.

The silver halide emulsion relating to the invention is preferably subjected to chemical sensitization. Methods known in the field of the art such as a sulfur sensitization, a gold sensitization, selenium sensitization, tellurium sensitization and noble metal sensitization may be applied.

The sulfur sensitization preferably applied in the invention is usually performed by adding a sulfur sensitizer to the silver halide emulsion and stirring for certain period at a high temperature of not less than 40° C. Known compounds may be used as the sulfur sensitization, for example, a sulfur compound contained in gelatin, and various sulfur compounds such as thiosulfates, thioureas, thiazoles and rhodanines. Preferable sulfur compounds are thiosulfates and thiourea compounds. The adding amount of the sulfur sensitizer is from $1\times10^{-7}$ to $1\times10^{-2}$ and preferably from $1\times10^{-5}$ to $1\times10^{-3}$, even though the amount is varied depending on various conditions such as the pH, the temperature and size of the silver halide grain at the time of the chemical sensitization.

Known selenium compounds can be employed as the selenium sensitizer in the invention. The selenium sensitization is usually performed by adding an instable type or non-instable type selenium compound to the silver halide emulsion and the emulsion is stirred for a certain period at a high temperature of not less than 40° C. As the instable type selenium compound, for example, those described in Japanese Examined Patent Publication Nos. 44-15748 and 43-13489, and Japanese Patent O.P.I. Publication Nos. 4-25832, 4-109240 and 4-324855. Particularly, the compounds represented by Formula (VIII) or (IX) described in Japanese Patent O.P.I. Publication No. 4-324855 are preferably employed.

The tellurium sensitizer to be used in the invention is a compound capable of forming silver telluride, which is presumed to be a sensitizing nucleus, on the surface or the interior of the silver halide grain. The formation rate of silver telluride in the silver halide emulsion can be tested by the method, for example, described in Japanese Patent O.P.I. Publication No. 5-313284. As the tellurium sensitizer, for example, the followings are usable: diacyltellurides, bis(oxycarbonyl)tellurides, bis(carbamoyl)tellurides, bis(oxycarbonyl)ditellurides, bis(carbamoyl)ditellurides, compounds each having a P═Te bond, tellurocarboxylic acids, Te-organyltllurocarboxylic acid esters, di(poly)tellurides, tellurides, tellurols, telluroacetals, tellurosulfonates, compounds each having a P—Te bond, Te-containing heterocyclic compounds, tellurocarbonyl compounds, inorganic tellurium compounds and colloidal tellurium. In concrete, the compounds described in the following publications are usable: U.S. Pat. Nos. 1,623,499, 3,320,069 and 3772031, British Patent Nos. 235,211, 1,121,496, 1,295,462 and 1,396,696, Canadian Patent No. 800,958, Japanese Patent O.P.I. Publication No. 40204640, Japanese Patent Nos. 2654722, 2699029 and 2811257, J. Chem. Soc. Chem. Commun. 653, 1980, ibid. 1102, 1979, ibid. 645, 1979, J. Chem. Soc. Perkin. Trans. 1, 2191, 1980, "The Chemistry of Organic Selenium and tellurium Compounds" Vol. 1 edited by S. Patai, 1986 and ibid. Vol. 2, 1987. Particularly, the compounds represented by Formula (II), (III) or (IV) described in Japanese Patent O.P.I. Publication No. 5-313284 are preferred.

The adding amount of the selenium or the tellurium sensitizer in the invention is usually about from $1\times10^{-8}$ to $1\times10^{-2}$ moles and preferably from $1\times10^{-7}$ to $1\times10^{-3}$ moles per mole of silver halide even though the amount is varied depending on the silver halide grain and the chemical ripening condition. Though the condition of the chemical sensitization in the invention is not specifically limited, a pH of from 5 to 8, a pAg of from 6 to 11 and preferably from 7 to 10, and a temperature of from 40 to 95° C. and preferably from 45 to 85° C., are applied.

The gold sensitizer for gold sensitization of the silver halide emulsion relating to the invention may be either ones each having an oxidation number of +1 or +3, and gold compounds usually to be employed as the gold sensitizer are employable. Examples of the gold sensitizer include chloroauric acid, potassium chloroaurate, auric trichloride, potassium auricthiocyanate, potassium iodoaurate, tetracyanoauric acid, ammonium aurothiocyanate and pyridyltrichlorogold. The adding amount of the gold sensitizer depends on the various conditions, but it is approximately from $1\times10^{-7}$ to $1\times10^{-3}$ moles and preferably from $1\times10^{-6}$ to $5\times10^{-4}$ moles per mole of silver halide.

In the silver halide emulsion relating to the invention, the gold sensitization may be applied together with another chemical sensitization; in such the case, for example, combinations of the sulfur sensitizing method with the gold sensitizing method, the selenium sensitizing method with the gold sensitizing method, the sulfur sensitizing method and the selenium sensitizing method with the gold sensitizing method, the sulfur sensitizing method and the tellurium sensitizing method with the gold sensitizing method, the sulfur sensitizing method, selenium sensitizing method and the selenium sensitizing method with the gold sensitizing method are preferred.

In the silver halide emulsion to be used in the invention, a cadmium salt, a sulfite, a lead salt or a thallium salt may coexist in the course of the formation or physical ripening of the silver halide grains.

In the invention, a reducing sensitization can be employed. As-the concrete compounds for the reducing sensitization, ascorbic acid, thiourea dioxide, tin (II) chloride, aminoiminomethanesulfonic acid, hydrazine derivatives, borane compounds, silane compounds and polyamine compounds are usable. Moreover, the reducing sensitization can be performed by ripening while the pH of the emulsion is kept at 7 of more or the pAg is kept at 8.3 or less. The reducing sensitization also can be performed by introducing the single addition portion of silver ions in the course of the silver halide grain formation.

Thiosulfonic acid compounds may be added to the silver halide emulsion relating to the invention according to the method described in European patent Publication No. 293, 917.

The silver halide emulsion relating to the invention can be spectrally sensitized by the addition of a spectral sensitizing dye. As the spectral sensitizing dye, cyanine dyes, merocyanine dyes, complex cyanine dyes, complex merocyanine dyes, holopolar cyanine dyes, styryl dyes, hemicyanine dyes, oxonol dyes and hemioxonol dyes are employable. For example, the sensitizing dyes described in the following publications are employable: Japanese Patent O.P.I. Publication Nos. 63-159841, 50-140335, 63-231437, 63-259651, 63-304242 and 63-15245, U.S. Pat. Nos. 4,639,414, 4,740,455, 4,741,966, 4,751,175 and 4,835,096. Sensitizing dyes useful in the invention are described in, for example, RD17643, item IV-A, p. 23, December 1978 and RD18431, item X, October 1978, p. 437, and publications referred in the above. Particularly, It is preferred that sensitizing dyes displaying spectral sensitivity suitable to the spectral property of the light source of various laser imagers and scanners. For example, the compounds described in Japanese Patent O.P.I. Publication Nos. 9-34078, 9-54409 and 9-80679 are preferably employed.

The silver halide emulsion contained in the thermally developable material relating to the invention may be composed of one kind or two or more kinds different from each other in the average grain size, halide composition, crystal habit and the chemical sensitizing condition. In the invention, it is preferable to employ plural kinds of light-sensitive silver emulsion for controlling the gradation property or γ; the plural kinds of the silver halide emulsion can be obtained by controlling the size, shape and halide composition of the silver halide grain, the amount of the sensitizing dye adsorbed to the silver halide grains and the amount of the chemical sensitizer. It is preferable that two to four kinds, preferably two or three kinds, of silver halide emulsion are employed in a form of mixture or separated layers. It is preferable to make the difference between the silver halide emulsions to at least 0.2 Log E, and more preferably to at least 0.3 Log E. The Log E is an index of sensitivity, and is a value of exposure E represented by logarithm on the horizontal axis of the characteristic curve in which the density of image formed by exposing through an optical wedge is plotted on the vertical axis and the exposure amount is plotted on the horizontal axis.

The technology relating to such the matter is described in, for example, Japanese Patent O.P.I. Publication Nos. 57-119341, 53-106125, 47-3929, 48-55730, 46-5187, 50-73627 and 57-150841. The greatest difference of the sensitivity is about 1.0 Log E, though there is no upper limitation on the difference of the sensitivity.

In the silver salt photo-thermal photographic imaging material, it is one of the features that the number average particle diameter of the light-insensitive silver salt of aliphatic carboxylic acid is from 0.01 μm to 0.60 μm.

The light-insensitive silver salt of aliphatic carboxylic acid, hereinafter referred to as the organic silver salt, is a silver salt which forms a silver image when it is heated at a temperature of 80° C. or more in the presence of a photocatalyst such as the latent image of the light-sensitive silver halide and a reducing agent, although the organic silver salt is relatively stable to light. The organic component of the organic silver salt may be an optional organic substance containing a source capable of forming silver ions. Such the light-insensitive organic silver salts are described in, for example, Japanese Patent O.P.I. Publication Nos. 6-130543, 8-314078, 9-127643, 10-62899 paragraphs [0048] and [0049], 10-94074 and 10-94075, European Patent Publication Nos. 0.803,764A1, p. 18, 1. 24 through p. 19, l. 37, 0,962,812A1 and 1,004,930A2, and Japanese Patent O.P.I. Publication Nos. 11-349591, 2000-7683, 2000-72711, 2000-112057 and 2000-155383. Silver salts of organic acids, particularly silver salts of long chain carboxylic acids having from 10 to 30, and more preferably from 15 to 28, carbon atoms. Examples of preferable organic silver salt include silver behenate, silver arachidate and silver stearate and mixtures thereof. The content of the silver behenate is preferably from 50 mole-percent to 100 mole-percent and particularly preferably fro 80 mole-percent to 100 mole-percent.

The shape of the silver behenate relating to the invention is preferably scaly having a ratio of length and breadth of from 1 to 9. When the ratio of length and breadth is within the range of from 1 to 8, the storage ability of the image is improved since the particle is not crushed on the occasion of the preparation of the dispersion. In the invention, the ratio of length and breadth of the scale-shaped organic silver salt is defined as follows.

The organic silver salt is observed by an electron micrometer, and the shape of the silver halide particle is approximated to a rectangular solid and the length of the sides of the rectangular solid are referred as "a", "b" and "c" in the order of the shortness ("b" and "c" may be the same). "x" and "y" are defined as follows by the calculation based on the shorter values of "a" and "b".

$$x=b/ay=c/b$$

"x" and "y" are calculated about approximately 200 particles and the average value of x is referred to as x(average). The particle satisfying the relation of 30≧x (average)≧1.5 is defined as the scale-shaped particle. The relation is preferably 30≧x(average)≧1.5, more preferably 20≧x(average)≧1.5. The average value of y or y(average) is defined as the length/breadth ratio. The length/breadth ratio is preferably from 1 to 9, more preferably from 1 to 6, and particularly preferably from 1 to 3. In the scale-shaped particle, "a" can be regarded as the thickness of a planar particle having the main surface with "b" and "c" as the sides thereof. The average value of "a" is preferably from 0.01 μm to 0.23 μm, and more preferably from 0.1 μm to 0.20 μm.

In the scale-shaped particle, ratio of the sphere equivalent particle diameter of the particle to "a" is defined as the aspect ratio. The aspect ratio of the scale-shaped particle in the invention is preferably from 1.1 to 30. By making the aspect ratio into such the ratio, the coagulation in the thermal developable material difficultly occurs and the storage ability of image is improved. In this case, the aspect ratio is preferably from 1.1 to 15.

It is one of the features of the light-insensitive silver aliphatic carboxylate relating to the invention that the number average diameter of the particles is from 0.01 μm to 0.60 μm, and preferably from 0.20 μm to 0.50 μm. By satisfying such the condition, the particles are difficultly coagulated and the storage ability of image is improved.

Moreover, it is surprisingly found that the image density is considerably increased when the average diameter of the light-insensitive is within the range of from 0.01 μm to 0.06 μm.

The sizes of the organic silver salt particles are preferably distributed in a monodispersed distribution. The monodispersed state is a state in which the quotient in percentage (variation coefficient) of the standard deviation of the volume weighted average diameter of the organic silver salt particles divided by the volume weighted average diameter is not more than 100%, preferably not more than 80%, and further preferably not more than 50%. The dispersion state is preferably determined from the particle size obtained by the self correlation function of the wobble of the scattered light with respect to the variation thereof depending on the time when the organic silver salt particles dispersed in a dispersing medium are lighted by laser light.

The organic silver salt particle is preferably prepared at a reaction temperature not more than 60° C. for preparing particles having low minimum density. Though the temperature of chemicals such as an aqueous solution of an alkali metal salt of organic acid may be a temperature more than 60° C., the temperature of the reaction liquid in which the reacting solution is added is preferably not more than 60° C. The temperature of not more than 50° C. is more preferable and that not more than 40° C. is particularly preferable.

The organic silver salt particle is prepared by reaction a solution containing silver ions such as silver nitrate with a solution or suspension of an alkali metal salt of an organic acid. It is preferable that not less than 50% of the entire amount of the silver to be added is added simultaneously with the addition of the solution or the suspension of the organic alkali metal salt. As the adding method, a method in which the adding solution is add to the surface of the reaction liquid, a method in which the adding liquid is added in the reaction liquid and a method in which the adding solution is added into a closed mixing means are usable. Among them, the method to add the liquid into the closed mixing means is preferred.

The pH of the solution containing silver ions such as silver nitrate to be employed in the invention is preferably from 1 to 6, and more preferably from 1.5 to 4. An acid or an alkali can be added to the solution containing the silver ions to control the pH; the kind of the acid and alkali is not specifically limited.

The organic silver salt relating to the invention may be subjected to ripening by raising the reaction temperature after finishing of the addition of the solution containing the silver ions such as silver nitrate and/or the solution or the suspension of the alkali metal salt of organic acid. It is considered that the ripening is the matter other than the foregoing reaction temperature. On the occasion of the ripening, the solution containing silver ions and the solution or the suspension of the alkali metal salt of organic acid are not added at all. The ripening is preferably carried out at a temperature of from 1° C. to 20° C. higher and more preferably from 1° C. to 10° C. higher, than the reaction temperature. The ripening time is preferably decided by trial and error method.

In the preparation of the organic silver salt relating to the invention, the addition of the solution or the suspension of the alkali metal salt of organic acid may be divided into from 2 to 6 times. Various functions can be provided to the particle by the divided addition, for example, that divided into an addition for improving the photographic properties and an addition for varing the hydrophilicity to the particle surface. The number of dividing times is preferably from 2 to 4. The organic silver slat is solidified if the temperature is lowered, therefore, a countermeasure such as the use of plural adding lines and a contrived circulation method is necessary. In the preparation of the organic silver salt, from 0.5 mole-percent to 30 mole-percent, and preferably not less than 20 mole-percent, of the solution or the suspension of entire moles of the alkali metal salt of organic acid to be added is solely added after finish of the addition of the solution containing silver ions. It is preferable that such the addition is appropriated as the first time of the addition. When the closed mixing means is employed, such the addition may be either applied to the closed mixing means or to the reacting vessel, and the later is preferred. By performing such the addition, the hydrophilicity of the surface of the organic silver salt can be raised. As a result of that, the layer forming ability of the thermal developable material is improved and peeling of the layer is inhibited.

The silver ion concentration of the solution containing silver ions such as silver nitrate to be used in the invention may be optionally decided, and a concentration of from 0.03 to 6.5 moles/l is preferable and that from 0.1 to 5 moles/l is more preferable.

At the enforcement of the invention, it is preferable that an organic solvent is added to at least one of the solution containing silver ions, the solution or the suspension of the alkali metal salt of organic acid and the liquid previously prepared in the reaction place in an necessary amount so that the alkali metal salt of the organic acid can be substantially transparent solution, not the state of a string-shaped aggregate or a micelle. Thus a solution containing fine organic silver salt particles excellent in the dispersing property by reacting the solution containing silver ions and the solution containing the alkali metal salt of organic acid in the presence of a water-miscible organic solvent.

The kind of the organic solvent is not limited as long as the solvent has the above properties, but one giving unsuitable influence on the photographic properties is not preferred; alcohols and acetone capable of being mixed with water are preferable and a tertiary alcohol having from 3 to 6 carbon atoms is preferred.

The alkali metal salt of organic acid is preferably one prepared by adding potassium hydroxide to an organic acid, namely one in which the alkali metal is potassium, since the solution containing the fine particles of the organic silver salt excellent in the dispersing ability can be obtained by such the alkali metal salt. It is preferable that, at the preparation of the organic silver salt, the amount of the alkali is made smaller than the equivalent amount of the organic acid so as to remain the not-reacted organic acid. In such the case, the remaining amount of the organic acid is from 3 to 50 mole-percent, and preferably from 3 to 30 mole-percent, of the entire amount of the organic acid. The preparation may be performed by adding alkali in an amount exceeding the desired amount and then neutralizing the excess alkali by addition of an acid such as nitric acid or sulfuric acid.

When the silver ion containing solution and/or the solution or suspension of the alkali metal salt of organic acid is added to the closed mixing means, for example, the compounds represented by Formula (1) described in Japanese Patent O.P.I. Publication No. 62-65035, the water-soluble N-heterocyclic compounds described in Japanese Patent O.P.I. Publication No. 62-150240, the inorganic peroxide compounds described in Japanese Patent O.P.I. Publication No. 50-101019, the sulfur compounds described in Japanese Patent O.P.I. Publication No. 51-73819, the disulfide compound described in Japanese Patent O.P.I. Publication No. 57-643 and hydrogen peroxide may be added may be added to the solution.

In the alkali metal salt of organic acid, the volume of the organic solvent is preferably from 3% to 70%, and more preferably from 5% to 50%, of the volume of water. The optimum amount of the organic solvent can be decided by trial and error method since the optimum volume of the solvent is varied depending on the reacting temperature. The concentration of the alkali metal salt of organic acid solution to be used in the invention is from 5 to 50%, preferably from 7 to 45%, and further preferably from 10 to 40%, by weight.

The temperature of the solution or the suspension of the alkali metal salt of organic acid is preferably from 50° C. to 90° C., more preferably from 60° C. to 85° C., and most preferably from 65° C. to 85° C., for holding the temperature so as to prevent the crystallization or solidification of the alkali metal salt of organic acid. Moreover, it is preferable that the temperature is kept at a designated value for controlling the reaction temperature at constant. By such the control, the separating rate of the fine crystal by rapidly cooling the high temperature solution or the suspension of the alkali metal salt of organic acid in the closed mixing means and the rate of conversion of the alkali metal salt of organic acid to the organic silver salt by the silver ion-containing solution can be suitably controlled. Thus the properties as the thermally developable material, particularly thermally developable light-sensitive material, can be further improved.

The solvent may be previously charged in the reacting vessel. As the previously charged solvent, water is preferred and a mixture of water and the solution or the suspension is also preferably usable.

A dispersing aid soluble in the aqueous medium may be added to the solution or the suspension of the alkali metal salt of organic acid, the silver ion-containing solution or the reacting liquid. Any dispersing aids may be used as long as it can disperse the formed organic silver salt. Concrete examples of the dispersing aid are similar to those later-mentioned as the dispersing aids for the organic silver salt.

In the preparation of the organic silver salt, a desalting and dehydration processes are preferably performed. The methods for the above processes are not specifically limited and known usual means can be applied. For example, a usual filtration method such as a centrifugal filtration, a suction filtration, an ultrafiltration, flock formation by a coagulation washing method and decantation by centrifugal precipitation are preferably applied. Among them, the ultrafiltration method is preferred; the desaltation and the dehydration may be performed at once or repeated for plural times. The addition and the exhaust of water may be performed continuously or separately. The desalting and the dehydration are carried out until the electro conductance of the exhausted water is attained to about not more than 300 μS/cm, more preferably not more than 100 μS/cm, and most preferably not more than 60 μS/cm. Though the lower limit of the electro conductivity is not specifically limited, it is usually about 5 μS/cm.

As the ultrafiltration, the method usually applied for desalting and condensation of a silver halide emulsion may be utilized. Research Disclosure Nos. 10208, 1972, 13122, 1975 and 16351, 1977, can be referred. The important operation conditions such as the pressure difference and the flowing amount can be decided referring the characteristic curve described on page 275 of H. Ooya "Handbook of Membrane Applying Technology", Saiwai Shobou, 1978. It is necessary, however, to find the optimal condition for inhibiting the coagulation of the particles and the occurrence of fog. As the method for filling the solvent lost through the membrane, a volume holding method by continuous addition of the solvent and a separately adding method in which the solvent is separately added into several times are applicable. The volume holding method is preferable since the time for desalting treatment is relatively short. Water purified by ion-exchange or distillation is used for filling the lost solvent, and a pH controlling agent may be added to the purified water to maintain the pH, the pH controlling agent may also be directly added to the dispersion of the organic silver salt.

As the ultrafiltration membrane, a planer type, a spiral type, a cylindrical type, a hollow string type and a hollow fiber type each built in a module are sold from Asahi Kasei Co., Ltd., Daicel Co., Ltd., Toray Co., Ltd., and Nitto Denkou Co., Ltd. Among them, the spiral type and the hollow string type are preferred form the viewpoint of the entire membrane area and the washing suitability. The fractionation molecular weight as the indicator of threshold value of the component permeable through the membrane is preferably not more than ⅕ of the molecular weight of the polymer dispersing agent employed in the dispersion. In the desalting by the ultrafiltration, it is preferable to previously disperse the dispersion so that the particle size is become to about 2 times of the final particle size in the volume weighted average. Any dispersing means such as later-mentioned high pressure homogenizer and microfluitizer may be applied.

The temperature of the liquid during the period after the particle formation to the desalting process is preferably kept at a low level, because silver nuclei tend to be formed in the field of the sharing force and the pressure on the occasion of the liquid conveying operation and the passing through the ultrafiltration membrane in the situation of that the organic solvent used for dissolving the alkali metal salt of organic acid is permeated in the formed organic silver salt particle. Therefore, in the invention, the ultrafiltration is performed while the temperature of the organic silver salt dispersion is maintained from 1 to 30° C. and preferably from 5 to 25° C.

It is preferable that the dispersing agent is added to the desalted and dehydrated organic silver salt and re-dispersed to form a fine dispersion for obtaining good surface condition of the coated layer of the thermal developable material, particularly the thermal developable light-sensitive material.

Known methods can be applied for preparation and the dispersion of the organic silver salt to be used in the invention. For example, the followings can be referred: Japanese Patent O.P.I. publication Nos. 8-234358 and 10-62899, European Patent Publication Nos. 0,803,763A1 and 0,962,812A1, and Japanese Patent O.P.I. publication Nos. 11-349591, 2000-7683, 2000-72711, 2000-53682, 2000-75437, 2000-86669, 2000-143578, 2000-178278, 2000-256254, 2001-162837, 2001-163889, 2001-163890, 2001-33907, 2000-305214, 2001-11081, 2000-344710, 2001-188313, 2001-83652, 2002-6442 and 2002-31870.

The organic silver salt can be mechanically dispersed to fine particle dispersion by known fine dispersing means such as a high speed mixer, a homogenizer, a high speed impact mill, a Banbury mixer, a homomixer, a kneader, a ball mill, a vibration ball mill, a planet ball mill, an attriter, a sand mill, a beads mill, a colloid mill, a jet mill, a roller mill, a tron mill and a high speed stone mill.

It is preferable that a strong force within the range, in which damage and the raising of the temperature do not occur, is uniformly given to obtain the organic silver salt dispersion having a particle size distribution of monodisperse, a small size particles and a high uniformity without coagulated particle. For satisfying such the condition, a dispersing method is preferable in which the dispersion composed of the organic silver salt and the dispersing agent solution is flown at a high speed and then the speed is dropped. In such the case, the dispersing agent is preferably only water which may contains not more than 20% by weight of an organic solvent, although any dispersing agent may be employed as long as the dispersing aid can be functioned together with the dispersing agent. The Fog is increased and the sensitivity is considerably lowered when the dispersion is carried out in the presence of the light-sensitive silver salt. Consequently, it is preferable that the dispersion substantially contains no light-sensitive silver salt and that the light-sensitive silver salt is not the added.

The dispersing apparatus and the techniques for the re-dispersion are described in detail in, for example, T. Kajiuchi and H. Usui "Rheology of Dispersion System and Dispersing Technology", p. 357–403, Shinzan-sha, 1991, "Progress of Chemical Industry, No. 24", edit. By Kagaku Kogyou Kai Tookai Shibu, p. 184–185, Maki Shoten, 1990, Japanese Patent O.P.I. Publication No. 59-49832, U.S. Pat. No. 4,533,254, and Japanese Patent O.P.I. Publication Nos. 8-137044, 8-238848, 2-261525 and 1-94933. In the invention, a method is preferable in which the dispersion containing at least the organic silver salt is push into a piping by a high pressure pump and passed through a narrow slit so as to the pressure of the dispersion is suddenly lowered to finely disperse the particles of the dispersion.

It is considered that the dispersion is uniformly carried out with high efficiency in the high pressure homogenizer by strengthened cavitation force caused by falling the pressure without decreasing (a) "sharing force" generated when the dispersed substance is passed with high pressure and high speed through a narrow slit having a width of approximately from 75 μm to 350 μm and (b) "impact force" caused by liquid-liquid or liquid-wall collision in a narrow space under high pressure. As such the kind of dispersing apparatus, Gaurin Homogenizer from a long time can be cited; in this apparatus, the dispersion conveyed with high pressure is converted to high velocity flow in a narrow space on a columnar surface and collides to the around wall by impetus, thus the emulsification and dispersion are carried out. As the apparatus utilizing foregoing Liquid-liquid collision, Y-type chamber of Microfluidizer, and the spherical chamber using a spherical backflow stopping valve described in Japanese Patent O.P.I. Publication No. 8-103642 can be cited, and as the liquid-wall collision, Z-type chamber of Microfluidizer is cited. For raising the dispersion efficiency, an apparatus is considered in which the high velocity flowing portion of the apparatus is shaped in to saw-tooth shape to increase the number of collision. The typical examples of such the apparatus are Gaurin Homogenizer, Microfluidex manufactured by Microfluidex International orporation, Microfluidizer manufactured by Mizuho Kogyo Co., Ltd., and Nanomizer manufactured by Tokushu Kika Kogyo Co., Ltd. The examples are also described in Japanese Patent O.P.I. Publication Nos. 8-238848 and 8-103642 and U.S. Pat. No. 4,533,254.

The organic silver salt can be dispersed into the dispersion having desired particle size by controlling the flowing velocity, the pressure difference on the occasion of the pressure falling and the times of treatment; and a flowing velocity of from 200 to 600 m/second, a pressure difference at the pressure falling of from 9 to 30 MPa are preferable from the viewpoint of the photographic properties and the particle size. A flowing velocity of from 300 to 600 m/second and a pressure difference of from 15 to 30 MPa are more preferable. The number of times of the treatment can be selected according to necessity; and is usually selected from 1 to 10, and is selected from 1 to 4 from the viewpoint of the product efficiency. It is not desired from the viewpoint of the dispersing properties and the photographic properties to raise the temperature of the dispersion under the high pressure. Under a high temperature exceeding 90° C., the particle size tens to be made large and the fog tends to be raised. Accordingly, it is preferable that a cooling device is attached before the process for applying the high pressure and the high velocity to the dispersion or after the process for falling the pressure and both of these processes, and the temperature of the dispersion is held within the range of from 5 to 80° C., and particularly from 5 to 65° C. The installation of the cooling device is particularly effective when the dispersion is performed at a high pressure within the range of from 15 to 30 MPa. As the cooling device, a device having double or triple pipes in which a static mixer installed, a multi-pipe heat changers or a helical pipe heat changer is optionally used according to the amount of heat to be changed. The diameter, thickness of the pipe wall and material of the pipe may be suitably selected considering the applied pressure. The cooling medium to be used in the cooling device, well water of 20° C., cold water of from 5 to 10° C. cooled by a freezing machine or ethylene glycol/water of −30° C. may be employed corresponding to the amount of heat to be exchanged.

When the organic silver salt is made to fine solid particles using a dispersing agent, for example, poly(acrylic acid), acrylic acid copolymers, synthesized anionic polymers such as maleic acid copolymers, mono maleate copolymers and acryloylmethylpropanesulfonic acid copolymers; semi-synthesized anionic polymers such as carboxymethyl starch and carboxymethyl cellulose, anionic polymers such as alginic acid and pectinic acid, the anionic surfactants described in Japanese Patent O.P.I. Publication No. 52-92716 and WO88/04794, the compounds described in Japanese Patent Application No. 7-530753, known anionic, nonionic and cationic surfactants, known polymers such as poly(vinyl alcohol), poly(vinyl pyrrolidone), hydroxypropyl cellulose and hydroxypropylmethyl cellulose, and natural polymers such as gelatin are optionally selected as the dispersing agent. When a solvent is employed as the dispersing medium, poly(vinyl butyral), butylethyl cellulose, methacrylate copolymers, maleic anhydride ester copolymers, polystyrene and butadiene-styrene copolymers are preferably employed.

Though it is usual method that a dispersing aid is mixed with the powder of the wet cake of the organic silver salt and the mixture in a surely state is put into the dispersing apparatus, the dispersion aid may be previously mixed with the organic silver salt and subjected to treatments by heat or by the solvent to prepare the powder or the wet cake of the organic silver salt. The pH of the dispersion may be controlled by a suitable pH controlling agent before, after or during the dispersing.

The organic silver salt may be roughly dispersed by controlling the pH and further dispersed to form the fine particles by varying the pH in the presence of the dispersing aid. In such the case, a fatty acid solvent may be used as the solvent for the roughly dispersing.

In the invention, the thermally developable material can be prepared by employing the mixture of the aqueous dispersion of the organic silver salt and the aqueous dispersion of light-sensitive silver salt. The mixing ratio of the light-sensitive silver salt and the organic silver salt can be decided according to the purpose. The ratio of the light-sensitive silver salt to the organic silver salt is preferably fro 1 to 30%, more preferably from 3 to 20%, and particularly preferably from 5 to 15%. The mixing of two or more kinds of the aqueous dispersion of the organic silver salt and two or more kinds of the aqueous dispersion of the light-sensitive silver salt is preferable means for controlling the photographic properties.

In the invention, a light-insensitive organic silver salt containing two or more reducible silver (I) ions in a molecule may be employed as the organic silver salt. In concrete, the compounds described in Japanese Patent Application No. 2001-251399 are usable. A silver salt of polymer containing acrylic acid may be employed.

Though the organic silver salt relating to the invention may be employed in an optional amount, and the amount of that is preferably from 0.15 to 5 g/m$^2$, more preferably from 0.3 to 3 g g/m$^2$, and further preferably from 0.5 to 2 g/m$^2$, in terms of silver.

In the silver salt photo-thermal photographic dry imaging material of the invention, a polymer is preferably contained which has at least one repeating unit of aliphatic monomer having a halogen radical releasable group. The polymer having the repeating unit which has the halogen radical releasable group may be prepared by polymerizing monomers previously having the halogen radical releasable group or by reaction of the halogen radical releasable group to a polymer having a substitutable group after the polymerization of the polymer.

In the invention, the aliphatic monomer having the halogen radical releasable group is preferably ones represented by the following Formula 1.

Formula 1

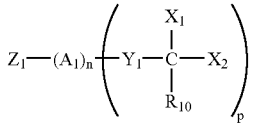

In Formula 1, $X_1$ and $X_2$ are each independently a halogen atom; $R_{10}$ is a hydrogen atom or a halogen atom; $Y_1$ is a di-valent linking group; and p is an integer of from 1 to 3. $A_1$ is an alkylene group, a cycloalkylene group, an alkenylene group or an alkynylene group; and n is 0 or 1. $Z_1$ is an ethylenic unsaturated group, an ethyleneimino group or an epoxy group.

The halogen atoms represented by $X_1$ and $X_2$ may be the same or different and is a fluorine atom, a chlorine atom, a bromine atom or an iodine atom. Among them, the chlorine atom, bromine atom or iodine atom is preferable, and the chlorine atom or bromine atom is more preferable and the bromine atom is particularly preferable.

$R_{10}$ is preferably a chlorine atom, a bromine atom or an iodine atom, more preferably the chlorine atom or the bromine atom, and particularly preferably the bromine atom.

The linking group represented by $Y_1$ is, for example, an —$SO_2$— group, an —N($R_6$)CO— group or an —OCO— group, and $R_6$ is a substituent. The substituent represented by $R_6$ is, for example, a halogen atom, an alkyl group, a cycloalkyl group, an alkenyl group, a cycloalkenyl group, an alkynyl group, an acyloxy group, an alkylthio group, a carboxyl group, an acylamino group, an acyl group or a trifluoromethyl group. p represents an integer of from 1 to 3.

$A_1$ may further have a substituent. Examples of the substituent are halogen atoms such as a fluorine atom, a chlorine atom and bromine atom; an alkyl group such as a methyl group, an ethyl group, a propyl group, a butyl group, a pentyl group, an iso-pentyl group, a 2-ethyl-hexyl group, an octyl group and a decyl group; an alkenyl group such as an ethenyl-2-propenyl group, a 3-butenyl group, a 1-methyl-3-propenyl group, a 3-pentenyl group and a 1-methyl-3-butenyl group; a cycloalkenyl group such as a 1-cycloalkenyl group and a 2-cycloalkenyl group; an alkynyl group such as an ethynyl group and a 1-propinyl group; an alkoxy group such as a methoxy group, an ethoxy group and propoxy group; an alkylcarbonyloxy group such as an acetyloxy group; an alkylthio group such as a methylthio group and a trifluoromethylthio group; a carboxyl group; an alkylcarbonylamino group such as an acetylamino group; a ureido group such as a methylaminocarbonylamino group; an alkylsuofonyl group such as a methanesulfonyl group and a trifluoromethanesulfonyl group; a carbamoyl group such as a carbamoyl group, an N,N-dimethylcarbamoyl group and a N-morpholinocarbamoyl group; a sulfamoyl group such as a sulfamoyl group, an N,N-dimethylsulfamoyl group and a morpholylsulfamoyl group; a trifluoromethyl group; a hydroxyl group; a nitro group; a cyano group; an alkylsulfonamide group such as a methanesulfonamide group and butanesulfonamide group; an alkylamino group such as an amino group, an N,N-dimethylamino group and an N,N-diethylamino group; a sulfo group; a phosphono group; a sulfite group; a sulfino group; an alkylsulfonylaminocarbonyl group such as a methanesulfonylaminocarbonyl group and ethnasulfonylaminocarbonyl group; an alkylcarbonylaminosulfonyl group such as an acetoamidosulfonyl group and a methoxyacetoamidosulfonyl group; an alkynylaminocarbonyl group such as an acetoamidocarbonyl group and methoxyacetoamidocarbonyl group; an alkylsulfinylaminocarbonyl group such as methanesulfinylaminocarbonyl group and ethanesulfinylaminocarbonyl group. When two or more substituent are there, they may be either the same as or different from each other. Provided that the substituent does not have an aryl and a heteroaryl group as a part thereof. n represents 0 or 1.

$Z_1$ is an ethylenic unsaturated group, an ethyleneimino group or an epoxy group. The ethylenic unsaturated group is, for example, a methylene group and a propylene group. Among them, the ethylenic unsaturated group is preferable and the methylene group is more preferable.

Concrete examples of the compound represented by Formula 1 are shown below; the invention is not limited to the following compounds.

1-1

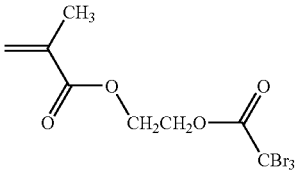

1-2

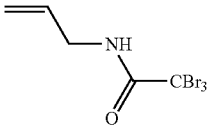

1-3

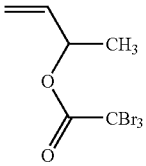

1-4

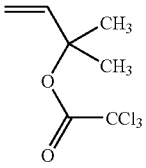

-continued 1-5

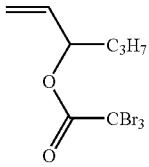

1-6

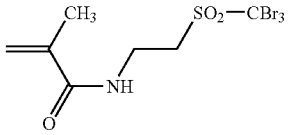

1-7

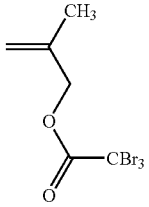

1-8

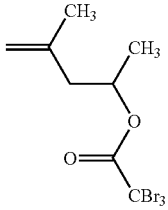

1-9

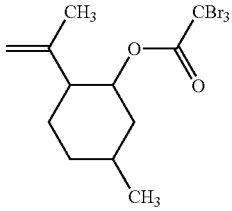

1-10

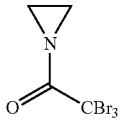

1-11

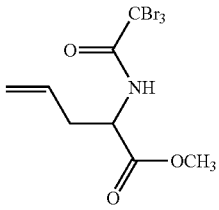

1-12

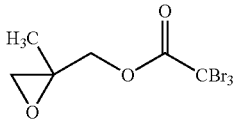

1-13

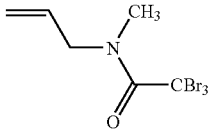

-continued 1-14

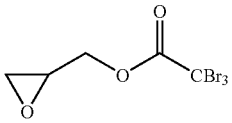

1-15

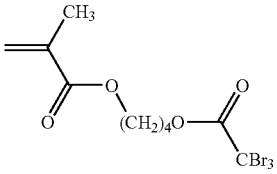

1-16

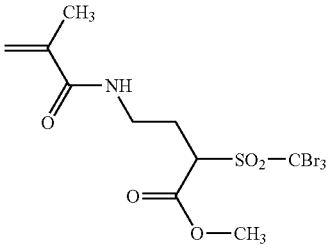

1-17

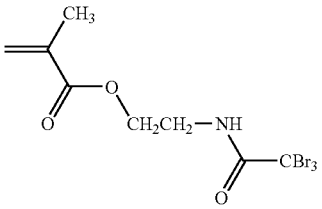

1-18

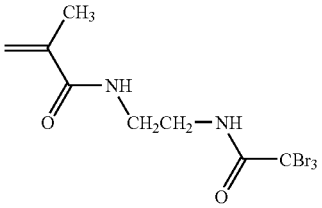

1-19

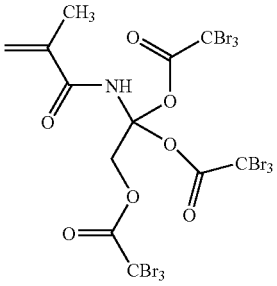

1-20

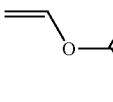

1-21

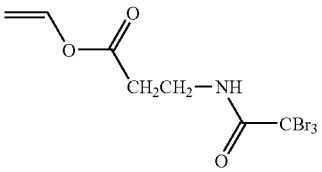

-continued 1-22

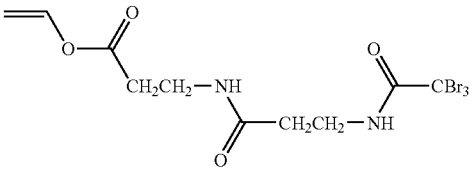

In the invention, the halogen radical releasable aliphatic monomer is preferably monomers represented by the following Formula 2.

Formula 2

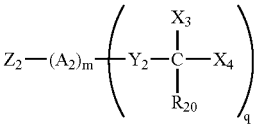

In Formula 2, $X_3$ and $X_4$ are each a halogen atom, which may be the same or different, such as a fluorine atom, a chlorine atom, a bromine atom and an iodine atom. Among them, the chlorine atom, bromine atom or iodine atom is preferable, and the chlorine atom or bromine atom is more preferable and the bromine atom is particularly preferable. $R_{20}$ is a hydrogen atom, a halogen atom or a substituent. As the substituent, the substituent is synonym for those represented by $R_6$ of Formula 1. $Y_2$ is an —N($R_3$)CO— group or an —OCO— group, and $R_3$ is a substituent. The substituent represented by $R_3$ is synonym for those represented by $R_6$ of Formula 1.

$A_2$ is an aromatic group or a heterocyclic group. The aromatic group is a single ring or condensed ring aryl group and preferably those having from 6 to 20 carbon atoms, and more preferably a phenyl group and a naphthyl group. Examples of the heterocyclic group are a pyridyl group, a pyradinyl group, a pyrimidyl group, a benzothiazolyl group, a benzoimidazolyl group, a thiadiazolyl group, a quinolyl group and an isoquinolyl group. These aromatic groups and the heterocyclic groups each may have a substituent. Examples of the substituent are halogen atoms such as a fluorine atom, a chlorine atom and bromine atom; an alkyl group such as a methyl group, an ethyl group, a propyl group, a butyl group, a pentyl group, an iso-pentyl group, a 2-ethyl-hexyl group, an octyl group and a decyl group; a cycloalkyl group such as a cyclohexyl group and a cycloheptyl group; an aryl group such as a phenyl group and a carboxyphenyl group; a heterocyclic group such as an imidazolyl group, a thiazolyl group, a benzooxazolyl group, a pyridyl group, a pyrrolyl group, an indolyl group and a pyrimidinyl group; an alkenyl group, such as an ethenyl-2-propenyl group, a 3-butenyl group, a 1-methyl-3-propenyl group, a 3-pentenyl group and a 1-methyl-3-butenyl group; a cycloalkenyl group such as a 1-cycloalkenyl group and a 2-cycloalkenyl group; an alkynyl groups such as an ethynyl group and a 1-propynyl group; alkoxy group such as a methoxy group, an ethoxy group and propoxy group; an acyloxy group such as an acetyloxy group and a benzoyloxy group; a heteroaryloxy group such as a 2-pyridyloxy group and pyrrolyloxy group; an alkylthio group such as a methylthio group and a trifluoromethylthio group; an arylthio group such as a phenylthio group and a 2-naphthylthio group; a heteroarylthio group such as a 3-thienylthio group and 3-pyrrolylthio group; an aralkyl group such as a benzyl group and a 3-chlorobenzyl group; a carboxyl group; an acylamino group such as an acetylamino group and a benzoylamino group; an acyloxycarbonylamino group such as an acetyloxycarbonylamino group and benzoyloxycarbonylamino group; a ureido group such as a methylaminocarbonylamino group and a phenylaminocarbonylamino group; a sulfonylamino group such as methanesulfonylamino group and a benzenesulfonylamino group; an acyl group such as an acetyl group, a benzoyl group; a sulfonyl group such as a methanesulfonyl group and a trifluoromethanesulfonyl group; a carbamoyl group such as a carbamoyl group, an N,N-dimethylcarbamoyl group and a N-morpholinocarbamoyl group; a sulfamoyl group such as a sulfamoyl group, an N,N-dimethylsulfamoyl group and a morpholylsulfamoyl group; a trifluoromethyl group; a hydroxyl group; a styryl group; a nitro group; a cyano group; a sulfonamido group such as a methane sulfonamide group and a butanesulfonamido group; an amino group such as an amino group and an N,N-dimethylamino group; a sulfo group; a phosphono group; a sulfite group; a sulfino group; a sulfonylaminocarbonyl group such as a methanesulfonylaminocarbonyl group and a ethanesufonylaminocarbonyl group; an acylaminosulfonyl group such as an acetoamidosulfonyl group and a methoxyacetoamidocarbonyl group; and a sulfinyhlaminocarbonyl group such as methanesulfinylaminocarbonyl group and an ethanesulfinylaminocarbonyl group. When there are two or more substituents, they may either be the same as or different from each other. m is 0 or 1.

$Z_2$ is an ethylenic unsaturated group, an ethyleneimino group or an epoxy group. Examples of the ethylenic unsaturated group are an ethylene group and a propylene group. Among the above, the ethylenic unsaturated group is preferable, and the methylene group is more preferable.

Concrete examples of the compound represented by Formula 2 are listed below, but the invention is not limited to them.

2-1

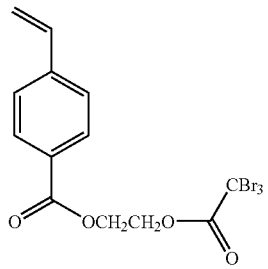

2-2

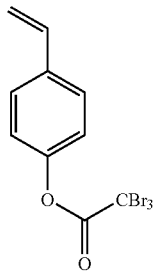

-continued 2-3

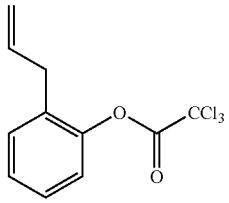

2-4

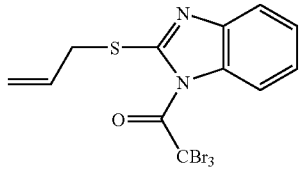

2-5

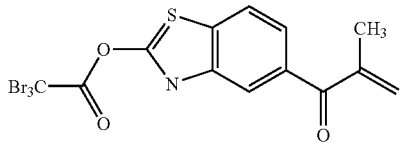

2-6

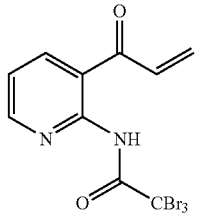

2-7

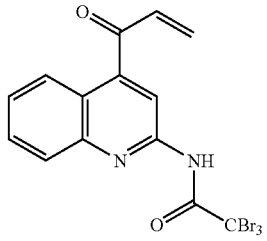

2-8

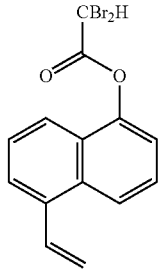

2-9

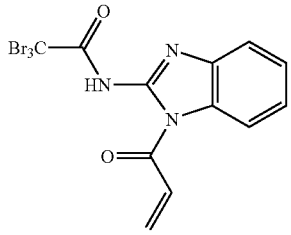

-continued 2-10

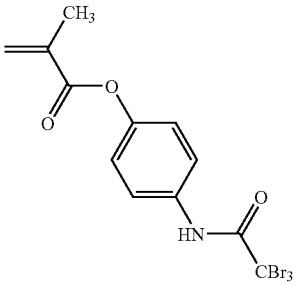

2-11

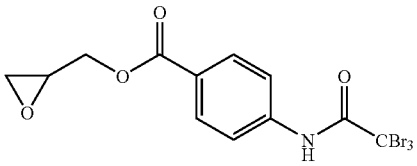

2-12

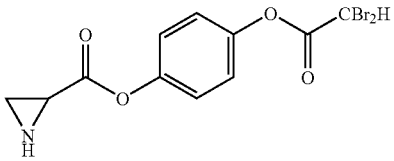

2-13

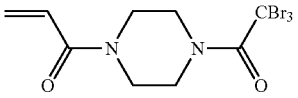

2-14

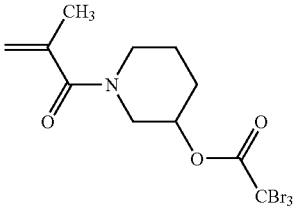

2-15

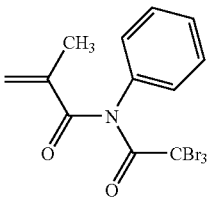

Concrete examples of the copolymers having the repeating units derived from the compounds represented by Formula 1 or 2 are listed below, but the invention is not limited to them.

TABLE 1

| Exemplified compound No. | Monomer (a) represented by Formula 1 or 2 | Monomer (b) to be copolymerized | Content of monomer unit (a) (percent by weight) | Number averaged molecular weight |
|---|---|---|---|---|
| P-1 | 1-1 | — | 100 | 5000 |
| P-2 | 1-1 | B | 25 | 8000 |
| P-3 | 1-17 | — | 100 | 4000 |
| P-4 | 1-17 | E | 40 | 7000 |
| P-5 | 1-20 | Synthesizing example 4 | 21 | 15000 |
| P-6 | 1-20 | B | 34 | 10000 |
| P-7 | 1-20 | E | 48 | 8000 |

TABLE 1-continued

| Exemplified compound No. | Monomer (a) represented by Formula 1 or 2 | Monomer (b) to be copolymerized | Content of monomer unit (a) (percent by weight) | Number averaged molecular weight |
|---|---|---|---|---|
| P-8 | 2-2 | — | 100 | 3000 |
| P-9 | 2-2 | E | 63 | 6000 |
| P-10 | 2-8 | E | 42 | 11000 |
| P-11 | 2-8 | B | 13 | 50000 |
| P-12 | 2-10 | — | 100 | 5000 |
| P-13 | 2-10 | B | 35 | 4500 |

B: Butyl acrylate
E: Ethyl acrylate

The content of the monomer (a) shown in Table 1 is a value obtained by the following equation in which absM is light absorbance at 254 nm per 1 mg of the compound represented by Formula 1 or 2 and absP is light absorbance at 254 nm per 1 mg of the polymer having the repeating unit derived from the compound represented by Formula 1 or 2.

$$\text{Content of the Monomer unit } (a) = absP/absM \times 100\%$$

Polymer having the repeating units derived from the monomer of the compound represented by Formula 1 or 2 may be employed singly or in a combination of two or more.

Synthesis of the ethylenic unsaturated group, the compound having an ethyleneimino group or an epoxy group, and the polymer of them are easily performed referring publications, for example, "New Experimental Chemical Course", Maruzen.

The synthesizing examples of the polymer compound having the repeating units derived from the monomers represented by Formula 1 or 2 described below.

SYNTHESIZING EXAMPLE 1

Synthesis of Exemplified Compound 1-1

Five point eight grams of triethylamine, 25 ml of dichloromethane and 5.0 g of 2-hydroxyethyl methacrylate were successively mixed and a solution of 12.1 g of tribromoacetyl chloride dissolved in 10 ml of dichloromethane was dropped into the resultant mixture while cooling by iced water. After the finish of the dropping, the mixture was stirred for 3 hours at a room temperature. After that, 100 ml of ethyl acetate was added and the organic substance layer was successively washed by 50 ml of 1 mole/L hydrochloric acid, 50 ml of a saturated aqueous solution of sodium hydrogencarbonate, and a saturated sodium chloride aqueous solution. The washed liquid was dried by magnesium sulfate and filtrated and vacuum condensed to obtain crude crystals. The crude crystals were recrystallized employing methanol. Thus 11.0 g of the objective Exemplified Compound 1-1 was obtained.

SYNTHESIZING EXAMPLE 2

Synthesis of Exemplified Compound 2-2

Six point three grams of triethylamine, 25 ml of dichloromethane and 5.0 g of 4-vinylphenol were successively mixed, and a solution of 14.4 g of tribromoacetyl chloride dissolved in 10 ml of dichloromethane was dropped into the resultant mixture while cooling by iced water. After the finish of the dropping, the mixture was stirred for 3 hours at a room temperature. After that, 100 ml of ethyl acetate was added and the organic substance layer was successively washed by 50 ml of 1 mole/L hydrochloric acid, 50 ml of a saturated aqueous solution of sodium hydrogencarbonate, and 50 ml of a saturated sodium chloride aqueous solution. The washed liquid was dried by magnesium sulfate and filtrated and vacuum condensed to obtain crude crystals. The crude crystals were recrystallized employing methanol. Thus 13.2 g of the objective Exemplified Compound 2-2 was obtained.

SYNTHESIZING EXAMPLE 3

Synthesis of Homopolymer Having the Repeating Unit of Exemplified Compound 1-1

Under a nitrogen atmosphere, 10 g of the Exemplified Compound 1-1, 80 ml of anhydrated tetrahydrofuran and 0.3 g of boron trifluoride-diethyl ether complex were successively mixed and the mixture was refluxed for 10 hours while heating. After cooling by standing, the reacting liquid was vacuum condensed. The resultant residue was dissolved by tetrahydrofuran and purified by reprecipitaion employing methanol. Thus 5 g of homopolymer having a number average molecular weight of 5,000.

SYNTHESIZING EXAMPLE 4

Synthesis of Copolymer Having at Least One Repeating Unit of Exemplified Compound 1-20

Ten grams of decane butyral (#2000-L, polymerization degree of about 300), 300 ml of toluene and 2.5 g of pyridine were successively mixed and a solution of 18 g of tribromoacetyl chloride dissolved in 20 ml of toluene was dropped in to the mixture while cooling by iced water. After the finish of the dropping, the mixture was stirred for 3 hours at a room temperature. After that, 500 ml of ethyl acetate was added and the organic substance layer was successively washed by 50 ml of 1 mole/L hydrochloric acid, 50 ml of a saturated aqueous solution of sodium hydrogencarbonate, and 50 ml of a saturated sodium chloride aqueous solution. The washed liquid was dried by magnesium sulfate and filtrated and vacuum condensed. The resultant residue was dissolved in methyl ethyl ketone and purified by reprecipitaion using hexane. Thus 19 g of copolymer having a number average molecular weight of 20,000. It is confirmed that the content of the vinyl tribromoacetate was 21% by weight by the measurement of light absorbance at 254 nm.

The polymer compound having the repeating unit derived from the compound represented by Formula 1 or 2 may be contained in the light-sensitive layer containing silver halide emulsion and the light-insensitive layer; preferably contained in the light-sensitive layer or the light-insensitive layer adjacent to the light-sensitive layer. When the polymer compound having the repeating unit derived from the compound represented by Formula 1 or 2 is added into the thermally developable material, the adding amount is preferably about from $1\times10^{-4}$ to 1.0 mole, and particularly from $1\times10^{-3}$ to 0.3 moles, in terms of monomer unit (a) pre mole of silver, even though the amount is not specifically limited.

The polymer compound having the repeating unit derived from the compound represented by Formula 1 or 2 relating to the invention can be used by dissolving in a suitable solvent, for example, alcohols such as methanol, ethanol, propanol and fluorinated alcohol; a ketone such as acetone and methyl ethyl ketone; dimethylformamide; dimethylsulfoxide and methyl cellosolve.

Moreover, the polymer can be added by known emulsified dispersing method. For example, the polymer is dissolved by a high-boiling solvent such as dibutyl phthalate, tricresyl phosphate and diethyl phthalate, and an assistance solvent such as ethyl acetate and cyclohexanone and mechanically dispersed to form an emulsified dispersion, and the dispersion is added to the desired structural layer. The polymer compound having the repeating unit derived from the compound represented by Formula 1 or 2 may also be added by a method known as the solid dispersion method, in which the polymer compound having the repeating unit derived from the compound represented by Formula 1 or 2 is dispersed in aqueous medium as fine particles by a means such as a ball mill, a colloid mill and an ultrasonic dispersing machine and the resultant dispersion is added to the optional layer.

In the silver salt photo-thermal photographic imaging material according to the invention, at least one of the compounds represented by the following Formula 3 is preferably added as a stabilizing agent.

Formula 3

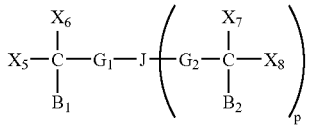

In Formula 3, $X_5$, $X_6$, $X_7$ and $X_8$ are each a halogen atom, which may be the same or different, such as a fluorine atom, a chlorine atom, a bromine atom and an iodine atom. Among them, the chlorine atom, bromine atom or iodine atom is preferable, and the chlorine atom or bromine atom is more preferable and the bromine atom is particularly preferable.

$B_1$ and $B_2$ are each independently a hydrogen atom, a halogen atom or a substituent. Examples of the substituent are an alkyl group, an aryl group, a cycloalkyl group, an alkenyl group, a cycloalkenyl group, an alkynyl group, an amino group, an acyl group, an acyloxy group, an acylamino group, a sulfonylamino group, a sulfamoyl group, a carbamoyl group, an alkylthio group, a sulfonyl group, an alkylsulfonyl group, a sulfinyl group, a cyano group and a heterocyclic group.

p is an integer of from 1 to 3.

$G_1$ and $G_2$ are each a linking group, for example, an —$SO_2$— group, a —CO— group, an —NHCO— group, an —OOC— group and an —$N(R_8)SO_2$— group. $G_1$ and $G_2$ may form a linking group combined with a group selected from —S—, —NH—, —CO— and —O— through an alkyl group. $R_8$ is a substituent. Examples of the substituent represented by $R_8$ are a halogen atom, an alkyl group, a cycloalkyl group, an alkenyl group, a cycloalkenyl group, an alkynyl group, an acyloxy group, an alkylthio group, a carboxyl group, an acylamino group, an acyl group and a trifluoromethyl group. $G_1$ and $G_2$ may be the same as or different from each other. When both of $G_1$ and $G_2$ are —$SO_2$— groups, p is 2 or 3.

J is a p+1-valent alkylene group, a cycloalkylen group, an alkenylene group, an alkynylene group, and is preferably an alkylene group and a cycloalkylene group each having the total carbon atom of from 2 to 20, and particularly preferably those having from 2 to 10 total carbon atoms. These groups each may further have a substituent, for example, halogen atoms such as a fluorine atom, a chlorine atom and bromine atom; an alkyl group such as a methyl group, an ethyl group, a propyl group, a butyl group., a pentyl group, an iso-pentyl group, a 2-ethyl-hexyl group, an octyl group and decyl group; a cycloalkyl group such as a cycloalkyl group and a cycloheptyl group; an alkenyl group such as an ethenyl-2-propenyl group, a 3-butenyl group, a 1-methyl-3-propenyl group, a 3-pentenyl group and a 1-methyl-3-butenyl group; an a cycloalkenyl group such as a 1-cycloalkenyl group and 2-cycloalkenyl group; an alkynyl group such as an ethynyl group and a 1-propinyl group; an alkoxy group such as a methoxy group, an ethoxy group and a propoxy group; an alkylcarbonyloxy group such as an acetyloxy group; an alkylthio group such as a methylthio group and a trifluoromethylthio group; a carboxyl group; an alkylcarbonylamino group such as an acetylamino group; a ureido group such as a enthylaminocarbonylamino group; an alkylsulfonylamino group such as a methanesulfonylamino group; an alkylsulfonyl group such as a methanesulfonyl group and trifluoromethanesulfonyl group; a carbamoyl group such as a carbonyl group, an N,N-dimethylacarbamoyl group and an N-morpholinocarbamoyl group; a sulfamoyl group such as a sulfamoyl group, an N,N-dimethylsulfamoyl group and a morpholinosulfamoyl group; a trifluoromethyl group; a hydroxyl group; a nitro group; a cyano group; an alkylsulfonamido group such as a methanesulfonamido group and a butanesulfonamido group; an alkylamino group such as an amino group and an N,N-dimethylamino group; a sulfo group; a phosphono group; a sulfite group; a sulfino group; an alkylsulfonylaminocarbonyl group such as a methanesulfonylaminocarbonyl group and a ethanesufonylaminocarbonyl group: an alkylcarbonylaminosulfonyl group such as an acetoamindosulfonyl group and a methoxyacetoamidocarbonyl group; and an alkylsulfinylaminocarbonyl group such as methanesulfinylaminocarbonyl goup and an ethanesulfinylaminocarbonyl group. When there are two or more substituents, they may be the same as or different from each other. Provided that the substituent does not have an aryl and an heteroaryl group as a part thereof.

Concrete examples of the compound represented by Formula 3 are listed below; the invention is not limited to them.

AF-1

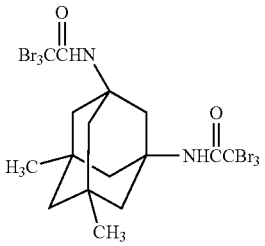

AF-2

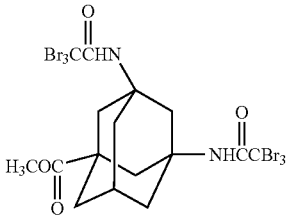

AF-3

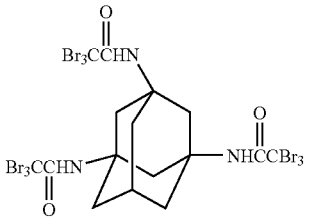

-continued

AF-4

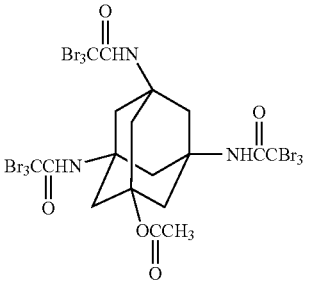

AF-5

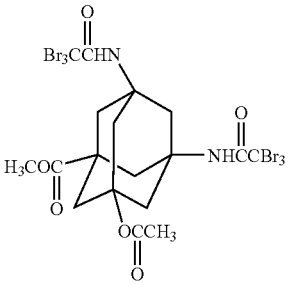

AF-6

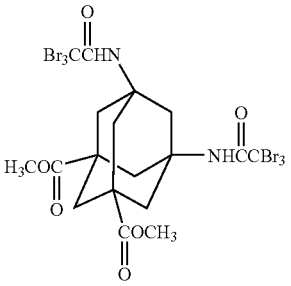

AF-7

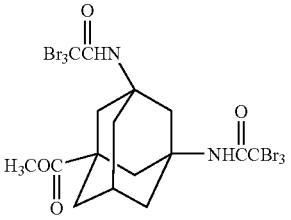

AF-8

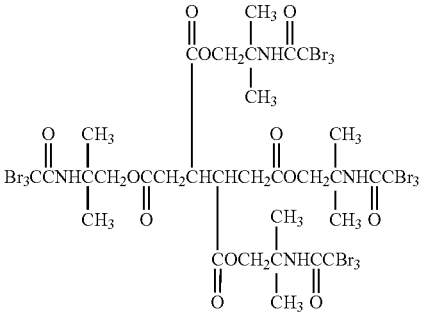

AF-9

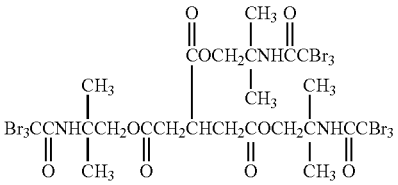

-continued
AF-10
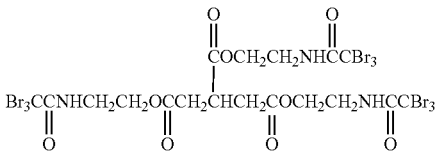
AF-11
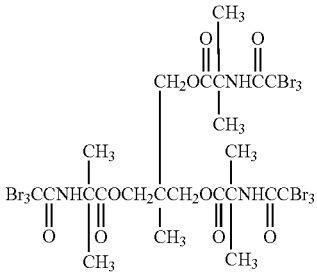
AF-12
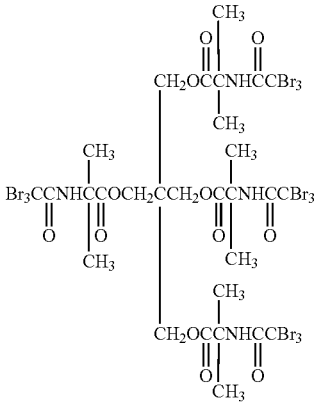
AF-13
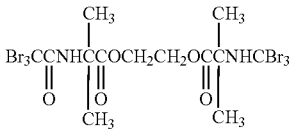
AF-14
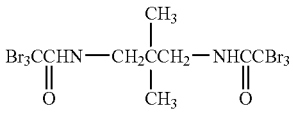
AF-15
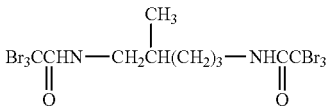
AF-16
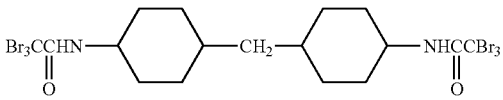
AF-17
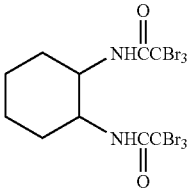
-continued
AF-18
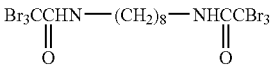
AF-19
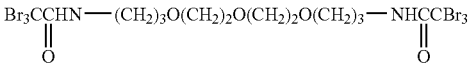
AF-20
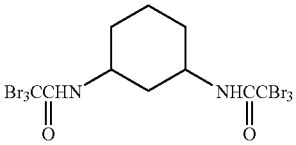
AF-21
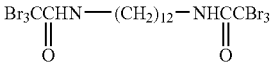
AF-22
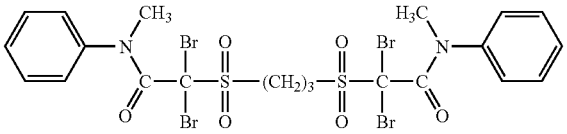
AF-23
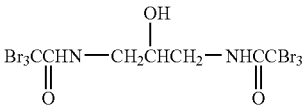
AF-24
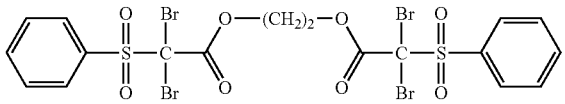
AF-25
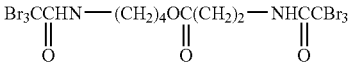
AF-26
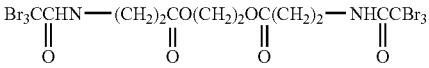
AF-27
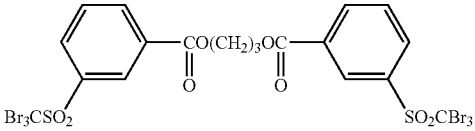
AF-28
$Br_3CSO_2CBr_2(CH_2)_4CBr_2SO_2CBr_3$
AF-29
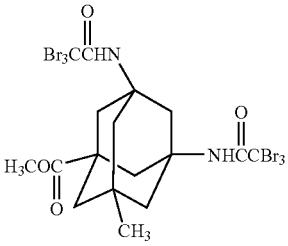

-continued

AF-30

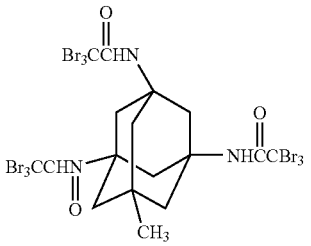

AF-31

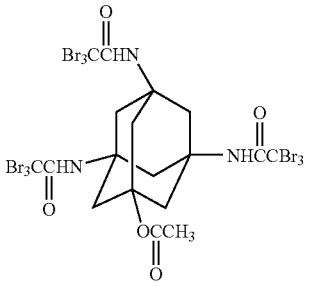

The compounds represented by Formula 3 can be added to either the light-sensitive layer containing the silver halide emulsion or the light-insensitive layer; and the addition to the light-sensitive layer or to the light-insensitive layer adjacent to the light-sensitive layer is preferred. Though the adding amount of the compounds to be added to the silver salt photo-thermal photographic material is not specifically limited, the amount of approximately from $1\times10^{-4}$ to 1.0 mole, and particularly from $1\times10^{-3}$ to 0.3 moles, is preferable.

It is one of the features of the silver salt photo-thermal photographic material of the invention that a silver ion reducing agent, hereinafter referred to as a reducing agent, is contained in the light-sensitive material. Though the kind of the reducing agent to be employed is not specifically limited in the invention, at least one compound selected from the compounds represented by the following Formula A-1, A-2 or A-3 is preferred.

Formula A-1

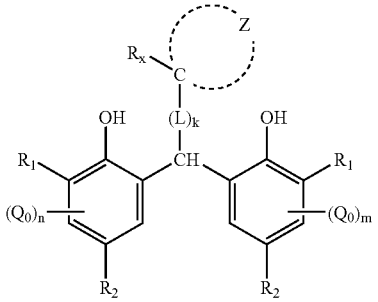

Formula A-2

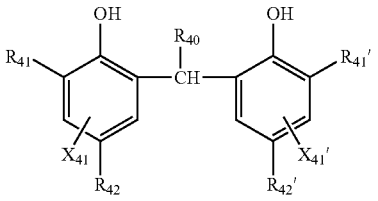

-continued

Formula A-3

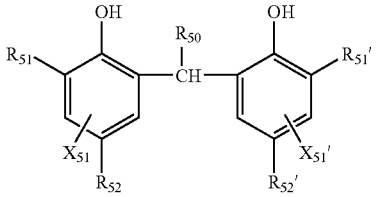

Formula A

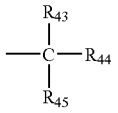

In Formula A-1, Z is a group of atoms necessary for forming a 3- to 10-member ring, the ring is preferably a 3-to 10-member non-aromatic or a 5 or 6-member, and more preferably a 3- to 10-member non-aromatic ring. Concrete examples of the 3-member ring are a cyclopropyl group, an alizidyl group and oxylanyl group; those of the 4-member ring are a cyclobutyl group, a cyclobutenyl, an oxetanyl group and an azetidinyl group; those of 5-member ring are a cyclopentyl group, a cyclopentenyl group, a cyclopentanedienyl group, a tetrahydrofuranyl group, a pyrrolydinyl group and a tetrahydrotienyl group; those of 6-member ring are a cyclohexyl group, a cyclohexenyl group, a cyclohexadienyl group, a tetrahydropyranyl group, a pyranyl group, a piperydinyl group, a dioxanyl group, a tetrahydrothiopyranyl group, a norcaranyl group, norpinanyl group and a norbornyl group; those of 7-member ring are a cycloheptyl group, a cycloheptinyl group and a cycloheptadienyl group; those of 8-member ring are a cyclooctanyl group, a cyclooctenyl group, a cyclooctadienyl group and a cyclooctatienyl group; those of 9-member ring are a cyclononanyl group, a cyclononenyl group, a cyclononadienyl group and a cyclononatrienyl group; and those of 10-member ring are a cyclodecanyl group, a cyclodecenyl group, a cyclodevadienyl group and a cyclodecatrienyl group.

The 3- to 6-member rings are preferable, the 5- and 6-member rings are more preferable and the 6-member ring is most preferable. Among them a hydrocarbon rings without any hetero atom are preferred. The ring may be form a spiro bond with another ring through a spiro atom and may be condensed with another ring including an aromatic ring in any way. The ring may have an optional substituent thereon. It is particularly preferable that the hydrocarbon ring is a ring having an alkenyl or an alkynyl structure including a —C═C— bond or a —C≡C— bond.

Concrete examples of the substituent are a halogen atom such as a fluorine atom, a bromine atom and a bromine atom; an alkyl group such as a methyl group, an ethyl group, a propyl group, a butyl group, a pentyl group, an iso-pentyl group, a 2-ethyl-hexyl group, an octyl group and decyl group; a cycloalkyl group such as a cycloalkyl group and a cycloheptyl group; an alkenyl group such as an ethenyl-2-propenyl group, a 3-butenyl group, a 1-methyl-3-propenyl group, a 3-pentenyl group and a 1-methyl-3-butenyl group; an acycloalkenyl group such as a 1-cycloalkenyl group and 2-cycloalkenyl group; an alkynyl group such as an ethynyl group and a 1-propinyl group; an alkoxy group such as a methoxy group, an ethoxy group and a propoxy group; an alkylcarbonyloxy group such as an acetyloxy group; an alkylthio group such as a methylthio group and a trifluoromethylthio group; a carboxyl group; an alkylcarbonylamino group such as an acetylamino group; a ureido group such as a enthylaminocarbonylamino group; an alkylsulfonylamino group such as a methanesulfonylamino group; an alkylsulfonyl group such as a methanesulfonyl group and trifluoromethanesulfonyl group; a carbamoyl group such as a carbonyl group, an N,N-dimethylacarbamoyl group and an N-morpholinocarbamoyl group; a sulfamoyl group such as a sulfamoyl group, an N,N-dimethylsulfamoyl group and a morpholinosulfamoyl group; a trifluoromethyl group; a hydroxyl group; a nitro group; a cyano group; an alkylsulfonamido group such as a methanesulfonamido group and a butanesulfonamido group; an alkylamino group such as an amino group and an N,N-dimethylamino group; a sulfo group; a phosphono group; a sulfite group; a sulfino group; an alkylsulfonylaminocarbonyl group such as a methanesulfonylaminocarbonyl group and a ethanesufonylaminocarbonyl group; an alkylcarbonylaminosulfonyl group such as an acetoamidosulfonyl group and a methoxyacetoamidocarbonyl group; and an alkylsilfinylaminocarbonyl group such as methanesulfinylaminocarbonyl group and an ethanesulfinylaminocarbonyl group. When there are two or more substituents, they may be the same as or different from each other. Particularly preferable substituent is the alkyl group.

The case of that Z is a 5- or 6-member aromatic ring is described below. The aromatic hydrocarbon ring may be s single ring or a condensed ring and preferably a single or double ring having from 6 to 30 carbon atoms such as a benzene ring or a naphthalene ring are employable, and the benzene ring is preferably employed. The aromatic heterocyclic ring is preferably a 5- or 6-membered heterocyclic ring which may have a condensed ring. As such the heterocyclic rings, the followings are preferable: an imidazole ring, a pyrazole ring, a thiophene ring, a furan ring, a pyrrol ring, a pyridine ring, a pyrimidine ring, a pyrazine ring, a pyridazine ring, a triazole ring, a triazine ring, an indole ring, an indazole ring, a purine ring, a thiadiazole ring, an oxadiazole ring, a quinoline ring, a phthalazine ring, a naphthilizine ring, a quinoquizaline ring, a quinazoline ring, a cinnoline ring, puterizine ring, an acridine ring, a phenanthoroline ring, a phenazine ring, a tetrazole ring, a thiazole ring, an oxazole ring, a benzimidazole ring, a benzoxazole ring, a benzthizole ring, an indolenine ring and a tetrazaindene ring. The imidazole ring, pyrazole ring, thiophene ring, furan ring, pyrrol ring, triazole ring, thiadiazole ring, tetrazole ring, thiazole ring, benzimidazole and benzothiazole are more preferable, and the thiophene ring, furan ring and thiazole ring are particularly preferred. The foregoing rings each may be condensed in any form with another ring including an aromatic ring. The rings each may have an optional substituent thereon. As the substituent, those described as the substituents for the foregoing 3- to 10-membered non-aromatic rings are applicable. When Z is 5- or 6-membered aromatic ring, the 5-membered rings are most preferable.

$R_1$ and $R_2$ are each a hydrogen atom, an alkyl group, an aryl group or a heterocyclic group, and the alkyl group having from 1 to 10 carbon atoms are preferable in concrete. Concrete examples of the alkyl group are a methyl group, an ethyl group, a propyl group, an iso-propyl group, a butyl group, a t-butyl group, a pentyl group, an iso-pentyl group, a 2-ethylhexyl group, an octyl group, a decyl group, a cyclohexyl group, a cycloheptyl group, a 1-methylcyclohexyl group, an ethenyl-2-propenyl group, a 3-butenyl group, a 1-methyl-3-propenyl group, a 3-pentenyl group, a 1-methyl-3-butenyl group, a 1-cycloalkenyl group, a 2-cycloalkenyl group, an ethynyl group and a 1-propynyl group. As $R_1$, the methyl group, ethyl group, iso-propyl group, t-butyl group, cyclohexyl group, and 1-methylcyclohexyl group are preferable, and the t-butyl group and 1-methylhexyl group are most preferable. As $R_2$, the methyl group, ethyl group, iso-propyl group, t-butyl group, cyclohexyl group, 1-methylcyclohexyl group and 2-hydroxyethyl group are preferable, and the methyl group and 2-hydroxyethyl group are more preferable. Concrete examples of the aryl group represented by $R_1$ or $R_2$ are a phenyl group, a naphthyl group and an anthranyl group. Concrete examples of the heterocyclic group represented by $R_1$ or $R_2$ are an aromatic heterocyclic group such as a pyridyl group, a quinolyl group, an iso-quinolyl group, an imidazolyl group, a pyrazolyl group, a triazolyl group, an oxazolyl group, a thiazolyl group, an oxadiazolyl group, a thiadiazolyl group and a tetrazolyl group; and a non-aromatic heterocyclic group such as a piperdino group, a morpholino group, a tetrahydrofuryl group, a tetrahydrothienyl group and a tetrahydropiranyl group. These groups each may have a substituent such as those described as the substituent on the foregoing rings.

In the most preferable combination of $R_1$ and $R_2$, $R_1$ is a tertiary alkyl group such as the t-butyl group and 1-methylcyclohexyl group and $R_2$ is a primary alkyl group such as the methyl group and 2-hydroxyethyl group.

$R_x$ represents a hydrogen atom or an alkyl group, and concretely examples of that are a methyl group, an ethyl group, a butyl group, a t-butyl group, a pentyl group, an iso-pentyl group, a 2-ethyl-hexyl group, an octyl group, a decyl group, a cyclohexyl group, a cycloheptyl group, a 1-methylcyclohexyl group, an ethenyl-2-propenyl group, a 3-butenyl group, a 1-methyl-3-propenyl group, a 3-pentenyl group, a 1-methyl-3-butenyl group, a 1-cycloalkenyl group, a 2-cycloalkenyl group, an ethynyl group, and 1-propynyl group. The methyl group, ethyl group and isopropyl group are more preferable. $R_x$ is preferably a hydrogen atom.

$Q_0$ is a group capable of substituting on the benzene ring, concrete examples thereof are an alkyl group such as a methyl group, an ethyl group, a propyl group, an iso-propyl group, a t-butyl group, a pentyl group, a hexyl group and a cyclohexyl group; a halogenated alkyl group such as a trifluoromethyl group and a perfluorooctyl group; a cycloalkyl group such as a cyclohexyl group and a cyclopentyl group; an alkynyl group such as a propalgyl group; a glycidyl group, an acryl group, a methacryl group, an aryl group such as a phenyl group; a heterocyclic group such as a pyridyl group, a thiazolyl group, an oxazolyl group, an imidazolyl group, a furyl group, pyrrolyl group, a pyradinyl group, a pyrimidinyl group, a pyridazinyl group, a selenazolyl group, sulforanyl group, a piperidinyl group, a pyrazolyl group and a tetrazolyl group; a halogen atom such as a chlorine atom, a bromine atom, an iodine atom and a fluorine atom; an alkoxy group such as a methoxy group, an ethoxy group, a propyloxy group, a pentyloxy group, a cyclopentyloxy group, a hexyloxy group and a cyclohexyloxy group; an aryloxy group such as a phenoxy group, an alkoxycarbonyl group such as a methyloxycarbonyl group, an ethyloxycarbonyl group and a butyloxycarbonyl group; an aryloxycarbonyl group such as a phenyloxycarbonyl group; a sulfonamide group such as a methanesulfonamide group, an ethanesulfonamide group, a butansulfonamide group, a hexanesulfonamide group, a cyclohexansulfonamide group and a benzenesulfonamide group; a sulfamoyl group such as an aminosulfonyl group, a methylaminosulfonyl group, a dimethylaminosulfonyl group, a butylaminosulfonyl group, a hexylaminosulfonyl group, a cyclohexylaminosulfonyl group, a phenylaminosulfonyl group and 2-pyridylaminosulfonyl group; a urethane group such as a methylureido group, an ethylureido group, a pentylureido group, a phenylureido group and a 2-pyridylureido group; an acyl group such as an acetyl group, a propionyl group, a butanoyl group, a hexanoyl group, a cyclohexanoyl group, a benzoyl group and pyridinoyl group; a carbamoyl group such as an aminocarbonyl group, a methylaminocarbamoyl group, a dimethylaminocarbamoyl group, a propylaminocarbamoul group, a pentylaminocarbamoyl group, a cyclohexylaminocarbamoyl group, a phenylaminocarbamoyl group and a 2-pyridylaminocarbamoyl group; an amino group such as an acetoamido group, a propionamide group, a butanamido group, a hexanamido group and a benzamido group; a sulfonyl group such as a methylsulfonyl group, a phenylsulfonyl group, butylsulfonyl group, a cyclohexylsulfonyl group, a phenylsulfonyl group and a pyridylsulfonyl group; an amino group such as an amino group, an ethylamino group, an anilino group and a 2-pyridylamino group; a cyano group; a nitro group; a sulfo group; a carboxyl group; a hydroxyl group; and a oxazamoyl group. These groups each may be substituted by each of these groups. n and m are each an integer of from 0 to 2, and it is most preferable that both of them are 0.

L represents a di-valent linking group, and is preferably an alkylene group such as a methylene group, an ethylene group and a propylene group. The number of the carbon atom is preferably from 1 to 20, and more preferably from 1 to 5. k represents an integer of from 0 or 1, and is most preferably 0.

In Formula A-2, $R_{40}$ represents the foregoing Formula A, and $R_{43}$ through $R_{45}$ are each a hydrogen atom or a substituent. Examples of the substituent represented by $R_{43}$ through $R_{45}$ are an alkyl group such as a methyl group, an ethyl group, a propyl group, an iso-propyl group, a cyclopropyl group, a butyl group, an iso-butyl group, a sec-butyl group, a t-butyl group, a cyclohexyl group and a 1-methycyclohexyl group; an alkenyl group such as a vinyl group, a propenyl group, a butenyl group, a pentenyl group, an iso-hexenyl group, a cyclohexenyl group, a butenylidene group, an iso-pentilydene group; an alkynyl group such as an ethynyl group and propynylidene group: an aryl group such as a phenyl group and a naphthyl group; a heterocyclic group such as a furyl group, a thienyl group, a pyridyl group and a tetrahydrofuranyl group; halogen atoms; a hydroxyl group; an alkoxy group; an aryloxy group; an acyloxy group; a sulfonyloxy group; a carboxy group; an alkoxycrbonyl group; an aryloxycarbonyl group; a carbamoyl group; a sulfamoyl group; a cyano group; and a sulfo group.

When C in Formula A does not form any ring with $R_{43}$ through $R_{45}$, $R_{40}$ contains an ethylene group such as a 2,6-dimethyl-5-heptenyl and a 1,5-dimethyl-4-hexenyl or an acetylene group such as a propynyl group; these groups may have a substituent.

When C in formula A form a ring such as a phenyl ring, a naphthyl ring, a furyl ring, a thienyl ring, a pyridyl ring, a cyclohexyl ring and a cyclohexenyl ring, with one of $R_{43}$ through $R_{45}$, $R_{40}$ has a an ethylene group such as a vinyl group, a propenyl group, an acryloxy group and a methacryloxy group, or an acetylene group such as an ethynyl group and an acetylenecarbonyloxy group at out of the ring; these groups may have a substituent.

$R_{41}$, $R_{41}'$, $R_{42}$, $R_{42}'$, $X_{41}$ and $X_{41}'$ are each a hydrogen atom or a substituent. As the substituent, those described with respect to $R_{43}$ through $R_{45}$ are applicable. $R_{41}$, $R_{41}'$, $R_{42}$ and $R_{42}'$ are each preferably an alkyl group, in concrete, the alkyl groups described regarding to $R_{43}$ through $R_{45}$ are applicable.

In Formula A-3, $R_{50}$ represents a hydrogen atom or a substituent. As the substituent, those described regarding to $R_{43}$ through $R_{45}$ of Formula A-2 are applicable. $R_{50}$ is preferably a hydrogen atom, an alkyl group, an alkenyl group or an alkynyl group, more preferably a hydrogen atom or an alkyl group.

$R_{51}$, $R_{51}'$, $R_{52}$, $R_{52}'$, $X_{51}$ and $X_{51}'$ are each a hydrogen atom or a substituent. As the substituent, those described regarding $R_{43}$ through $R_{45}$ of Formula A-2 are applicable; and an alkyl group, an alkenyl group and an alkynyl group are preferable. In concrete, the examples in the description of the alkyl group, alkenyl group and alkenyl group of $R_{43}$ through $R_{45}$ are applicable. Provided that at least one of $R_{51}$, $R_{51}'$, $R_{52}$, $R_{52}'$, $X_{51}$ and $X_{51}'$ contains an ethylene group such as a vinyl group, an aryl group, and a methacryloxymethyl group or an acetylene group such as an ethylnyl group, a propagyl group and a propagyloxycarbonyloxymethyl group; these groups may have a substituent.

In the invention, the compound represented by Formula A-1 is preferably employed in a combination with a compound represented by the following Formula A-4. The ratio of the amount of the compound of Formula A-1 to the amount of the compound of Formula A-4 is preferably from 95:5 to 55:45, more preferably from 90:10 to 60:40.

Formula A-4

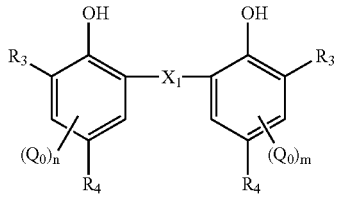

In Formula A-4, $X_1$ is a charcogen atom or a CHR group. The charcogen is sulfur, selenium and tellurium and preferably a sulfur atom. R in the CHR is a hydrogen atom, a halogen atom or an alkyl group. The halogen atom is preferably a fluorine atom, a chlorine atom and bromine atom and the alkyl group is preferably a substituted or unsubstituted alkyl group having from 1 to 20 carbon atoms. Examples of the alkyl group include. a methyl group, an ethyl group, a propyl group, a butyl group, a hexyl group, a heptyl group, a vinyl group, an aryl group, a butenyl group, a hexadienyl group, an ethenyl-2-propenyl group, a 3-butenyl group, a 1-methyl-3-propenyl group, a 3-pentenyl group and 1-methyl-3-butenyl group.

These groups each may have a substituent. As the substituent, those described about Formula A-1 are applicable. When there are two or more substituent, they may be the same as or different from each other.

$R_3$ is an alkyl group, and the two groups represented by $R_3$ may be the same as or different from each other, provided that at least one of them is a secondary or tertiary alkyl group. The alkyl group is preferably a substituted or unsubstituted alkyl group having from 1 to 20 carbon atoms is preferable. Concrete examples of the alkyl group include a methyl group, an ethyl group, a propyl group, an iso-propyl group, a butyl group, a t-butyl group, a t-amyl group, a t-octyl group, a cyclohexyl group, a cyclopentyl group, a 1-methylcyclohexyl group and a 1-methylcyclopropyl group. The substituent of the alkyl group is not specifically limited; examples of that include an aryl group, a hydroxyl group, an alkoxy group, an aryloxy group, an alkylthio group, an arylthio group, an acylamino group, a sulfonamide group, a sulfonyl group, a phospholyl group, an acyl group, a carbamoyl group, an ester group and a halogen atom. $R_3$ may be for a saturated ring together with $(Q_o)_n$ or $(Q_o)_m$. $R_3$ is preferably a secondary or tertiary alkyl group and the number of the carbon atom is preferably from 2 to 20 and more preferably a tertiary alkyl group. T-butyl group, t-amyl group and a 1-methylcyclohexyl group are more preferable and the 1-methylcyclohexyl group is most preferable. $R_4$ is a hydrogen atom or a group capable of substituting on the benzene ring. Examples of the group capable of substituting on the benzene ring include a halogen atom such as a fluorine atom, a chlorine atom, a bromine atom, an alkyl group, an aryl group, a cycloalkyl group, an alkenyl group, a cycloalkenyl group, an alkynyl group, an amino group, an acyl group, an acyloxy group, an acylamino group, a sulfonylamino group, a sulfamoyl group, a carbamoyl group, an alkylthio group, a sulfonyl group, an alkylsulfonyl group, a sulfinyl group, a cyano group and a heterocyclic group. Plural $R_3$ and $R_4$ may be the same as or different from each other.

The number of carbon atoms of $R_4$ is preferably from 1 to 5, more preferably 1 or 2. These groups each may have a substituent. As the substituent, the substituents described for Formula A-1 are applicable. Both of $R_4$ are preferably an alkyl group having from 1 to 20 carbon atoms and a methyl group is most preferable.

$Q_0$ is the synonym of that in Formula A-1. $Q_0$ may form a saturated ring together with $R_3$ or $R_4$. $Q_0$ is preferably a hydrogen atom, a halogen atom or an alkyl group and is more preferably a hydrogen atom.

Concrete examples of the compound represented by Formula A-1, A-2, A-3 or A-4 are listed below; the invention is not limited to them.

(1-1)

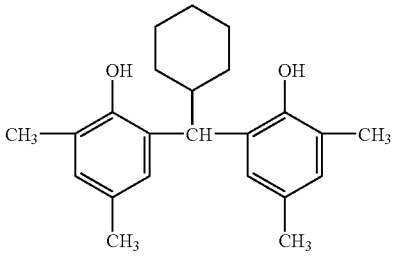

(1-2)

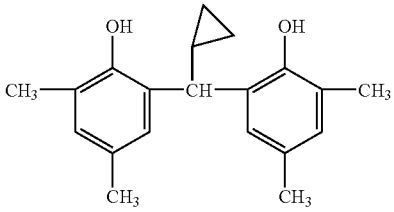

(1-3)

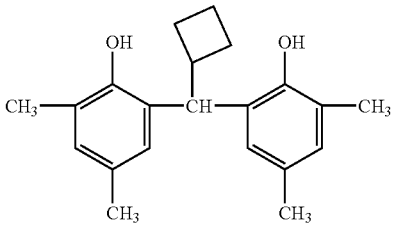

-continued (1-4)

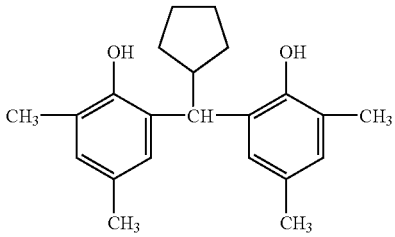

(1-5)

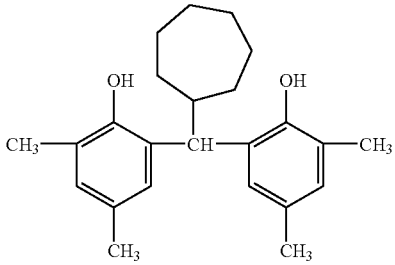

(1-6)

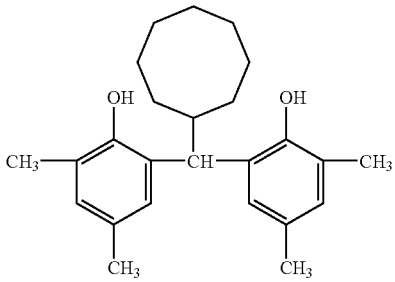

(1-7)

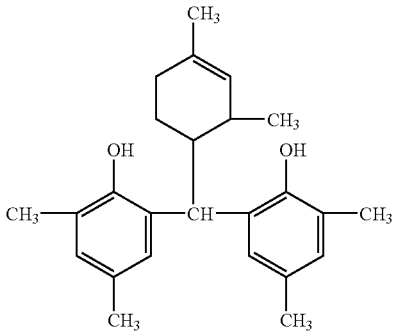

(1-8)

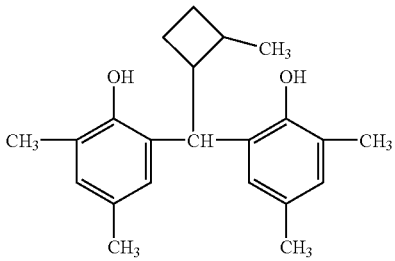

-continued
(1-9)
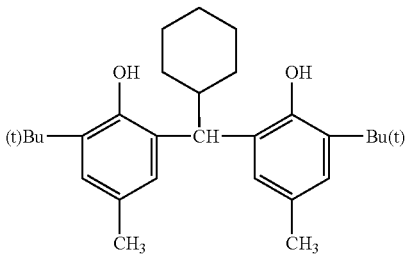
(1-10)
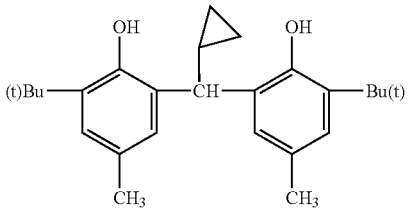
(1-11)
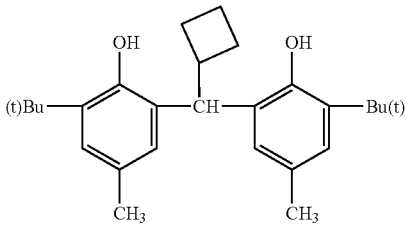
(1-12)
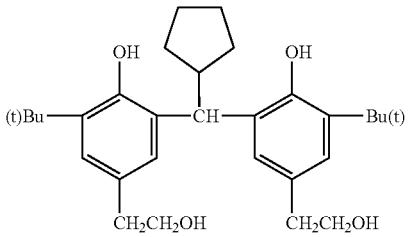
(1-13)
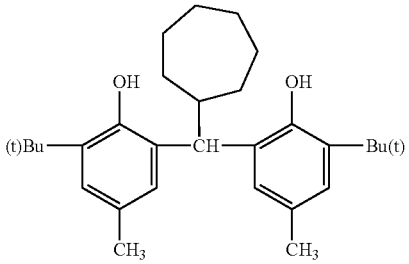
(1-14)
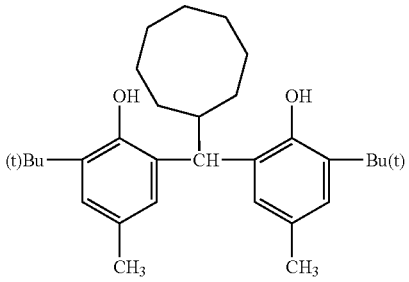
-continued
(1-15)
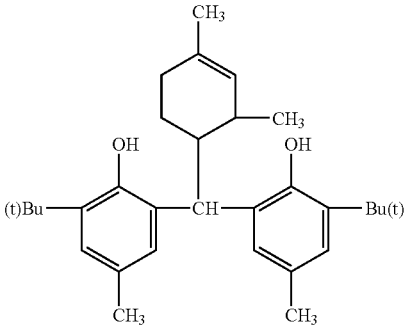
(1-16)
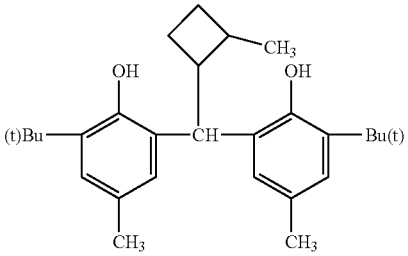
(1-17)
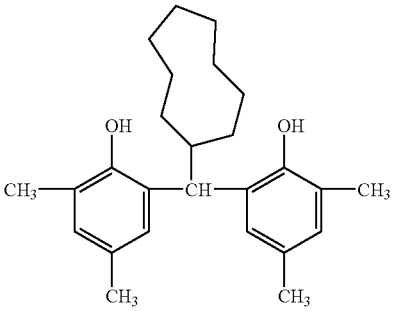
(1-18)
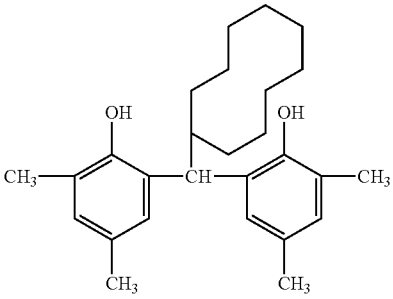
(1-19)
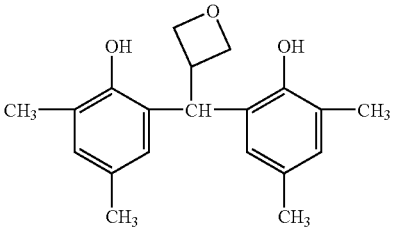

-continued
(1-20)
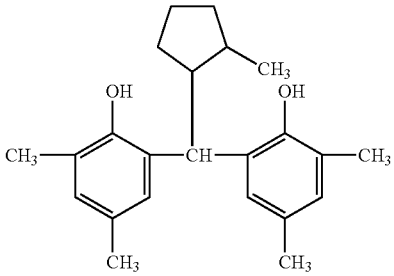
(1-21)
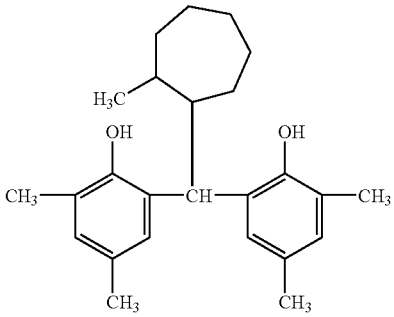
(1-22)
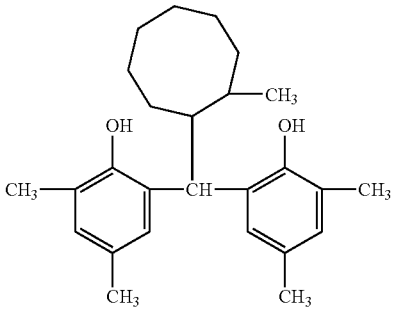
(1-23)
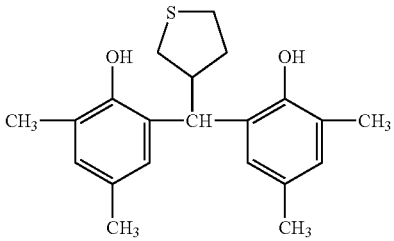
(1-24)
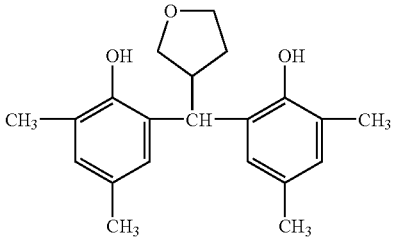
-continued
(1-25)
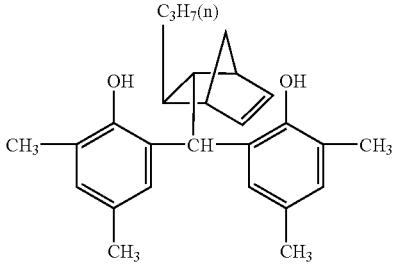
(1-26)
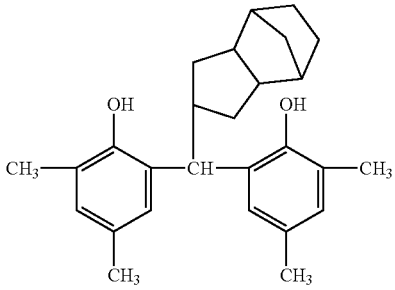
(1-27)
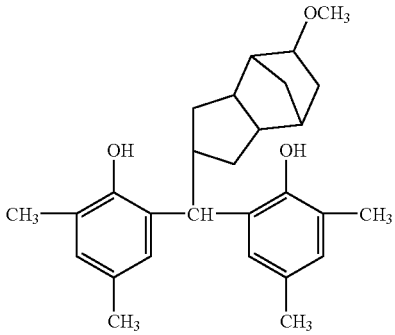
(1-28)
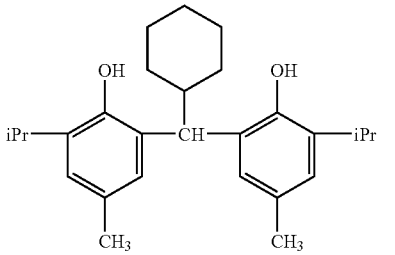
(1-29)
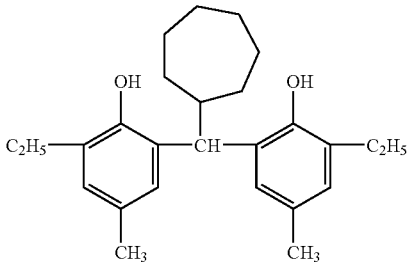

-continued
(1-30)
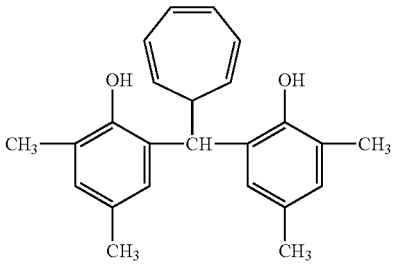
(1-31)
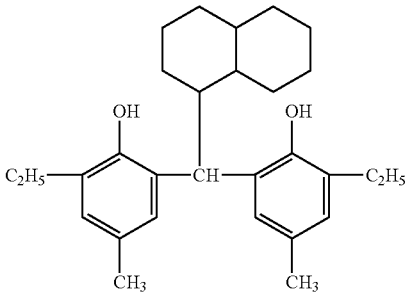
(1-32)
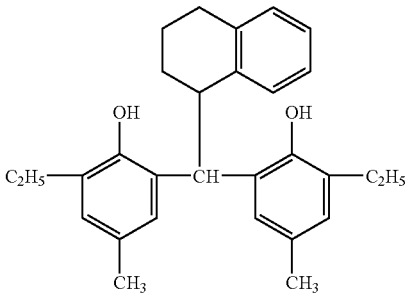
(1-33)
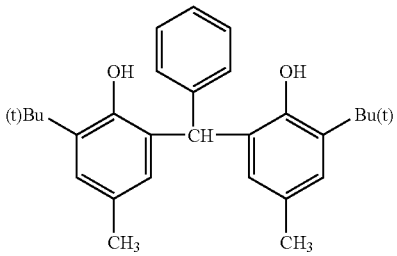
(1-34)
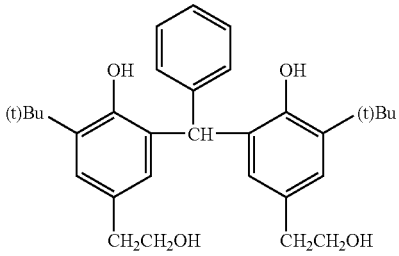
-continued
(1-35)
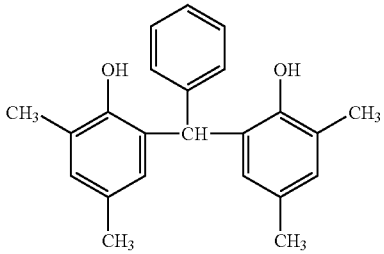
(1-36)
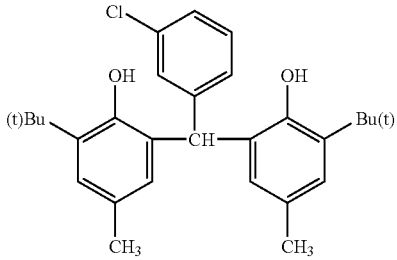
(1-37)
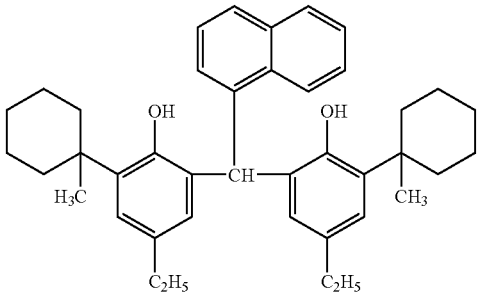
(1-38)
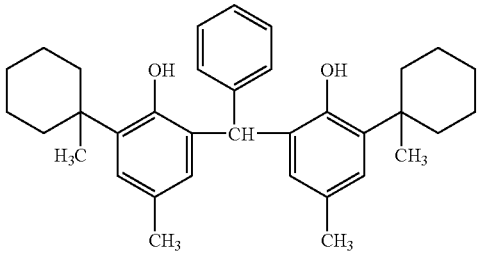
(1-39)
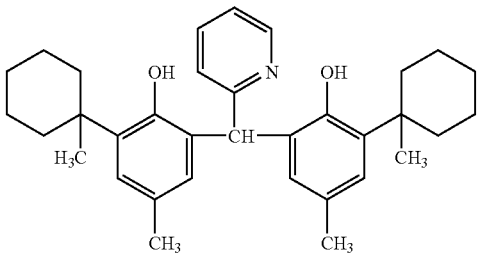

-continued
(1-40)
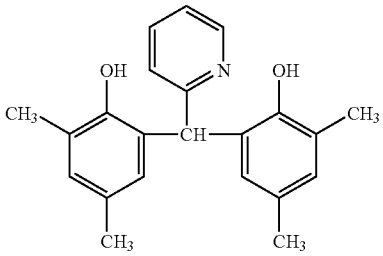
(1-41)
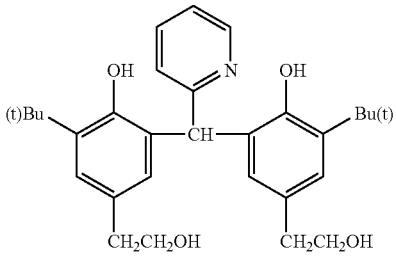
(1-42)
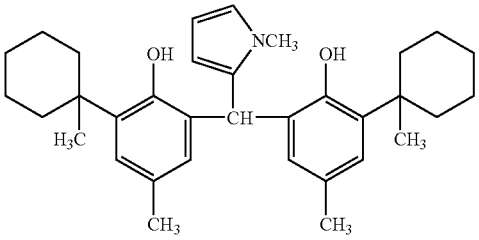
(1-43)
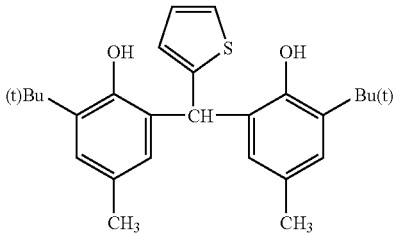
(1-44)
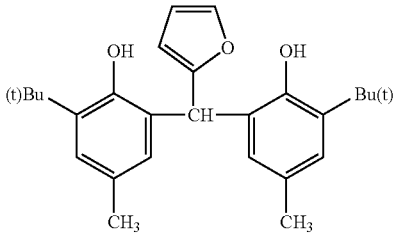
(1-45)
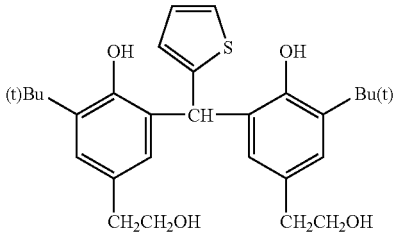
-continued
(1-46)
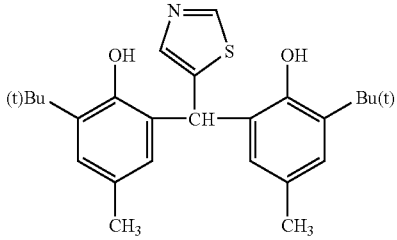
(1-47)
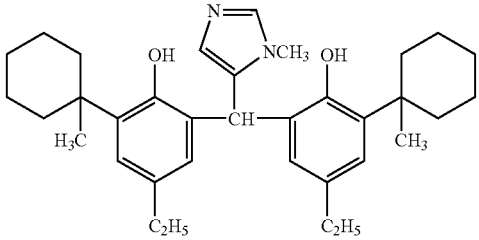
(1-48)
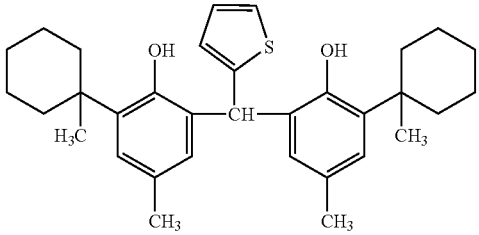
(1-49)
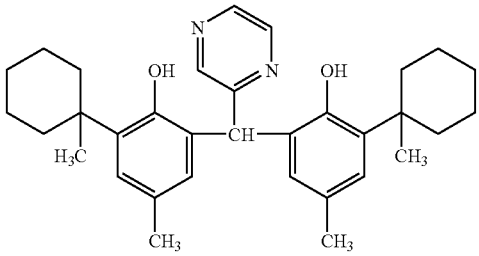
(1-50)
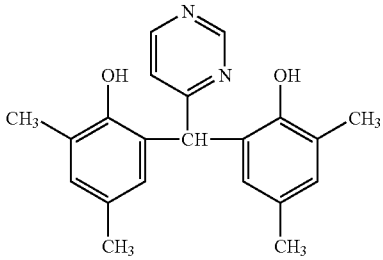
(1-51)
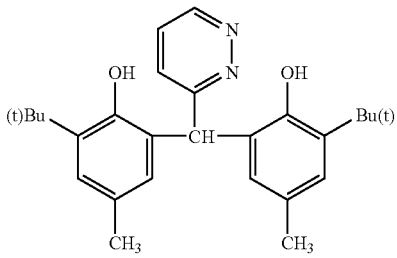

-continued
(1-52)
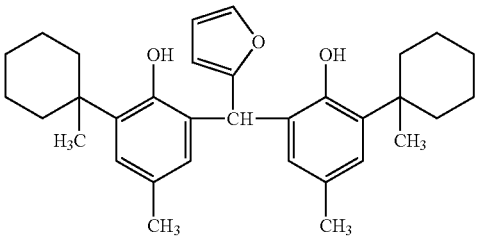
(1-53)
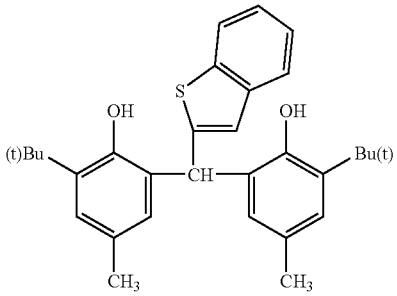
(1-54)
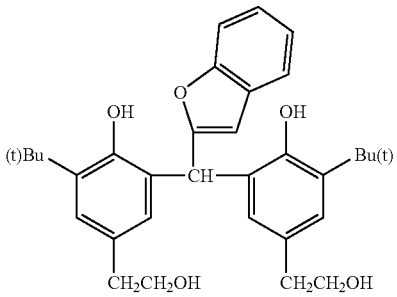
(1-55)
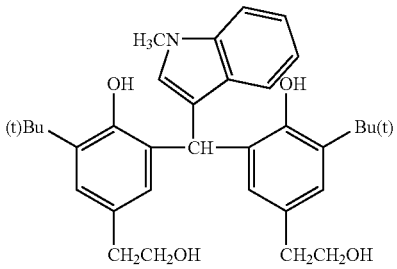
(1-56)
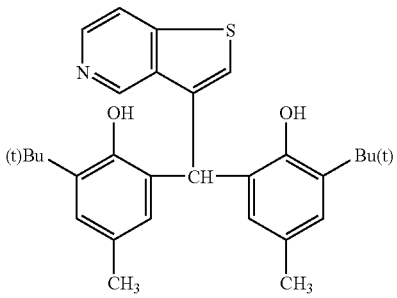
-continued
(1-57)
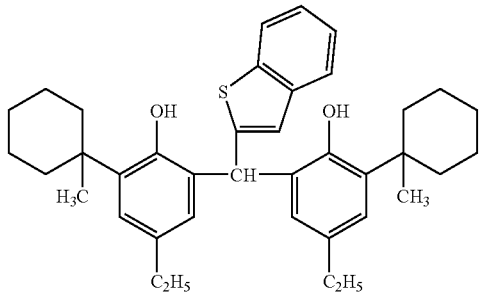
(1-58)
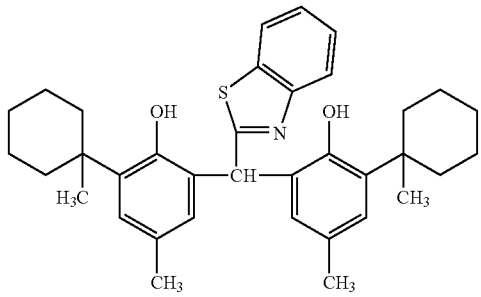
(1-59)
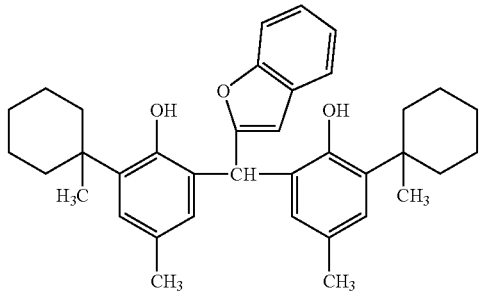
(1-60)
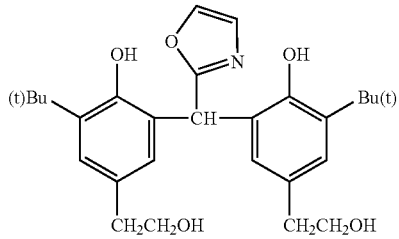
(1-61)
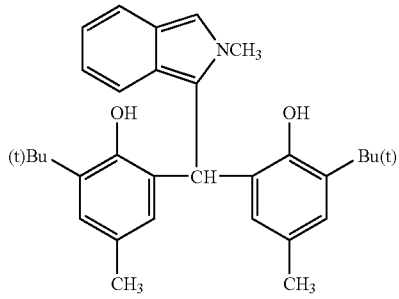

-continued
(1-62)
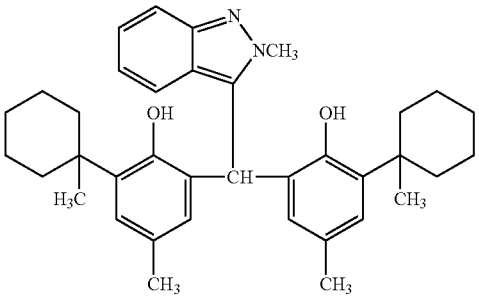
(1-63)
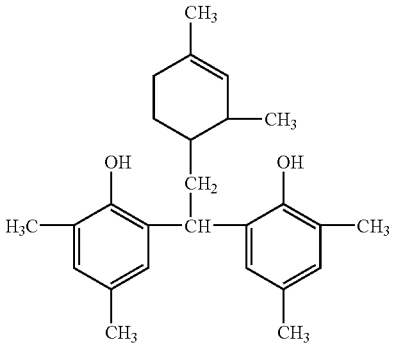
(1-64)
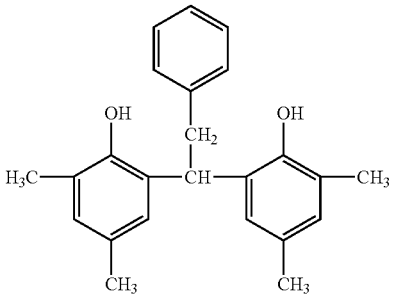
(1-65)
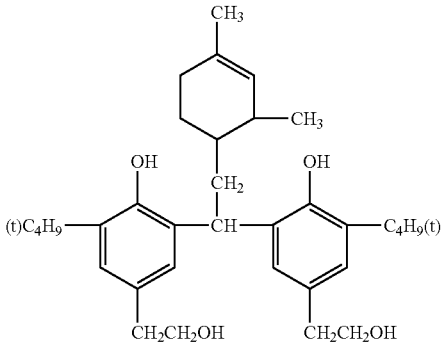
(1-66)
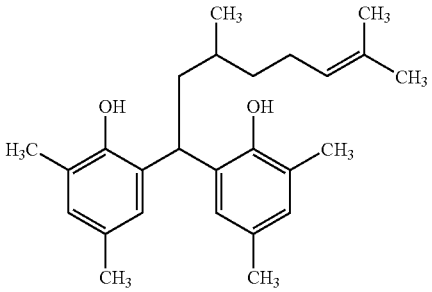
-continued
(1-67)
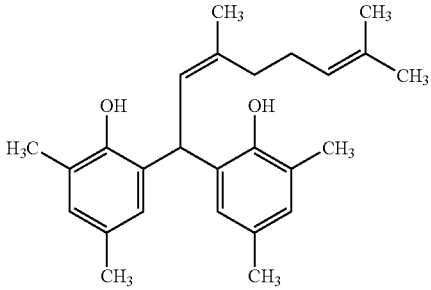
(1-68)
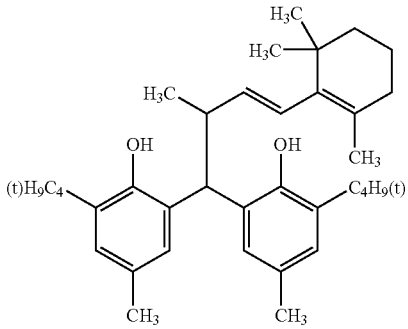
(1-69)
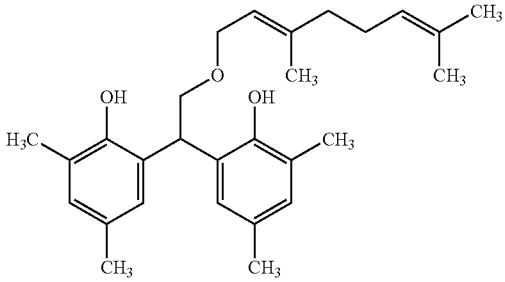
(1-70)
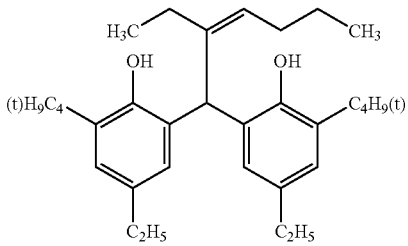
(1-71)
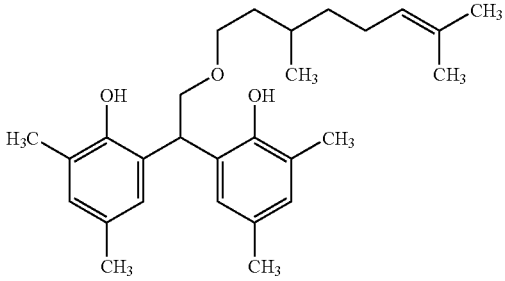

-continued
(1-72)
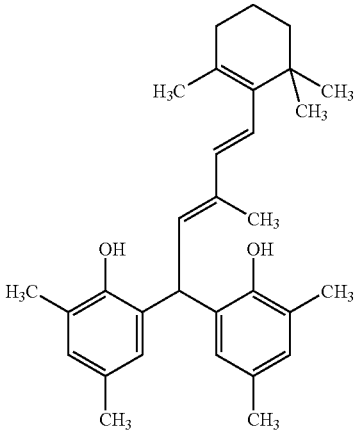
(1-73)
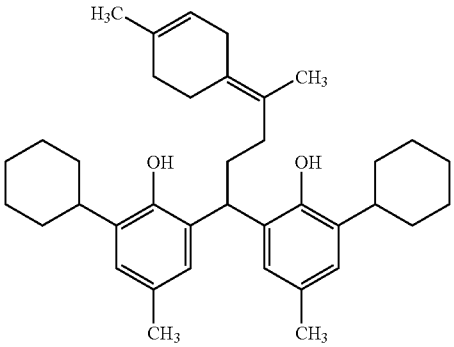
(1-74)
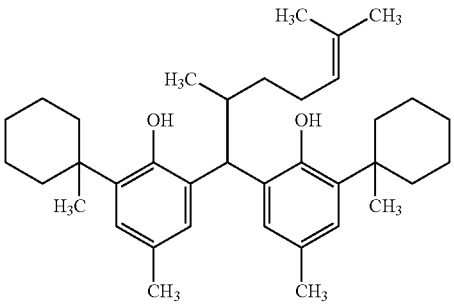
(1-75)
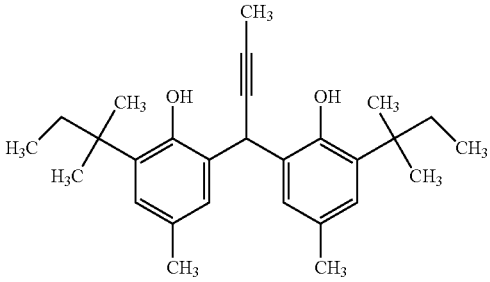
-continued
(1-76)
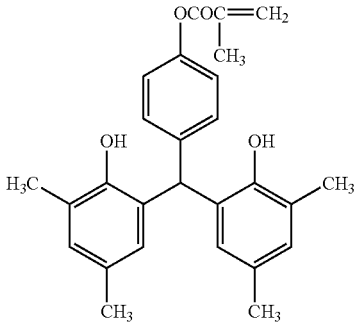
(1-77)
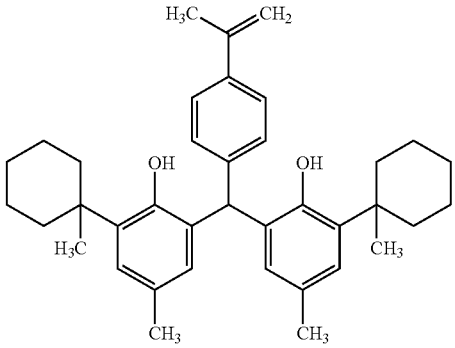
(1-78)
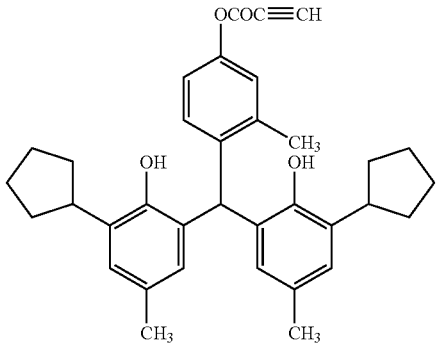
(1-79)
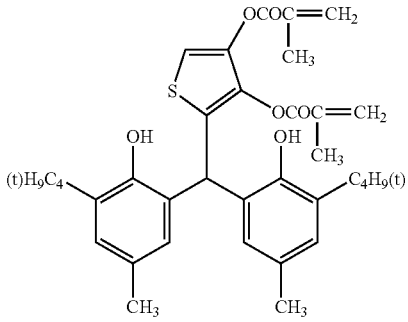

-continued
(1-80)
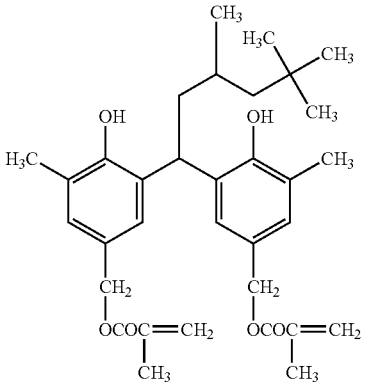
(1-81)
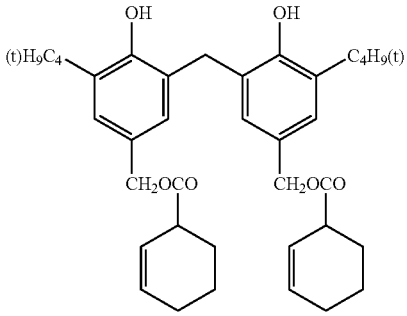
(1-82)
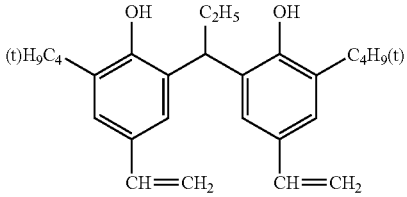
(1-83)
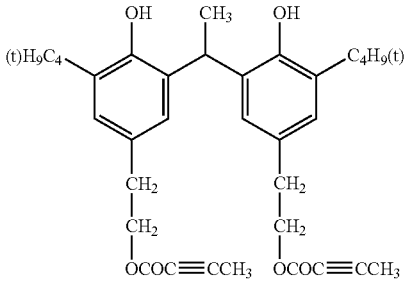
(1-84)
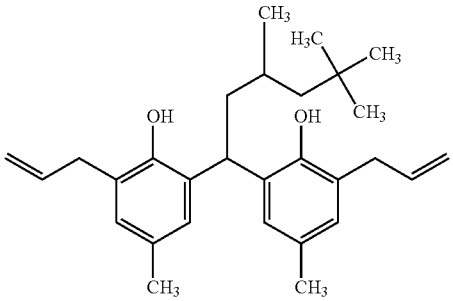
-continued
(1-85)
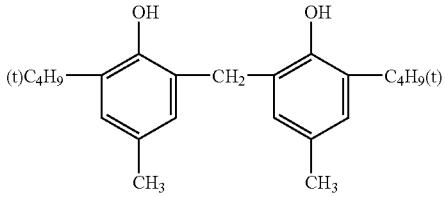
(1-86)
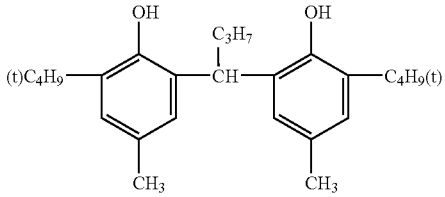
(1-87)
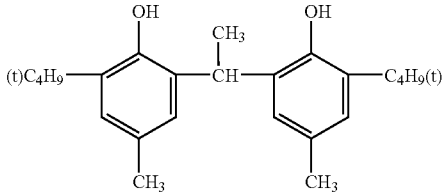
(1-88)
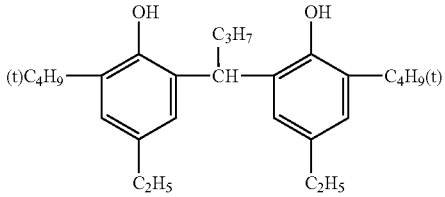
(1-89)
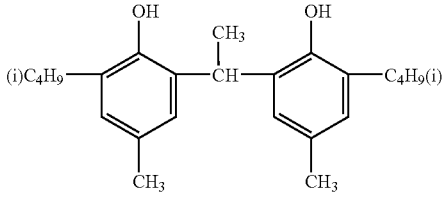
(1-90)
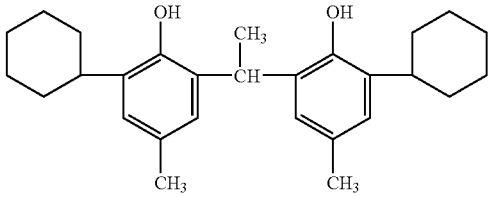
(1-91)
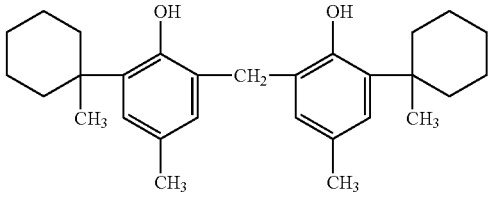

-continued (1-92)

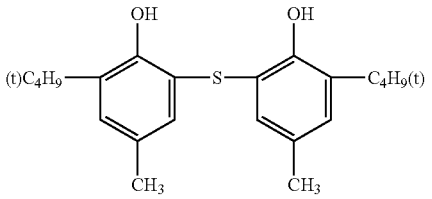

(1-93)

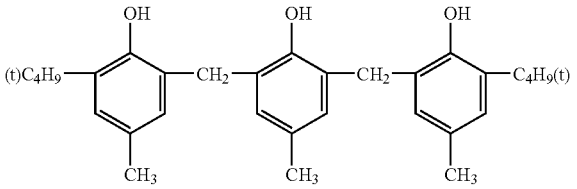

(1-94)

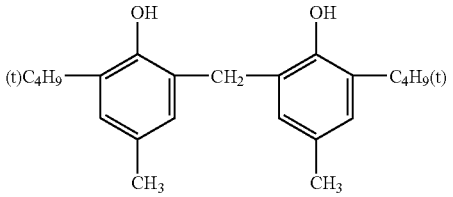

The compounds represented by Formula A-1, A-2, A-3 or A-4 can be easily synthesized by a known method. A preferable synthesizing scheme of an example of Formula A-1 is shown below.

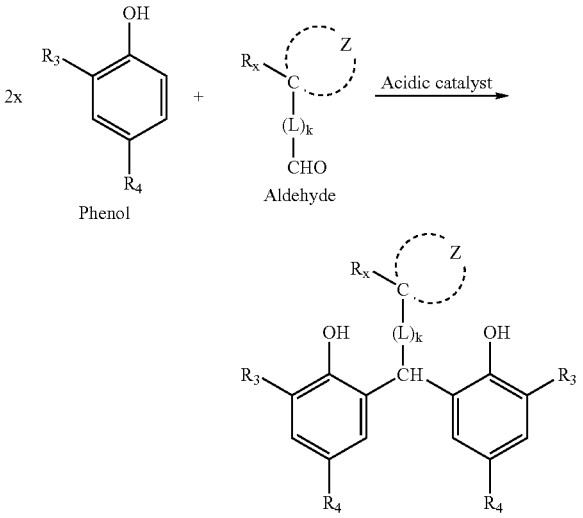

Preferably two equivalents of phenol and one equivalent of aldehyde are dissolved or suspended with or without solvent and a suitable amount of an acidic catalyst is added, and are reacted preferably for a time of from 0.5 to 60 hours at a temperature of from −20 to 120° C. Thus the objective compound represented by Formula A-1 can be obtained with high yield.

The organic solvent is preferably a hydrocarbon type organic solvent, for example, benzene, toluene, xylene, dichloromethane and chloroform and toluene are preferable. The reaction without solvent is most preferable from the viewpoint of the yield. Any inorganic and organic acids can be employed as the acidic catalyst and concentrated hydrochloric acid, p-toluenesulfonic acid, and phosphoric acid are preferably employed. The amount of the acid as the catalyst is preferably from 0.001 to 1.5 equivalents of the Aldehyde. The reacting temperature is preferably near the room temperature, about from 15 to 25° C., and the reaction time is preferably from 3 to 20 hours.

The compounds represented by Formulas A-2 and A-3 can be synthesized by the following methods.

Synthesis of 1–66

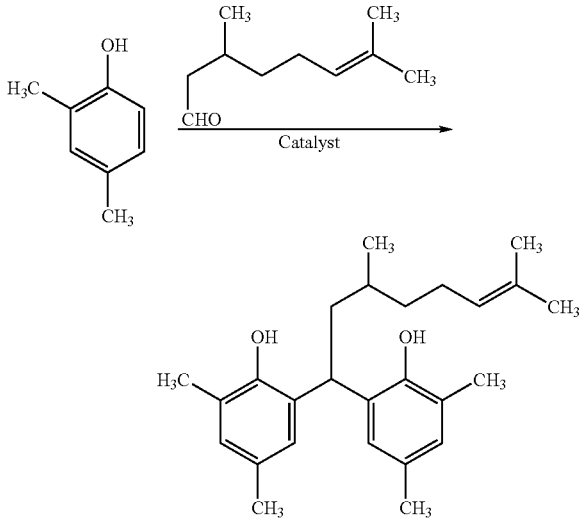

Synthesis of 1–76

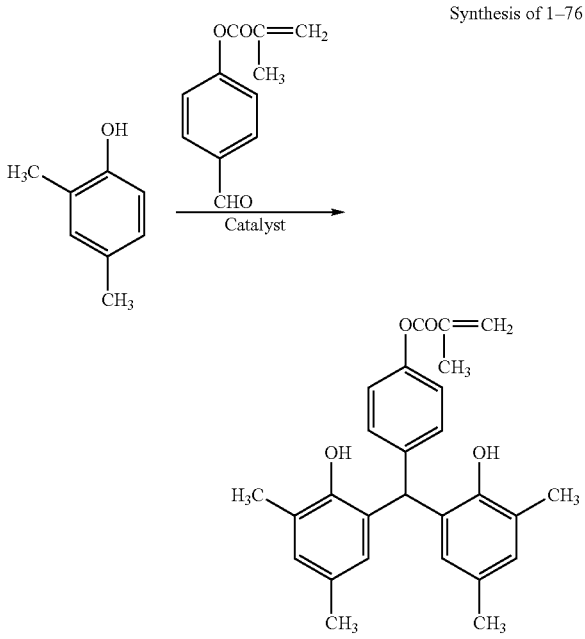

The compound represented by Formula A-4 or A-5 can be synthesized by reacting the phenol derivative and the aldehyde derivative in a solvent such as water, methanol, ethanol, acetonitryl, tetrahydrofuran, ethyl acetate, toluene and N,N-dimethylformamide employing a catalyst such as hydrochloric acid, sulfuric acid and p-toluenesulfonic acid, according to the above scheme.

The reducing agent contained in the thermal developable light-sensitive material is an agent to form a silver image by reducing the organic silver salt. A reducing agent capable of employing together with the reducing agent according to the invention is described, for example, in U.S. Pat. Nos. 3,770,448, 3,773,512, 3,593,863, RD Nos. 17029 and 29963, and Japanese patent O.P.I. Publication Nos. 11-119372 and 2002-62616.

The using amount of the compounds represented by Formula A-1, A-2, A-3 or A-4 and others is preferably from $1\times10^{-2}$ to 10 moles, and more preferably from $1\times10^{-2}$ to 1.5 moles, per mole of silver.

Next, the constitution other than the above-mentioned of the silver photo-thermal photographic dry imaging material according to the invention is described below.

<Tone of Image>

It is said regarding the tone of the output image for medical diagnosis such as X-ray photographic film that a more precise diagnosis result can be easily obtained by an observer by a cold tone image. The cold tone is a neutral black or bluish tinged black tone and the warm tone is brownish tinged black tone. For further precise quantitive discussion, the tone is described according to the expression recommended by the International Illumination Committee (CIE).

The terms "more cold tone" and "more warm tone" relating to the color tone can be expressed by the hue angle hab at the minimum density $D_{min}$ and an optical density of 1.0. The hue angle can be calculated by the following equation using the color coordinates a*b* of the L*a*b* color space recommended by the CIE in 1976 which has almost equal perceptional walking degree.

$$hab=\tan^{-1}(b^*/a^*)$$

It has been known that the appearance color suitable for the image diagnosis can be obtained by controlling the values of u*, v* of the (L*u*v*) color space or a*, b* of the (L*a*b*) color space of CIE 1976 to a specific values, such as that described in Japanese Patent O.P.I. Publication No. 2000-29164.

It has been found by the results of the investigation by the inventors that an image having the diagnosis suitability higher than that of the usual silver salt photographic material can be obtained by the silver photo-thermal photographic dry imaging material when the u* or a* values and the v* or b* values at various photographic density are plotted on a graph in which the horizontal line is assigned for v* or a* and the vertical is assigned for u* or b* of the (L*u*v*) color space or the (L*a*b*) color space of CIE 1976 to draw a linear regression line and the linear regression line is controlled into a specific range.

Namely, it is preferred that the decision coefficient (double decision) $R^2$ of the linear regression line is from 0.998 to 1.000. The linear regression line is prepared by the procedure in which the silver salt photo-thermal photographic dry imaging material is thermally developed and the color density is measured at the optical density of the silver images of 0.5, 1.0, 1.5 and the minimum density and the values of u* and v* at each of the densities are plotted on a to dimensional graph of the (L*u*v*) color space of IEC 1976 having the horizontal axis of u* and the vertical axis of v* and the linear regression line is drawn.

Moreover, it is preferable that the value of v* at the crossing point of the linear regression line with the horizontal axis is from −5 to 5 and the slant v*/u* of the line is from 0.7 to 2.5.

An example of the method for preparing the linear regression line or the measuring the u* and v* values in the CIE 1976 color space is described below.

A four steped sample including an unexposed portion and portions each having an optical density of 0.5, 1.0 and 1.5 is prepared by a thermal developing apparatus. The portions of the wedge are measured by spectral calorimeter such as CM-3600d manufactured by Minolta CO., Ltd. and u* and v* are calculated. The measurement is carried out employing a light source F7, a field angle of vision of 10' and a transmission measuring mode. The values of u* and v* are plotted on a graph having the horizontal axis of u* and the vertical axis of v* and the linear regression line is drawn. The decision coefficient (double decision) $R^2$, the slice and the slant are obtained.

Next, the concrete method for obtaining the linear regression line having the foregoing characteristic is described below.

In the invention, the preferable color tone can be obtained by optimizing the shape of the developed silver by controlling the adding amount of the additives such as the following tone controlling agent, reducing agent and the compounds capable of participating directly or indirectly in the developing reaction process of the foregoing silver halide grain and the silver salt of aliphatic carboxylic acid. For example, the tone rends to be bluish when the shape of the developed silver is made to dendrite shape and the tone tends to be yellowish when the shape of the developed silver is made to filament shape. The tone control can be attained by considering such the property of the shape of the developed silver.

In the silver salt photo-thermal photographic dry imaging material, a tone controlling agent is preferably employed. Examples of the usable tone controlling agent are disclosed in Research Disclosure, hereinafter referred to as RD, No. 17029, U.S. Pat. Nos. 4,123,282, 3,994,732, 3,846,136 and 4,021,249. Particularly preferable tone controlling agent is a combination of phthalazinone or phthalazine and phthalic acid and the like or phthalic anhydride and the like.

In the invention, it is particularly preferable that a compound containing a carboxylic acid such as phthalic acid, 4-methylphthalic acid, 4-nitrophthalic acid, tetrachlorophthalic acid anhydride and pentachlorophthalic acid is added to the light-insensitive layer adjacent to the light-sensitive layer.

It is further preferable that the compound is added to the light-insensitive layer provided on the side of the support opposite to the side of the light-sensitive layer.

Other than the tone controlling agent, couplers disclosed in Japanese Patent O.P.I. Publication No. 11-288057 and European Patent No. 1134611A2, and leuco dye aftermentioned are preferably employed to fine control of the tone.

The leuco dye is a colorless or slightly colored compound capable of converting to the colored state by heating at a temperature of from 80 to 200° C. for 0.5 to 30 seconds. Any leuco dyes capable of forming dye by oxidation by silver ions can be employed in the invention. Though the leuco dye suitable for the invention is not specifically limited, for example, biphenyl leuco dyes, phenol leuco dyes, indoaniline leuco dyes, acrylated azine leuco dyes, phenoxazine leuco dyes, phenodiazine leuco dyes and phenothiazine leuco dyes are usable. The leuco dyes described in the following publications are suitable: U.S. Pat. Nos. 3,544, 234, 3,846,136, 3,994,732, 4,021,249, 4,021,250, 4,022,617, 4,123,282, 3,468,247 and 4,461,681, and Japanese Patent O.P.I. Publication Nos. 50-36110, 59-206831, 5-204087, 11-231460, 2002-169249 and 2002-236334. It is preferable that various color leuco dyes are employed single or in a combination of them for controlling the tone to the designated tone. In the invention the leuco dye forming blue color is preferably used for preventing excessively yellowing of the tone accompanied with the use of a highly active reducing agent or excessively making reddish of the image at the portion of a high density of not less than 2.0 caused by the use of fine silver halide grains. It is further preferable to use the leuco dye forming yellow color and that forming cyan color for finely controlling the tone.

The concentration of the leuco dye is suitably controlled considering the relation to the tone of developed silver itself. In the invention, it is preferable that the leuco dye is colored for forming a reflex density of from 0.01 to 0.05 or a transmission density of from 0.005 to 0.05 to control the tone of the image so as to form a tone within the preferable range. In the invention, a sum total of the maximum density at the maximum absorbance wavelength of dyestuff image formed by the leuco dye is preferably 0.01 or more and 0.50 or less, more preferably 0.02 or more and 0.30 or less, and especially preferably it is preferable to develop color to have a value of 0.03 or more and 0.10 or less.

Further, those preferably used as yellow coloring leuco dyes are dye image forming agents represented by the Formula (YA) where absorbance at 360 to 450 nm is increased by being oxidized.

Formula (YA)

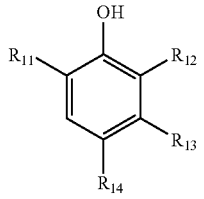

In the Formula (YA), $R_{11}$ represents a substituted or unsubstituted alkyl group, and when $R_{12}$ is a substituent other than hydrogen atom, $R_{11}$ represents an alkyl group. The alkyl group is preferably the alkyl group with 1 to 30 carbons and may have substituents.

Specifically, methyl, ethyl, butyl, octyl, i-propyl, t-butyl, t-octyl, t-pentyl, sec-butyl, cyclohexyl, 1-methyl-cyclohexyl and the like are preferable. The groups which are sterically greater than i-propyl (i-propyl, i-nonyl, t-butyl, t-amyl, t-octyl, cyclohexyl, 1-methyl-cyclohexyl, adamanthyl, etc.) are preferable. Among others, secondary or tertiary alkyl groups are preferable, and t-butyl, t-octyl, t-pentyl and the like which are the tertiary alkyl groups are especially preferable. The substituents which R.sub.11 may have include halogen atoms, aryl, alkoxy, amino, acyl, acylamino, alkylthio, arylthio, sulfonamide, acyloxy, oxycarbonyl, carbamoyl, sulfamoyl, sulfonyl, phosphoryl groups and the like.

$R_{12}$ represents a hydrogen atom, a substituted or unsubstituted alkyl or acylamino group. The alkyl groups represented by R.sub.12 are preferably the alkyl groups with 1 to 30 carbons, and the acylamino groups represented by $R_{12}$ are preferably the acylamino groups with 1 to 30 carbons. In these, the description of the alkyl groups is the same as that of the $R_{11}$.

The acylamino groups represented by $R_{12}$ may be unsubstituted or may have substituents, which specifically include acetylamino, alkoxyacetylamino, aryloxyacetylamino groups and the like. $R_{12}$ is preferably a hydrogen atom or an unsubstituted alkyl group with 1 to 24 carbons, and specifically include methyl, i-propyl and t-butyl. Also, $R_{11}$ and $R_{12}$ are not 2-hydroxyphenylmethy groups.

$R_{13}$ represents a hydrogen atom or a substituted or unsubstituted alkyl group. As the alkyl groups, preferable are the alkyl groups with 1 to 30 carbons, and the description of the alkyl groups is the same as that of $R_{11}$. $R_{13}$ is preferably a hydrogen atom or an unsubstituted alkyl group with 1 to 24 carbons, and specifically include methyl, i-propyl, t-butyl and the like. And it is preferred that either $R_{12}$ or $R_{13}$ is the hydrogen atom.

$R_{14}$ represents a group capable of being substituted to benzene ring, preferably a substituted or unsubstituted alkyl group with 1 to 30 carbons or an oxycarbonyl group with 2 to 30 carbons, and more preferably an alkyl group with 1 to 24 carbons. The substituents of the alkyl group include aryl, amino, alkoxy, oxycarbonyl, acylamino, acyloxy, imide, ureido groups and the like, and are more preferably aryl, amino, oxycarbonyl and alkoxy groups. These substituents of the alkyl group may be further substituted with these substituents.

Next, most preferably used compound represented by the formula(YA) is a bisphenol compound represented by the following Formula (YB) in the invention.

Formula (YB)

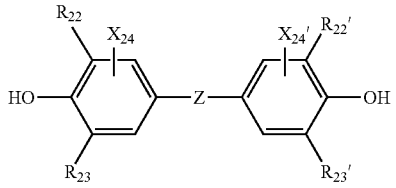

In the Formula (YB), Z represents —S— group or —C($R_{21}$)($R_{21}$')— group, and $R_{21}$ and $R_{21}$' each represent hydrogen atoms or substituents. The substituents represented by $R_{21}$ and $R_{21}$' include, for example, alkyl groups (methyl, ethyl, propyl, isopropyl, cyclopropyl, butyl, isobutyl, sec-butyl, t-butyl, cyclohexyl, 1-methyl-cyclohexyl, etc.), alkenyl groups (vinyl, propenyl, butenyl, pentenyl, isohexenyl, cyclohexenyl, butenylidene, isopentylidene, etc.), alkynyl groups (ethynyl, propinylidene, etc.), aryl groups (phenyl, naphthyl, etc.), heterocyclic groups (furyl, thienyl, pyridyl, tetrahydrofuran, etc.), and further, halogen, hydroxyl, alkoxy, aryloxy, acyloxy, sulfonyloxy, nitro, amino, aminoacyl, sulfonylamino, sulfonyl, carboxy, alkoxycarbonyl, aryloxycarbonyl, carbamoyl, sulfamoyl, cyano, sulfo and the like. As $R_{21}$ and $R_{21}$', preferred are hydrogen atoms or alkyl groups.

$R_{22}$, $R_{23}$, $R_{22}$' and $R_{23}$' each represent substituents, and the substituents include the same groups as the substituents included in the description for $R_{21}$ and $R_{21}$'.

As $R_{22}$, $R_{23}$, $R_{22}$' and $R_{23}$', preferred are alkyl, alkenyl, alkynyl, aryl, heterocyclic groups and the like, and the alkyl groups are more preferable. The substituents of alkyl groups include the same groups as the substituents included in the description for $R_{21}$ and $R_{21}$'.

$R_{22}$, $R_{23}$, $R_{22}$' and $R_{23}$' are more preferably tertiary alkyl groups such as t-butyl, t-amyl, t-octyl, 1-methyl-cyclohexyl and the like.

$X_{24}$ and $X_{24}'$ each represent hydrogen atoms or substituents, and the substituents include the same groups as the substituents included in the description for $R_{21}$ and $R_{21}'$.

The compounds represented by the Formulas (YA) and (YB) can include the compounds (II-1) to (II-40) described in [0032] to [0038] of JAPANESE PATENT O.P.I. PUBLICATIONA-2002-169249, and the compounds (ITS-1) to (ITS-12) described in [0026] of EP 1,211,093.

Hereinafter, specific examples of the bisphenol compounds represented by the Formulas (YA) and (YB) are shown, but the present invention is not limited thereto.

(YA-1)

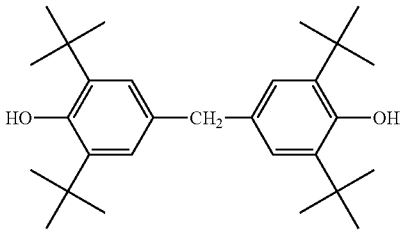

(YA-2)

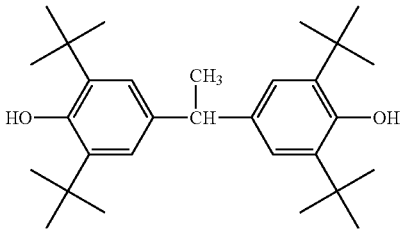

(YA-3)

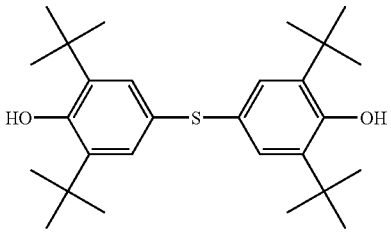

(YA-4)

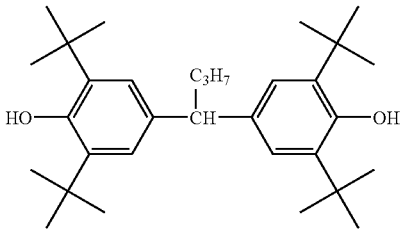

(YA-5)

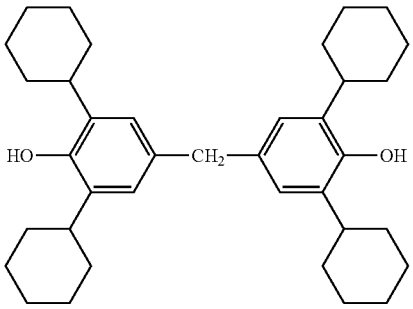

-continued (YA-6)

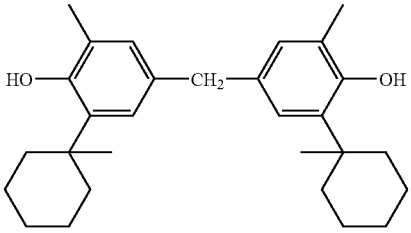

(YA-7)

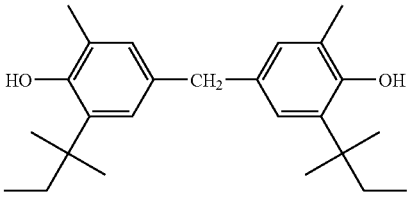

(YA-8)

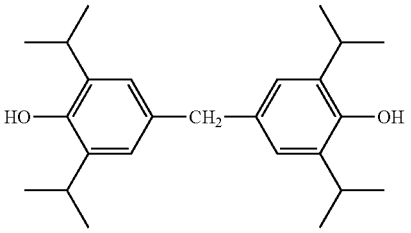

(YA-9)

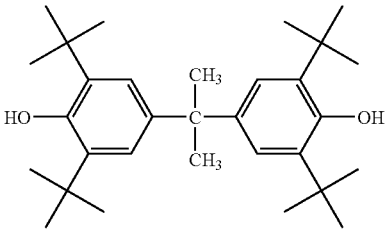

(YA-10)

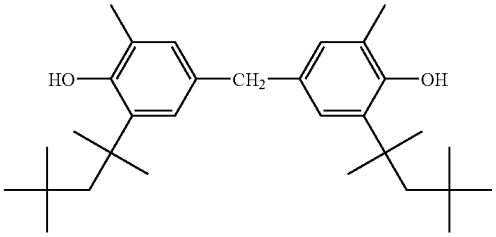

The addition amount of the compound (hindered phenol compound) of the Formula (YA) (including the compounds of the Formula (YB)) is typically from 0.00001 to 0.01 mol, preferably from 0.0005 to 0.01 mol, and more preferably from 0.001 to 0.008 mol per 1 mol of Ag.

In the embodiment, those especially preferably used as the cyan coloring leuco dyes are dye image forming agents where absorbance at 600 to 700 nm is increased by being oxidized, Japanese Patent O.P.I. Publication No. 59-206831 (especially, the compounds where % max is within the range of 600 to 700 nm), the compounds of the Formulae (I) to (IV) of Japanese Patent O.P.I. Publication No. 5-204087 (specifically, the compounds (1) to (18) described in the paragraphs of [0032] to [0037]), and the compounds of the Formulae 4 to 7 of Japanese Patent O.P.I. Publication No.

11-231460 (specifically, the compounds No. 1 to No. 79) described in the paragraph [0105]).

The cyan coloring leuco dyes especially preferably used in the invention are represented by the following Formula (CL).

Formula (CL)

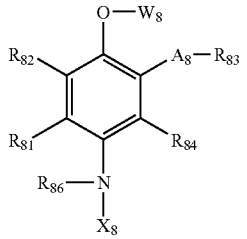

In the formula, $R_{81}$ and $R_{82}$ are hydrogen atoms, halogen atoms, substituted or unsubstituted alkyl, alkenyl, alkoxy and —NHCO—$R_{10}$ groups ($R_{10}$ represents an alkyl, aryl or heterocyclic group), or $R_{81}$ and $R_{82}$ are the groups which are bound one another to form an aliphatic hydrocarbon ring, aromatic hydrocarbon ring or heterocycle. $A_8$ represents —NHCO—, —CONH— or —NHCONH— group, and $R_{83}$ represents a substituted or unsubstituted alkyl, aryl or heterocyclic group. Also, -$A_8$-$R_{83}$ may be a hydrogen atom. $W_8$ represents a hydrogen atom or —CONH—$R_{85}$, —CO—$R_{85}$ or —CO—O—$R_{85}$ group ($R_{85}$ represents a substituted or unsubstituted alkyl, aryl or heterocyclic group.), and $R_{84}$ represents a hydrogen atom, halogen atom, a substituted or unsubstituted alkyl, alkenyl, alkoxy, carbamoyl or nitrile group. $R_{86}$ represents —CONH—$R_{87}$, —CO—$R_{87}$ or —CO—O—$R_{87}$ group ($R_{87}$ represents a substituted or unsubstituted alkyl, aryl or heterocyclic group.). $X_8$ represents a substituted or unsubstituted aryl or heterocyclic group.

In the Formula (CL), as the halogen atoms represented by $R_{81}$ and $R_{82}$, included are for example fluorine, bromine, chlorine atoms and the like. As the alkyl groups represented by $R_{81}$ and $R_{82}$, included are the alkyl groups with up to 20 carbon atoms (e.g., methyl, ethyl, butyl, dodecyl, etc.). As the alkenyl groups represented by $R_{81}$ and $R_{82}$, included are the alkenyl groups with up to 20 carbon atoms (e.g., vinyl, allyl, butenyl, hexenyl, hexadienyl, etenyl-2-propenyl, 3-butenyl, 1-methyl-3-propenyl, 3-pentenyl, 1-methyl-3-butenyl, etc.). As the alkoxy groups represented by $R_{81}$ and $R_{82}$, included are the alkoxy groups with up to 20 carbon atoms (e.g., methoxy, ethoxy groups, etc.). Also, in —NHCO—$R_{10}$, as the alkyl, aryl and heterocyclic groups represented by $R_{10}$, included are the alkyl groups with up to 20 carbon atoms (e.g., methyl, ethyl, butyl, dodecyl, etc.), the aryl groups with 6 to 20 carbon atoms such as phenyl, naphthyl and thienyl groups, and the heterocyclic groups such as thiophene, furan, imidazole, pyrazole and pyrrole groups, respectively. The alkyl groups represented by $R_{83}$ are preferably the alkyl groups with up to 20 carbon atoms, and for example, included are methyl, ethyl, butyl, dodecyl and the like. The aryl groups represented by $R_{83}$ are preferably the aryl groups with 6 to 20 carbon atoms, and for example, included are phenyl, naphthyl, thienyl groups and the like. As the heterocyclic groups represented by $R_{83}$, included are thiophene, furan, imidazole, pyrazole, pyrrole groups and the like. In —CONH—$R_{85}$, —CO—$R_{85}$ or —CO—O—$R_{85}$ represented by $W_8$, the alkyl groups represented by $R_{85}$ are preferably the alkyl groups with up to 20 carbon atoms, and for example, included are methyl, ethyl, butyl, dodecyl and the like, the aryl groups represented by $R_{85}$ are preferably the aryl groups with 6 to 20 carbon atoms, and for example, included are phenyl, naphthyl, thienyl groups and the like, and as the heterocyclic groups represented by $R_{85}$, included are, for example, thiophene, furan, imidazole, pyrazole, pyrrole groups and the like.

The halogen atoms represented by $R_{84}$, for example, included are fluorine, chlorine, bromine, iodine groups and the like. As the alkyl groups represented by $R_{84}$, for example, included are the chain or cyclic alkyl groups such as methyl, butyl, dodecyl and cyclohexyl groups. As alkenyl groups represented by $R_{84}$, included are the alkenyl groups with up to 20 carbon atoms (e.g., vinyl, allyl, butenyl, hexenyl, hexadienyl, etenyl-2-propenyl, 3-butenyl, 1-methyl-3-propenyl, 3-pentenyl, 1-methyl-3-butenyl, etc.). As alkoxy groups represented by $R_{84}$, for example, included are methoxy, butoxy, tetradecyloxy groups and the like. The carbamoyl groups represented by $R_{84}$, for example, included are diethylcarbamoyl, phenylcarbamoyl groups and the like. Also, nitrile groups are preferable. In these, the hydrogen atom and the alkyl group are more preferable. The above $R_{83}$ and $R_{84}$ may be linked one another to form a cyclic structure.

The above groups can further have a single substituent or multiple substituents. As the typical substituents, included are halogen atoms (e.g., fluorine, chlorine, bromine atoms, etc.), alkyl groups (e.g., methyl, ethyl, propyl, butyl, dodecyl, etc.), hydroxy, cyano, nitro groups, alkoxy groups (e.g., methoxy, ethoxy, etc.), alkylsulfonamide groups (e.g., methylsulfonamide, octylsulfonamide, etc.), arylsulfonamide groups (e.g., phenylsulfonamide, naphthylsulfonamide, etc.), alkylsulfamoyl groups (e.g., butylsulfamoyl, etc.), arylsulfamoyl groups (e.g., phenylsulfamoyl, etc.), alkyloxycarbonyl groups (e.g., methoxycarbonyl, etc.), aryloxycarbonyl groups (e.g., phenyloxycarbonyl, etc.), aminosulfonamide, acylamino, carbamoyl, sulfonyl, sulfinyl, sulfoxy, sulfo, aryloxy, alkoxy, alkylcarbonyl, arylcarbonyl, aminocarbonyl groups and the like.

$R_{10}$ or $R_{85}$ is preferably phenyl group, and more preferably the phenyl group having multiple halogen atoms and cyano groups as the substituents.

In —CONH—$R_{87}$, —CO—$R_{87}$ or —CO—O—$R_{87}$ group represented by $R_{86}$, the alkyl groups represented by $R_{87}$ are preferably the alkyl groups with up to 20 carbon atoms and for example included are methyl, ethyl, butyl, dodecyl groups and the like, the aryl groups represented by $R_{87}$ are preferably the aryl groups with 6 to 20 carbons and for example included are phenyl, naphthyl, thienyl groups and the like, and as the heterocyclic groups represented by $R_{87}$, for example included are thiophene, furan, imidazole, pyrazole and pyrrole groups and the like.

As the substituents which the groups represented by $R_{87}$, it is possible to use those which are the same as the substituents included in the description for $R_{81}$ to $R_{84}$ of the Formula (CL).

The aryl groups represented by $X_8$ include the aryl groups with 6 to 20 carbon atoms such as phenyl, naphthyl and thienyl groups, and the heterocyclic groups represented by $X_8$ include thiophene, furan, imidazole, pyrazole and pyrrole groups and the like.

As the substituents which the groups represented by $X_8$, it is possible to use those which are the same as the substituents included in the description for $R_{81}$ to $R_{84}$ Of the Formula (CL). As the groups represented by $X_8$, preferable are the aryl or heterocyclic group having the alkylamino group (diethylamino, etc.) at a para-position. These groups may comprise photographically useful groups.

Specific examples of the cyan coloring leuco dyes (CL) are shown below, but the cyan coloring leuco dye used for the invention is not limited thereto.
(CA-1)
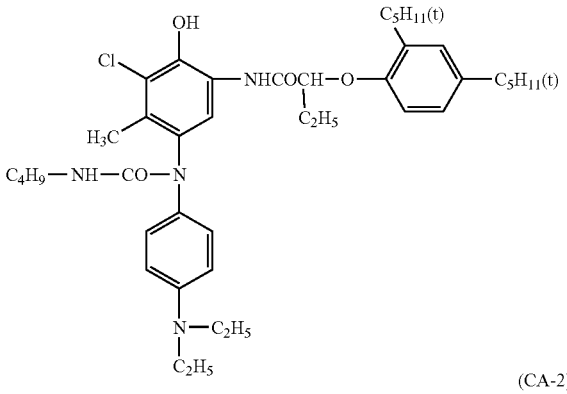
(CA-2)
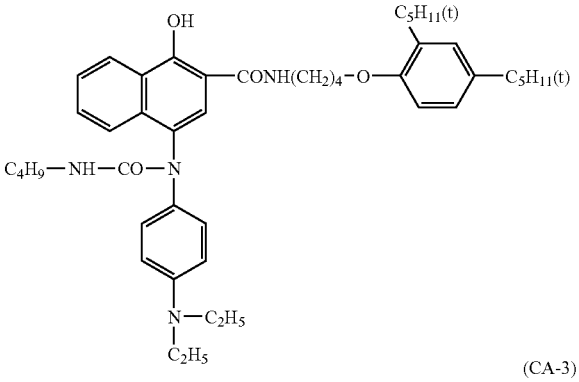
(CA-3)
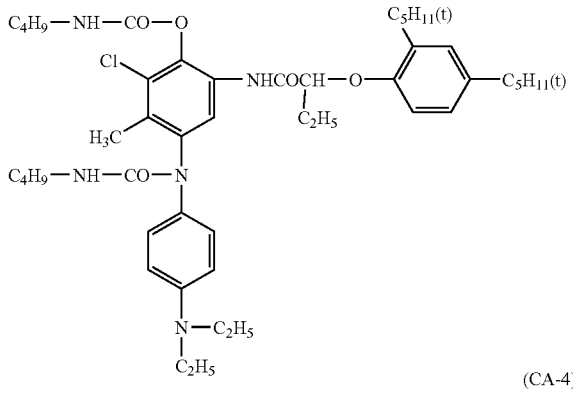
(CA-4)
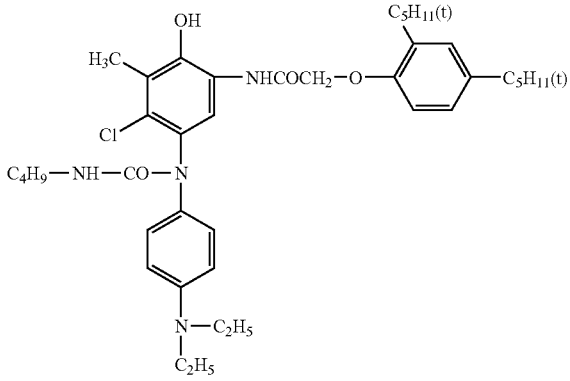
-continued
(CA-5)
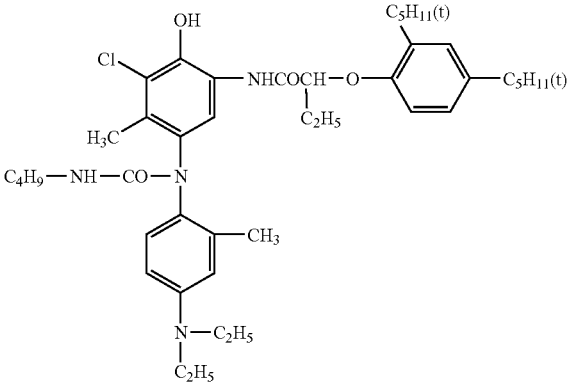
(CA-6)
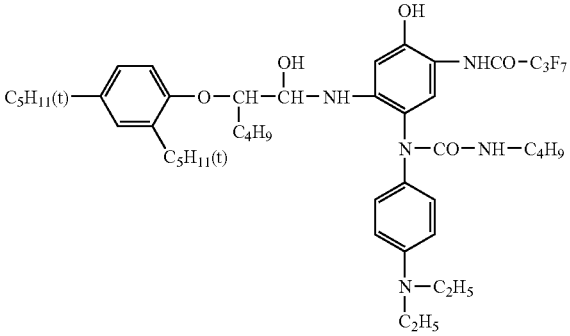
(CA-7)
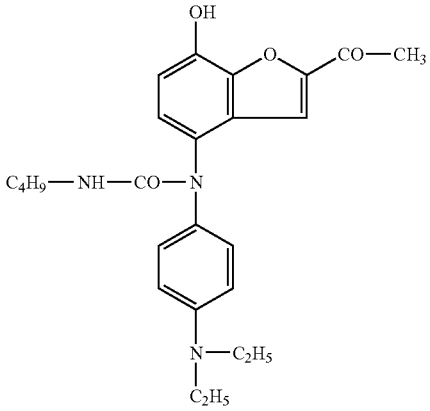
(CA-8)
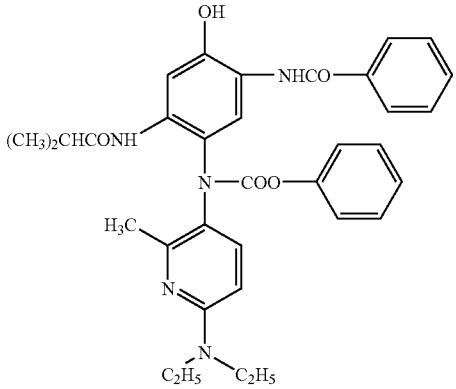

-continued (CA-9)

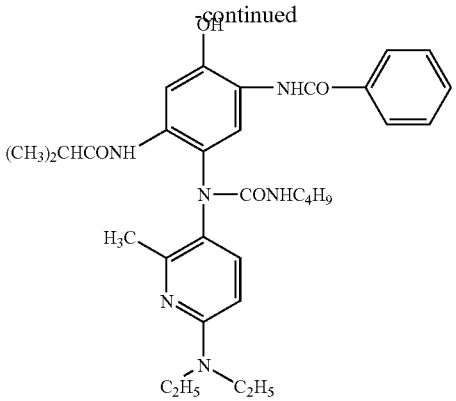

(CA-10)

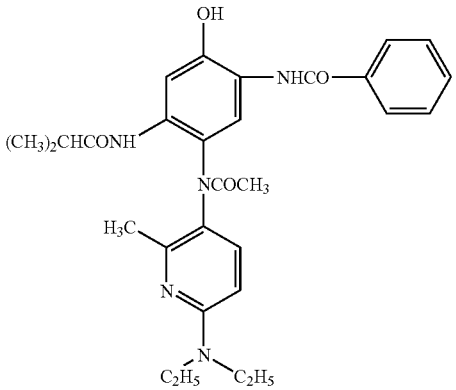

(CA-11)

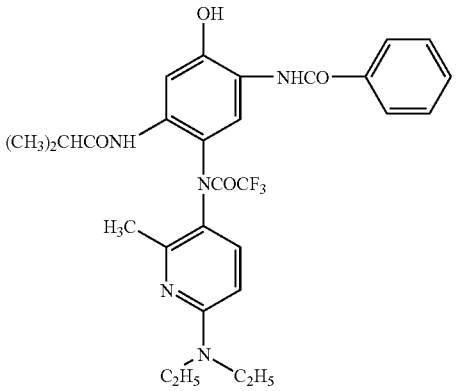

(CA-12)

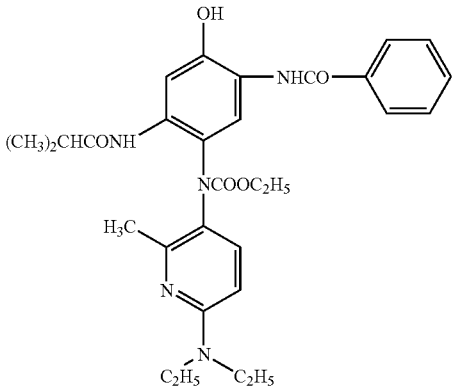

The addition amount of the cyan coloring leuco dye is typically from 0.00001 to 0.05 mol/l mol of Ag, preferably from 0.0005 to 0.02 mol/l mol of Ag, and more preferably from 0.001 to 0.01 mol/l mol of Ag. Also, the addition amount ratio of the cyan coloring leuco dye to the total amount of the reducing agents is preferably from 0.001 to 0.2 in mol ratio, more preferably, from 0.005 to 0.1. In the invention, a sum total of the maximum density at the maximum absorbance wavelength of dyestuff image formed by the cyan leuco dye is preferably 0.01 or more and 0.50 or less, more preferably 0.02 or more and 0.30 or less, and especially preferably it is preferable to develop color to have a value of 0.03 or more and 0.10 or less.

In the invention, it is preferable to utilize mazenta coloring lueco dyes or yellow coloring lueco dyes together with above-mentioned cyan coloring lueco dyes for adjusting delicate color tone.

As the method of adding the compounds of the Formulas (YA) and (YB) and the cyan coloring leuco dye, the similar methods of adding reducing agent may be applied, namely, the compounds may be contained in a coating solution either as a solution, as a emulsion, as a fine solid dispersion and the like, then added to the dry imaging material.

It is preferred that the compounds of the Formulas (YA) and (YB) and the cyan coloring leuco dye are contained in the image formation layer containing the organic silver salt, but one may be contained in the image formation layer and the other may be contained in non-image formation layer adjacent thereto, and both may be contained in the non-image forming layer. Also when the image forming layer is made up of multiple layers, they may be contained in different layers, respectively.

<Binder>

The binder suitable for the silver salt photo-thermal photographic dry imaging material according to the invention is transparent or translucent and usually colorless, and a natural polymer, synthesized polymer and copolymer and another medium for forming a film such as that described in Japanese Patent O.P.I. Publication No. 2001-330918, paragraph [0069], are employable. Among them, a polyvinyl acetal is preferable and a poly(vinyl butyral) is particularly preferable for the silver salt photo-thermal photographic dry imaging material according to the invention which is later-mentioned in detail. A cellulose ester, particularly a polymer such as triacetyl cellulose and cellulose acetate butylate, having the softening point higher than that of the above polymers is preferably employed to an overcoat layer and an undercoat layer, particularly to a protective layer and a back coat layer. Two or more kinds of the above binders may be employed according to necessity. To the binder, one or more polar groups selected from a —COOM group, an —$SO_3M$ group, an —$OSO_3M$ group, a —P═O$(OM)_2$ group and a —O—P═O$(OM)_2$ group, in which M is a hydrogen atom or an alkali metal atom, —N$(R)_2$ group —N+$(R)_3$, in which R is a hydrocarbon group, an epoxy group, an —SH group and —CN group is preferably introduced by copolymerization or additional reaction. Among the —$SO_3M$ group and the —$OSO_3M$ group are particularly preferred. The amount of the polar group is from $1\times10^{-8}$ to $1\times10^{-1}$ moles/g and preferably from $1\times10^{-6}$ to $1\times10^{-2}$ moles/g.

Such the binder is employed within the range effective to act as the binder. The effective range can be easily decided by the person concerned to the art of the field. For example, as the indicator for holding the organic silver salt in the light-sensitive layer is a ratio of the binder to the organic silver salt of from 15:1 to 1:2 is preferable and that from 8:1 to 1:1 is more preferable. Namely, a binder amount of the light-sensitive layer is preferably of from 1.5 to 6 g/$m^2$ and more preferably from 1.7 to 5 g/$m^2$. When the amount is less than 1.5 g/m$^2$, sometimes the density of the unexposed area is considerably increased so as to be unacceptable for practical use.

In the invention, the thermal transition point after the thermal developing treatment of the light-sensitive layer containing the light-insensitive aliphatic carboxylic acid silver salt, the light-sensitive emulsion containing the light-sensitive silver halide grains, the silver ion reducing agent and binder in a temperature of not less than 100° C. is preferably from 46° C. to 200° C.

In the invention, the thermal transition point is a temperature represented by the VICAT softening point of a ring and ball method, and is an endothermic peak of the peeled layer of the developed light-sensitive layer measured by a differential scanning calorimeter such as Exstar 6000 manufactured by Seiko Densh Kogyo Co., Ltd., DSC 220C manufactured by Seiko Densh Kogyo Co., Ltd., and DSC-7 manufactured by Parkin Elmar Co., Ltd. Generally, a polymer compound has a glass transition point; however, in the silver salt photo-thermal photographic dry imaging material a large endothermic peak appears at a temperature lower than the glass transition point of the binder employed in the light-sensitive layer. According to the results of the investigation by the inventors on the thermal transition temperature, the strength of the coated layer is increased and the photographic properties such as the sensitivity, maximum density and storage ability of image are considerably raised by making the thermal-transition temperature to from 46° C. to 200° C.

The glass transition point Tg of the binder to be employed in the invention is preferably from 70° C. to 105° C. The glass transition point can be measured by a differential scanning calorimeter; the cross point of the base line and the slope of the endothermic peak is defined as the glass transition point.

In the invention, the glass transition point Tg is obtained by the method described in Brandlap et al. "Polymer Handbook", p. III-139 to p. III-179, Wairly & Son, 1966.

When the binder is a copolymer, the Tg can be determined by the following equation.

$$Tg(\text{copolymer})^\circ\ \text{C.}=v_1Tg_1+v_2Tg_2+\ldots+v_nTg_n$$

In the equation, $v_1 \ldots v_n$ are the weight ratios of the monomers in the copolymer, and $Tg_1, Tg_2 \ldots Tg_n$ are each the Tg in ° C. of homopolymers each formed from of the individual monomers.

The accuracy of the Tg calculated by the above equation is ±5° C.

The use of the binder having a Tg of from 70 to 105° C. is preferable since the sufficient maximum density can be obtained in the image formation.

The binder relating to the invention is preferably one having a Tg of from 70 to 105° C., a number average molecular weight of from 1,000 to 1,000,000 and preferably from 10,000 to 500,000 and a polymerization degree of approximately from 50 to 1,000.

Examples of the polymer or copolymer containing the ethylenic unsaturated monomer as the structural unit are described in Japanese Patent O.P.I. Publication No. 2001-330918, paragraph [0069].

Among them, particularly preferable examples are alkyl methacrylates, aryl methacrylates and styrens. Among these polymers, a polymer having an acetal group is preferable. Poly(vinyl acetal) having an acetoacetal structure is preferred in the polymer having an acetal group. Examples of the poly(vinyl acetal) are those described in U.S. Pat. Nos. 2,358,836, 3,003,879 and 2,828,204, and British Patent No. 771,155.

The compounds represented by the following Formula V are preferable as the polymer having the acetal group.

Formula V

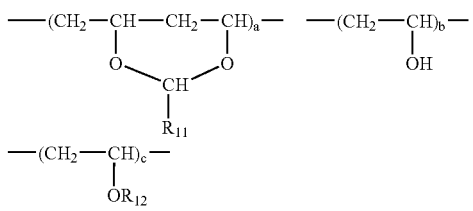

In the above formula, $R_{11}$ is an unsubstituted alkyl group, a substituted alkyl group, an aryl group and a substituted alkyl group, and preferably a group other than the aryl group. $R_{12}$ is an unsubstituted alkyl group, a substituted alkyl group, an unsubstituted aryl group, a substituted aryl group, a —$COR_{13}$ or a $CONHR_{13}$ group. $R_{13}$ is the same as $R_{11}$.

The polymers represented by Formula V can be synthesized by a usual method described in "Vinyl acetate Resin" edit. by I. Sakurada, Kobunshi Kagaku Kankoukai, 1962.

These polymers may be either employed singly or in a blend of two or more kinds. In the light-sensitive layer relating to the invention, the above-described polymer is employed as the principal binder. The principal binder is a binder accounting for 50% or more by weight of the entire binder in the light-sensitive layer. Accordingly, another polymer may be employed within the range of less than 50% by weight.

In the invention, an organic gelling agent may be contained in the light-sensitive layer. The organic gelling agent is a compound, such as a poly-valent alcohol, displaying a function, when the compound is added to an organic liquid system, by which a yield point is appeared in the system and the fluidity of the system is disappeared or decreased.

In the invention, it is also preferable embodiment that the coating liquid of the light-sensitive layer contains polymer latex dispersed in an aqueous medium. In such the case, the aqueous polymer latex preferably accounts for not less than 50% of the entire binder in the light-sensitive material.

When the light-sensitive layer relating to the invention contains the polymer latex, the polymer latex preferably accounts for not less than 50%, and more preferably not less than 70%, of the entire binder contained in the light-sensitive layer.

Here the polymer latex is one comprising an aqueous medium and a water-insoluble hydrophobic polymer dispersed in the medium in a form of fine particles. As the state of the dispersion may be one in which the polymer is emulsified in the medium, one prepared by emulsion polymerization, one dispersed in a micelle form and one in which the polymer partially has a hydrophilic structure and the molecular chain itself is dispersed in a molecular state are entirely usable. The average diameter of the dispersed particles is preferably from 1 to 50,000 nm and more preferably approximately from 5 to 1,000 nm. The distribution of the particle diameter is no specifically limited; one having wide distribution and one having monodispersed distribution are entirely usable.

The polymer latex relating to the invention may be either polymer latex having usual uniform structure or core/shell type latex. In the later case, it is preferable some times that the core and the shell are different from each other in the glass transition point. The lowest film forming temperature of the polymer latex relating to the invention is preferable from −30° C. to 90° C. and more preferably approximately from 0 to 70° C. A film forming aid may be added to lower the lowest film forming temperature. The film forming aid usable in the invention is a compound capable of lowering the lowest film forming temperature, which is also called as the plasticizer and described in, for example, S. Muroi "Chemistry of Synthesized latex", Koubunshi Kankoukai, 1970.

The species of polymer employable in the polymer latex include acryl resin, vinyl acetate resin, polyester resin, polyurethane resin, rubber type resin, vinyl chloride resin, vinylidene chloride resin, polyolefin resin and copolymers thereof. Linear polymer, branched polymer and crosslinked polymer may be employed. The polymer may be homopolymer formed by one kind of monomer or copolymer formed by polymerization of two or more kinds of monomer. The copolymer may be random copolymer or block copolymer. The molecular weight of the polymer is usually from 5,000 to 1,000,000, and more preferably approximately from 10,000 to 100,000, in number average molecular weight. When the molecular weight is too small, the mechanical strength of the layer is insufficient and when the molecular weight is too large, the film forming ability is low. Consequently, such the polymers are undesirable.

The polymer latex preferably has an equilibrium moisture content of from 0.01 to 2%, and more preferably from 0.01 to 1%, by weight at 25° C. and 60% HR. Regarding the definition and the measuring method of the equilibrium moisture content, for example, "Polymer Engineering Course 14, Polymer Material Test Method" edit. by Koubunshi Gakkai, Chijin Shokan, can be referred. Concrete examples of the polymer latex are those described in Japanese Patent O.P.I. Publication No. 287299, paragraph [0173]. These polymers may be employed singly or a blend of two or more kinds according to necessity. As the species of the polymer, one containing a carboxylic acid component such as acrylate or methacrylate in an amount of from approximately 0.1 to 10% by weight is preferable.

Moreover, the light-sensitive layer may contains a hydrophilic polymer such as gelatin, poly(vinyl alcohol), methyl cellulose, hydroxypropyl cellulose, carboxymethyl cellulose and hydroxypropyl cellulose within the range of not more than 50% by weight of the entire binder of the layer. The adding amount of these hydrophilic polymers is preferably not more than 30% by weight of the entire binder.

In the course of the preparation of the light-sensitive layer coating liquid, the organic silver salt and the aqueous polymer latex may be added in any order or in simultaneously, and it is preferable that the polymer latex is later added. Further more it is preferable that the organic silver salt and the reducing agent are mixed before the addition of the polymer latex. In the invention, when the temperature during the standing after the mixing of the organic silver salt and the polymer latex is too low, the surface of the coated layer is damaged and when the temperature is too high, the fog is increased. Consequently, the coating liquid after mixing is preferably stood at a temperature of from 30° C. to 65° C., and particularly preferably from 35° C. to 60° C. for the later-mentioned period. Such the temperature can be held by warming the preparation tank of the coating liquid.

The coating of the light-sensitive layer coating liquid relating to the invention is preferably carried out employing the coating liquid stood for a time of from 30 minutes to 24 hours, more preferably from 60 minutes to 12 hours, and particularly preferably from 120 minutes to 10 hours after the mixing of the organic silver salt and the aqueous polymer latex. Here "after mixing" means after the time when the organic silver salt and the aqueous polymer latex are added and the added components are uniformly dispersed. In the invention, the fogging in the storage period and the formation of the printed-out silver after the development are inhibited by the use of the crosslinking agent to the forgoing binder, although it is known that the adhesion of the layer with the support is improved and the unevenness of the development is reduced by the use of the crosslinking agent. As the crosslinking agent, various crosslinking agents usually used for photographic material such as the aldehyde type, epoxy type, ethyleneimine type, vinylsulfon type, sulfonate type, acryloyl type, carbodimide type and silane compound type carosslinking agents are used. The following isocyanate type compounds, silane compounds, epoxy compounds and acid anhydrides are preferable.

The isocyanate type crosslinking agent is isocyanates and adducts thereof each having at least two isocyanate groups. Concrete examples of such the compound are aliphatic diisocyanates, aliphatic diioscyanates each having a cyclic group, benzeneioscyanates, naphthalenediisocyanates, biphenylisocyanates, diphenylmethanediisocyanates, triphenylmethanediisocyanates, triisocyanates, tetraisocyanates, addacts of these isocyanates and addacts of these isocyanates with di-valent or tri-valent polyalcohols. In concrete, the isocyanate comounds described in Japanese Patent O.P.I. Publication No. 56-5535, pp. 10 to 12, are applicable.

The adduct of the isocyanate and the polyalcohol has high ability for improving the adhesive between the layers and preventing the peeling of the layer, aberration of image and formation of bubbles. Such the isocyanate compound may be arranged at any portions of the photo-thermal photographic material, for example, in the support or one or more optional layers provided on the light-sensitive layer side of the support such as the light-sensitive layer, a surface protective layer, an interlayer, an anti-halation layer and a subbing layer. When the support is paper, the compound can be contained in the sizing composition of the paper.

Thioisocyanate type crosslinking agents each having the thioisocyanate structure corresponding to the above-mentioned isocyanates are also useful.

The amount of the crosslinking agent is usually from 0.001 to 2 moles, and preferably from 0.005 to 0.5 moles, per mole of silver.

The isocyanate compounds and the thioisocyanate compounds contained in the layer according to the invention are preferably compounds capable of functioning as the above-mentioned crosslinking agent.

Examples of the silane compound employable in the invention as the crosslinking agent are those represented by Formula (1), (2) or (3) disclosed in Japanese Patent O.P.I. Publication No. 2001-264930.

The epoxy compound employable in the invention as the crosslinking agent is a compound having one or more epoxy groups. There is no limitation on any matter such as the number of the epoxy group and the molecular weight. It is preferable that the epoxy group is contained in the molecule as a glycidyl group through an ether bond or an imino bond. The epoxy compound may be any of a monomer, an oligomer and a polymer, and the number of the epoxy group being in the molecule is usually from about 1 to 10, and preferably from 2 to 4. In the case of that the epoxy compound is polymer, it may be either polymer or copolymer, and particularly preferable number average molecular weight Mn of it is approximately from 2,000 to 20,000.

The acid anhydride employable in the invention is a compound having at least one acid anhydride group represented by the following formula. There is no limitation on any matter such as the number of the acid anhydride group and the molecular weight.

—CO—O—CO—

The foregoing epoxy compound or acid anhydride compounds may be employed singly or in a combination of two or more thereof. Though the adding amount of them is not specifically limited, it is preferably from $1\times10^{-6}$ to $1\times10^{-2}$, more preferably from $1\times10^{-5}$ to $1\times10^{-3}$, moles $m^2$.

In the invention, the epoxy compounds and the acid anhydride compounds may be added into one or more optional layers provided on the light-sensitive layer side of the support such as the light-sensitive layer, the surface protective layer, the interlayer, the antihalation layer and the subbing layer.

The effects of the invention can be enhanced by the use of a silver saving agent. The silver saving agent is a compound capable of reducing the silver amount necessary for obtaining certain image density. Though various mechanisms of reducing the silver amount can be considered, the use of a compound capable of raising the covering power of the developed silver is preferable. The covering power of the developed silver is optical density per unit weight of silver.

Preferable examples of the silver saving agent are hydrazine derivatives, vinyl compounds, quaternary onium compounds and hydrazine compounds.

The concrete examples of the hydrazine derivative are Compounds H-1 through H-29 described in U.S. Pat. No. 5,545,505, columns 11 to 20, Compounds 1 through 12 described in U.S. Pat. No. 5,464,738, columns 9 to 11, Compounds H-1-1 through H-1-28, H-2-1 through H-2-9, H-3-1 through H-3-12, H-4-1 through H-4-21 and H-5-1 through H-5-5 described in Japanese Patent O.P.I. Publication No. 2001-27790, paragraphs [0042] to [0052].

Examples of the vinyl compound are Compounds CN-01 through CN-13 described in U.S. Pat. No. 5,545,515, columns 13 to 14, Compounds HET-01 and HET-02 described in U.S. Pat. No. 5,635,339, columns 10, Compounds MA-01 through MA-07 described in U.S. Pat. No. 5,654,130, columns 9 and 10, Compounds IS-01 through IS-04 described in U.S. Pat. No. 5,705,324, columns 9 and 10, and Compounds 1-1 through 218-2 described in Japanese Patent O.P.I. Publication No. 2001-125224, paragraphs [0043] to [0088].

A concrete example of the quaternary onium compound is triphenyltetrazolium.

Concrete examples of the silane compound are alkoxysilane compounds each having two or more secondary amino groups or a salt thereof such as Compounds A-1 to A-33 described in Japanese Patent O.P.I. Publication No. 2003-5324, paragraphs [0027] to [0029].

The adding amount of the silver saving agent is from $1\times10^{-5}$ to 1 mole, and preferably from $1\times10^{-4}$ to $1\times10^{-1}$ moles, per mole of the organic silver salt.

<Fog Inhibitor and Image Stabilizer>

Reducing agents such as bisphenols or sulfonamidophenols each having a proton are mainly used as the reducing agent, consequently it is preferable to a compound capable of inactivating the reducing agent by forming an active species which can abstract the hydrogen atom is contained in the layer. A colorless photo-oxidizing compound capable of forming a free radical as a reactive species by light exposure is preferable.

Therefore, any compounds having the above-described functions are employable; an organic radical composed of plural atoms is preferred. Compounds having any structure can be used as long as the compounds have such the functions and bring no baneful influence on the silver salt photo-thermal photographic imaging material. Such the free radical generating compounds each preferably have an aromatic hydrocarbon ring or heterocyclic ring for giving stability to the generated free radical so that the radical can be contacted the reducing agent for satisfactory time to inactivate the reducing agent. Typical examples of such the compound are bi-imidazolyl compounds and iodonium compounds.

The adding amount of the bi-imidazolyl compound and the iodonium compound is from 0.001 to 0.1 moles/$m^2$ and preferably from 0.005 to 0.05 moles/$m^2$. In the light-sensitive material according to the invention, the above compounds may be contained in any layer, and preferably near the reducing agent.

Many compounds capable of releasing a halogen atom as the active species have been also known as the fog inhibitor and the image stabilizer.

The adding amount of such the compounds is preferably within the range in which a problem of increasing of printed out silver by the formation of silver halide is substantially not caused. The amount is preferably not more than 150%, and more preferably not more than 100% of the amount of the compound not releasing the active halogen radical. Concrete examples of the compound capable of forming the active halogen radical are Compounds (III-1) through (III-23) described in Japanese Patent O.P.I. Publication No. 2002-169249, paragraph [0086] and [0087].

Fog inhibitors other than the above are described below.

Examples of fog inhibiter preferably usable in the invention are the Exemplified Compounds of a through j described in Japanese Patent O.P.I. Publication No. 8-314059, paragraph [0012], thiosulfonate esters A through K described in Japanese Patent O.P.I. Publication No. 7-209797, paragraph [0028], Exemplified Compounds (1) through (44) described in Japanese Patent O.P.I. Publication No. 55-140833, p. 14, Compounds (I-1) through (I-6) and (C-1) through (C-3) described in Japanese Patent O.P.I. Publication No. 2001-13627, paragraph [0063] and [0066], Compounds (III-1) through (III-108) described in Japanese Patent O.P.I. Publication No. 2002-90937, paragraph [0027], vinylsulfon compounds and/or β-halosulfon compounds such as Compound VS-1 through VS-7 and HS-1 through HS-5 described in Japanese Patent O.P.I. Publication No. 6-208192, paragraph [0013], sulfonylbenzotriazole compounds such as KS-1 through KS-8 described in Japanese Patent O.P.I. Publication No. 2000-330235, and substituted propenenitorile compounds such as PR-01 to PR-08 described in Japanese Patent O.P.I. Publication No. 2000-515995.

The foregoing fog inhibitors are generally employed in an amount of not less than 0.001 moles pre mole of silver. The range of the adding amount is usually from 0.01 to 5 moles, and preferably from 0.02 to 0.6 moles per mole of silver.

Compounds known as the fog inhibitor other than the above-mentioned may be contained in the silver salt photo-thermal photographic imaging material; the compounds may be either compounds capable of forming the reactive species the same as the foregoing compound or compounds different from the foregoing compounds in the fog inhibition mechanism. Examples of such the compounds are those described in U.S. Pat. Nos. 3,589,903, 4,546,075 and 4,452,885, Japanese Patent O.P.I. Publication No. 59-57234, U.S. Pat. Nos. 3,874,946 and 4,756,999, and Japanese Patent O.P.I. Publication Nos. 9-388328 and 9-90550. Moreover, the compounds described in U.S. Pat. No. 5,028,523, European Patent Nos. 600,587, 605,981 and 631,176 are usable as the fog inhibitor.

When the reducing agent has an aromatic hydroxyl group, particularly bis-phenols, a non-reductive compound capable of forming a hydrogen bond with such the group is preferably employed together with the reducing agent. Examples of the hydrogen bond forming compound are Compound (II-1) through (II-40) described in Japanese Patent O.P.I. Publication No. 2002-90937, paragraphs [0061] to [0064].

<Fluorine-containing Surfactant>

In the invention, fluorine-containing surfactants represented by Formula SF are preferably employed for improving the conveying property of film in the thermal development apparatus and the environmental suitability or accumulation in an organism.

Formula SF $$(Rf\text{-}(L_1)_{nl})_p\text{-}(Y)_{ml}\text{-}(A)_q$$

In the formula, Rf is a substituent having a fluorine atom; $L_1$ is a di-valent linking group having no fluorine atom; Y is a (p+q)-valent linking group having no fluorine atom; A is an anionic group or a salt thereof; nl and ml are each an integer of 0 or 1; p is an integer of from 1 to 3; provided that nl and ml are not 0 at the same time when q is 1.

The fluorine-containing surfactants represented by Formula SF can be obtained by introducing an anionic group A by sulfate esterification to a compound formed by an addition reaction or a condensation reaction of a fluorine introduced alkyl compound having from 1 to 25 carbon atoms such as a compound having a trifluoromethyl group, a pentafluoroethyl group, a perfluorobutyl group, a perfluoroctyl group or a perfluoroctadecyl group or an alkenyl group such as a compound having a perfluorohexenyl group or a perfluorononenyl group with a 3- to 6-valent alkanol compound having no fluorine atom, an aromatic compound having 3 or 4 hydroxyl groups or a hetero compound. Examples of the 3- to 6-valent alkanol compound are glycerol, pentaerythrytol, 2-methyl-2-hydroxymethyl-1,3-propanediol, 2,4-dihydroxy-3-hydroxymethylpentene, 1,2,6-hexanetriol, 1,1,1-tris(hydroxymethyl)propane, 2,2-bis(butanol)-3, an aliphatic triol, tetramethylolmethane, D-sorbitol, xylitol and D-mannitol.

Examples of the aromatic compound and the hetero compound each having 3 to 4 hydroxyl groups include 1,3,5 hydroxy benzene and 2,4,6-trihydroxypyridine.

Ten fluorine-containing surfactants represented by Formula SF can be added according to known methods, for example, that the surfactant is dissolved in alcohols such as methanol and ethanol, ketones such as methyl ethyl ketone and acetone, or polar solvent such as dimethylsulfoxide and dimethylformamide and added. The fluorine-containing surfactant may also be added in a state of fine particle of less than 1 μm dispersed in water or an organic solvent by a sand mill, a jet mill, an ultrasonic wave disperser or a homogenizer. The dispersing can be performed by disclosed dispersing techniques. The fluorine-containing surfactant represented by Formula SF is preferably added to the outermost protective layer.

The adding amount of the fluorine-containing surfactant represented by Formula SF is preferably from $1\times10^{-8}$ to $1\times10^{-1}$, particularly preferably from $1\times10^{-5}$ to $1\times10^{-2}$, per square meter. When the adding amount is less than the above, the desired static charging property cannot be obtained, and when the amount exceeds the above range, the moisture dependency is increased and the storage ability under high humidity is degraded.

<Surface Layer>

In the invention, it is preferable to employ an inorganic or organic powder as a matting agent in the surface layer (on the light-sensitive layer side and the light-insensitive layer provided on the opposite side) of the silver salt photothermal photographic imaging material for the essential purpose of the invention and controlling the surface roughness. The powder to be used in the invention is preferably one having a Mho's hardness of 5 or more. The powder optionally selected from known inorganic or organic powders can be employed. Examples of the inorganic powder are titanium oxide, boron nitride, $SnO_2$, $SiO_2$, $Cr_2O_3$, $\alpha$-$Al_2O_3$, $\alpha$-$Fe_2O_3$, $\alpha$-FeOOH, SiC, cerium oxide, corundum, artificial diamond, garnet, mica, silica rock, silicon nitride and silicon carbide. Examples of the organic powder are powders of poly(methyl acrylate), polystyrene and Teflon®. Among them, the inorganic powders of $SiO_2$, titanium oxide, barium sulfate, $\alpha$-$Al_2O_3$, $\alpha$-$Fe_2O_3$, $Cr_2O_3$ and mica are preferable, $SiO_2$ and $\alpha$-$Al_2O_3$ are more preferable and $SiO_2$ is particularly preferable.

In the invention, it is preferable that the surface of the powder particle is treated by a silicon compound or an aluminum compound. The surface condition of the outermost layer can be improved by the use of such the surface treated powder. The content of the silicon or the aluminum is preferably from 0.1 to 10%, more preferably from 0.1 to 5%, and particularly preferably from 0.1 to 2%, by weight, respectively. The ratio of Si and Al is preferably Si<Al. The surface treatment can be performed by the method described in Japanese Patent O.P.I. Publication No. 2-83219. The average particle diameter of the powder in the invention is defined by the average diameter in the case of the spherical powder, the average of the length of the major axis in the case of the needle-shaped powder, or the average of the largest diagonal length of the planar in the case of the planar shaped powder; they are easily determined from the measurement by the electron microscopic observation.

The average particle diameter of the organic or inorganic powder is preferably from 0.5 to 10.0 μm and more preferably from 1.0 to 8 μm.

The average particle diameter of the organic or inorganic powder contained in the outermost layer of the light-sensitive layer is usually from 0.5 to 8.0 μm, preferably from 1.0 to 6.0 μm, and more preferably from 2.0 to 5.0 μm. The adding amount is usually from 1.0 to 20%, preferably from 2.0 to 15%, and more preferably from 3.0 to 10%, by weight of the amount of the binder including that of the hardening agent to be used in the outermost layer. The average diameter of the organic or inorganic powder particles contained in the outermost layer provided on the side of the support opposite to the light sensitive layer is usually from 2.0 to 15.0 μm, preferably from 3.0 to 12.0 μm, and more preferably from 4.0 to 10.0 μm. The adding amount is usually from 0.2 to 10%, preferably from 0.4 to 7%, and more preferably from 0.6 to 5%, by weight of the amount of the binder including that of the hardening agent to be used in the outermost layer.

The variation coefficient of the particle size distribution of the powder is preferably not more than 50%, more preferably not more than 40% and particularly preferably not more than 30%. The variation coefficient is a value calculated by the following equation.

{(Standard deviation of particle diameter)/(Average particle diameter)}×100

The method for adding the organic or inorganic powder may be a method in which the powder is previously dispersed in the coating liquid and coated or a method in which the coating liquid is coated and the powder is sprayed to the coated layer before drying thereof. Both of the method may be applied in combination when plural kinds of the powder are added.

In the silver salt photo-thermal photographic dry imaging material according to the invention, Lb/Le is preferably from 1.5 to 10 wherein Le is the average particle diameter in μm of the matting agent contained in the outermost layer on the light-sensitive layer side and Lb is the average particle diameter of the matting agent contained in the outermost layer on the back coat layer. The unevenness of the image density on the occasion of the thermal development can be improved by bringing the value of Lb/Le within the above range.

The raw material of the support to be used in the silver salt photo-thermal photographic dry imaging material are, for example, various polymers, glass, wool cloth, cotton cloth, paper and metal such as aluminum. One capable of being formed a state of flexible sheet or roll is suitable from the viewpoint of handling as an information recording medium. Accordingly, as the support for the silver salt photo-thermal photographic dry imaging material, plastic film such as cellulose acetate film, polyester film, polyester film, poly (ethylene terephthalate) film, polyamide film, polyimide film, cellulose triacetate film and polycarbonate film is preferable. Two dimensionally elongated poly(ethylene terephthalate) film is particularly preferred. The thickness of the support is approximately from 50 to 300 μm, preferably from 70 to 180 μm.

In the invention, electroconductive metal oxide and or an electro conductive compound such as electroconductive polymer may be contained in the structural layer for improving the static charge property. Though the electroconductive material may be contained in any layer, it is preferably contained in the backing layer, the surface protective layer or the subbing layer. In the invention, the electroconductive compounds described in U.S. Pat. No. 5,244,773, columns 14 to 20, are preferably employed.

In the invention, it is preferable that the electroconductive metal oxide is contained in the surface protective layer on the backing layer side. It is found that the effects of the invention, particularly the conveying ability on the occasion of the thermal development, are enhanced by such the addition of the electroconductive material. Here, the electroconductive oxide is a crystalline metal oxide particle; the particle containing an oxygen defect and the particle containing a small amount of different kind of atom functioning as a donor to the metal oxide are particularly preferable since such the particle generally has high conductance. The later is particularly preferable because it does not cause fogging of the silver halide emulsion. Examples, of preferable metal oxide are ZnO, $TiO_2$, $SnO_2$, $Al_2O_3$, $In_2O_3$, $SiO_2$, MgO, BaO, $MoO_3$, $V_2O_5$, and a composite salt thereof. Particularly, ZnO, $TiO_2$ and $SnO_2$ are preferred. As examples of addition the different kind of atom, the addition of Al or In to ZnO, that of Sb, Nb, P or a halogen atom to $SnO_2$, and that of Nb or Ta to $TiO_2$ are effective. The adding amount of such the different kind atom is preferably from 0.01 to 30 mole %, and particularly preferable from 0.1 to 10 mole %. Moreover, a silicon compound may be added on the occasion of preparation of the fine particle to improve the dispersing ability and the transparency of the fine particle. The metal oxide to be employed in the invention has electro conductivity, and the specific volume resistivity is not more than $1\times10^{3}$ Ω·cm, particularly not more than $1\times10^{5}$ Ω·cm. Japanese Patent O.P.I. Publication Nos. 56-143431, 65-120519, 58-62647 describe about these metal oxides. Another crystalline metal oxide or a fibrous material such as titanium oxide described in Japanese Patent Examined Publication No. 59-6235 may be employed.

The size of the applicable particle is preferably not more than 1 μm, and the particle having a size of not more than 0.5 μm is easily usable since the stability of the particle after dispersing is high. The use the electroconductive particle having a size of not more than 0.3 μm is preferable since the light scatter can be made as low as possible and a transparence light-sensitive material can be prepared. When the electroconductive metal oxide has needle-like or fibrous shape, a length of not more than 30 μm and a diameter of not more than 1 μm are preferable. It is particularly preferable that the particle has a length of not more than 10 μm, a diameter of not more than 0.3 μm and a ratio of length to diameter of not less than 3. As the $SnO_2$, SNS10M, SN-100P, SN-100D and FSS10M sold by Ishihara Sangyo Co., Ltd. can be employed.

The silver salt photo-thermal photographic dry imaging material comprises at least one light-sensitive layer on the support. Though the light-sensitive layer may be solely formed on the support, at least one light-insensitive layer is preferably formed on the light-sensitive layer. For example, a protective layer is preferably provided on the light-sensitive layer for protecting the light-sensitive layer, and a back coating layer is provided on the opposite side of the support for preventing adhesion between the sheets or in the roll of the thermally developable material. The polymer which has a glass transition point higher than that of the light-sensitive layer and difficultly deformed and scratched such as cellulose triacetate and cellulose acetate-butylate is selected from the foregoing binder as the binder for the protective layer and the back coat layer.

For adjusting gradation and the like the two or more layers may be provided on one side of the support and one or more layers may be provided on both of the sides of the support.

<Dye>

In the silver salt photo-thermal photographic dry imaging material, it is preferable that a filter layer is formed on the light-sensitive side or the opposite side or that a dye or a pigment is added to the light-sensitive layer for controlling the amount or wavelength distribution of light passed through the light-sensitive layer.

Various known dyes each absorbing various wavelength regions can be employed according to the spectral sensitivity of the thermally developable material. For example, when the silver salt photo-thermal photographic dry imaging material is a image recording material by infrared rays, squalilium dyes having a thiopyrylium nucleus, referred to as thiopyryliumsqualilium dye in this specification, such as those disclosed in Japanese Patent O.P.I. Publication and squalilium dyes each having a pyrylium nucleus, referred to as pyryliumsqualilium dye in this specification, and thiopyryliumchroconium dyes and pyryliumchroconium dyes each similar to the squalilium dye are preferably employed.

The compound having the squalilium nucleus is a compound having a 1-cyclobutene-2-hydroxy-4-one group and the compound having the chroconium group is a compound having a 1-cyclopentene-2-hydroxy-4,5-dione group in the molecular structure thereof. The hydroxyl group may be dissociable. In the invention, such the dyes are collectively referred to as squalilium dye for convenience. The dyes described in Japanese Patent O.P.I. Publication No. 8-201959 are also preferable.

<Coating of Structural Layer>

The silver salt photo-thermal photographic dry imaging material is preferably prepared by a method in which the forgoing raw materials of each of the structural layers are dissolving or dispersing in solvents to prepare coating liquids, and the resulted coating liquids are simultaneously coated to form a multi-coated layer and subjected to a heat treatment. The "simultaneously coating to form a multi-coated layer" means a procedure in which the multi-coated layer composed of the plural structural layers are formed in a state that the coating liquids of each structural layers are simultaneously coated to form the multi-coated layer and dried, the multi-coated layer is not formed by repeating of the coating and drying of the individual layer. Namely, the upper layer is provided before the remaining ratio of the entire solvent in the lower layer is become to not less than 70% and more preferably not less than 90%.

The simultaneous coating of the plural layers can be known methods without any limitation, for example, a bar coating method, a curtain coating method, an immersing method, an air-knife method, a hopper coating method, a reverse roller method, a sliding coating method, a gravure coating method and extrusion coating method. Among them, the sliding coating method and the extrusion coating method is preferred. In the above, the coating methods are described about the coating on the light-sensitive layer side, and such the coating methods can be applied to the coating of the backing layer together with the under coating layer. The simultaneous multi-layer coating method for the thermally developable material is described in detail in Japanese Patent O.P.I. Publication No. 2000-15173.

The coating amount of silver is preferably decided according to the purpose of the silver salt photo-thermal dry imaging material. For the medical purpose, the silver amount is preferably from 0.3 g/m$^2$ to 1.5 g/m$^2$ and more preferably from 0.5 g/m$^2$ to 1.5 g/m$^2$. The silver derived from the silver halide preferably accounts for 2 to 18%, and more preferably from 5 to 15%, of the entire amount of silver. The coating density of silver halide particles having a sphere-equivalent particle diameter of not less than 0.01 μm is preferably from $1\times10^{14}$ to $1\times10^{18}$ particles/m$^2$ and more preferably from $1\times10^{15}$ to $1\times10^{17}$ particles/m$^2$.

The coating density of the silver salt of light-insensitive long chain aliphatic carboxylic acid is preferably from $1\times10^{-17}$ g to $1\times10^{-14}$ g, and more preferably from $1\times10^{-16}$ g to $1\times10^{-15}$ g, per one particle of the silver halide having a sphere-equivalent particle diameter of not less than 0.01 μm.

When the coating is carried out under the condition within the above-described range, preferable results are obtained in the maximum optical density per a certain coating amount of silver or the covering power of silver and the tone of the silver image.

It is preferable that the silver salt photo-thermal photographic dry imaging material contains a solvent in an amount within the range of from 5 to 1.000 mg/m$^2$. It is more preferable that the amount of the solvent is controlled so as to be from 100 to 500 mg/m$^2$. Thus the silver salt photo-thermal photographic dry imaging material can be obtained which has high sensitivity, low fog and high maximum density. The solvents described in Japanese Patent O.P.I. Publication No. 2001-264930, paragraph [0030] are usable, although the solvent is not limited thereto. The solvents may be employed singly or in a combination of several kinds.

The content of the solvent in the silver salt photo-thermal photographic dry imaging material can be controlled according to variation of the production condition such as the temperature in the coating and the drying processes. The amount of the solvent can be measured by gas chromatography under a condition suitable for detection of the solvent contained in the silver salt photo-thermal photographic dry imaging material.

<Package>

The silver salt photo-thermal photographic dry imaging material is preferably stored in a package for preventing variation of the density and formation of fogging. The space ratio in the package is from 0.01 to 10% and preferably from 0.02 to 5%. It is preferable to enclose nitrogen gas so that the partial pressure of nitrogen in the package is to not less than 80% and preferably to not less than 90%.

<Exposure to the Silver Salt Photo-thermal Photographic Dry Imaging Material>

Laser light is usually used for exposing the silver salt photo-thermal photographic dry imaging material. A light source suited for the color sensitivity given to the silver salt photo-thermal photographic dry imaging material of the invention is preferably employed. For example, when the material is infrared sensitive, any light source of infrared region can be employed, and an infrared semiconductor laser (780 nm, 820 nm) is preferably employed since the laser is high power and the silver salt photo-thermal photographic dry imaging material can be made transparency.

In the invention, the exposure is preferably performed by scanning by laser beam, and various methods can be applied for the exposing. For example, a method employing a laser scanning exposure apparatus is applicable as the first preferable method in which the angle of the scanning laser beam with the surface of the light-sensitive material to be exposed is substantially not become perpendicular. The "substantially not become perpendicular" means that the angle nearest the perpendicular in the course of the scanning is preferably from 55° to 88°, more preferably from 60° to 86°, further preferably from 65° to 84°, and most preferably from 70° to 82°.

The diameter of the spot of the beam at the light-sensitive material surface on the occasion of the scanning is preferably not more than 200 μm and more preferably not more than 100 μm, because the shifting of the incidental light angle from the perpendicular of the can be reduced when the spot diameter is smaller. The lower limit of the spot diameter is 10 μm. the degradation of image quality relating to light reflection such as formation of density unevenness as like as interference fringes can be reduced by such the laser scanning exposure.

As the second method, the exposure by a laser scanning exposing apparatus generating vertically multiple laser light is preferably performed. The degradation of image quality caused by formation of density unevenness as like as interference fringes can be reduced by employing such the exposure compared with the scanning exposure by vertical single mode laser light. For multiplication, methods by synthesizing, application of returned light and overlapping with high frequency are preferable. The vertically multiple means that the wavelength of the light for exposure is not single, and the distribution of the wavelength of the exposing light is usually not less than 5 μm and preferably not less than 10 μm. Though there is no upper limitation on the wavelength distribution, and the upper limit is usually 60 μm.

It is preferably as the third embodiment that the image is formed by scanning exposure by two or more laser light beams.

The image recording technique employing plural laser light beams is utilized as a writing means in a laser printer or a copying machine for writing plural lines every once of scanning for responding to the requirement of high resolution and high speed. Such the technique is known, for example, by Japanese Patent O.P.I. Publication No. 60-166916. In such the technique, laser light beam irradiated from a light source unit is swung for scanning by a polygon mirror and focused on the photoreceptor surface through a fθ lens, which is a laser scanning optical apparatus the same as a laser imager in the principle.

In the laser printer and the digital copying machine, a laser light beam is focused on the photoreceptor at a position apart for online width from the previous scanning line of another beam to satisfy the purpose of writing plural lines by one time of scanning. In concrete, the two light beams near at a space of tens microns in the sub-scanning direction on the imaging surface. In the case of the writing density is 400 dpi, the pitch of the two beams in the sub-scanning direction is 63.5 μm, and when the writing density of 600 dpi, the pitch is 42.3 μm. In the invention, it is preferable to form an image by focusing two light beams each different in the incident angle at the same position of the exposing face. Such the method is different from the foregoing method in which the light beams are parted in the sub-scanning direction by the space corresponding to the resolution. When the exposing energy necessary to writing the image by one laser light beam having a wavelength of λ nm is E at the exposing surface, and N laser beams employed for image forming each have the same wavelength of λ nm and the same energy En, the relation of them is preferably $0.9\times E \leqq En\times N \leqq 1.1\times E$. By satisfying the above condition, the energy at the exposing surface is kept since the reflection of each of the laser light beams to the light-sensitive layer is reduced since the exposing energy of each of the light beam is low. As a result of that, the formation of the interference fringes is inhibited.

Though the plural light beams each different in the wavelength λ are employed in the above-described case, light beams each different from the other in the wavelength may be employed. In such the case, it is preferably to make the difference of the wavelength to λ nm to be within the range of $(\lambda-30)<\lambda_1, \lambda_2 \ldots \lambda_n \leqq (\lambda+30)$.

Commonly known lasers are employed in the above the first to third image forming embodiments. The laser can be optionally selected from the followings according to the purpose of the use: solid lasers such as a ruby laser, A YAG laser and a glass laser; gas lasers such as He—Ne laser, $CO_2$ laser, a Co laser, He—Cd laser, $N_2$ laser and an excimer laser; semiconductor lasers such as an InGaP laser, an AlGaAs laser, a GaAsP laser, an InGaAs laser, an InAsP laser, a $CdSnP_2$ laser and a GaSb laser; Chemical lasers and dye lasers. Among them, the semiconductor lasers emitting light of a wavelength of from 600 to 1200 nm are preferably employed from the viewpoint of maintenance and the size of the light source. The spot size of the light beam at the surface of the thermal developable material on the occasion of the scanning to be used in the laser imager and the laser image setter is usually from 5 to 75 μm in the minor axis and from 5 to 100 μm in the major axis. The speed of the scanning by the laser can be set at a suitable value to the individual silver salt photo-thermal photographic dry imaging material according to the sensitivity of the thermally developable material at the wavelength of the light emitted from the laser and the power of the laser.

<Thermal Development Apparatus>

The thermal development apparatus in the invention comprises a film supplying means typically a film tray, a laser image recording means, a thermally developing means for uniformly and stably applying heat to the entire surface of the thermally developable material, and a conveying means by which the thermally developable material is conveyed from the film supplying means and through the laser recording means and the development means to form an image and to output to outside of the apparatus. A concrete example of such the embodiment of the thermal development apparatus is displayed in FIG. 1.

The thermal development apparatus 100 is constituted by a supplying means 110 for supplying the film sheet of thermal developable material F one by one, a exposing means 120 for exposing the conveyed film F, a developing means 130 for developing the exposed film F, a cooling means 150 for stopping the development, an accumulating means 160, a pair of conveying rollers 140 for conveying the film F conveyed from the film supplying means, a pair of conveying rollers 144 for conveying the film F to the developing means, and plural pairs of conveying rollers 141, 142, 143 and 145. The developing means is constituted by a heating drum 1 having plural counter rollers 2 as a heating means for developing the film F, by which the film F is heated while being almost contacted and held to the circumference of the drum, and a separating claw for separating the developed film from the drum and conveying to the cooling portion.

The conveying speed of the silver salt photo-thermal photographic dry imaging material is preferably from 10 to 200 mm/second.

The development of the silver salt photo-thermal photographic dry imaging material is typically carried out by heating the imagewise exposed material at suitably high temperature; the condition of the development is changed depending on the employed apparatus or means. The latent image formed by the exposure is developed by heating at a medium high temperature such as a temperature from 80 to 200° C., preferably from about 100 to 200° C., for sufficient time, usually from 1 second to 2 minutes.

When the heating temperature is less than 80° C., sufficient image density cannot be obtained for the short time and when the temperature is more than 200° C., the binder is fused and not only the formation of damage the image by transferring to the roller but bad influences are also brought to the conveying ability and the developing apparatus. The silver image is formed by oxidation-reduction of the organic silver salt functioning as an oxidizing agent with the reducing agent by heating. Such the reaction process is progressed without supplying of any processing liquid such as water.

Typical heating means such as a hot plate, an iron, a hot roller, carbon and white titanium oxide may be employed as the heating device apparatus or means. The thermally developable material having the protective layer is preferably heated by contacting the side on which the protective layer is provided to the heating means from the viewpoint of uniformly heating, heating efficiency and the working efficiency. It is preferable that the thermally developable material is conveyed to be developed while the protective layer provided side thereof is contacted to the heating roller.

EXAMPLES

The invention is described in detail bellow referring examples; the invention is not limited to the examples. In the examples, percent is percent by weight as long as no specific description is attached.

<<Preparation of Light-sensitive Silver Halide Emulsion>>

| <Preparation of light-sensitive emulsion-1> | |
|---|---|
| (Solution A1) | |
| Phenylcarbamoyl-modified gelatin | 88.3 g |
| Compound A (*1) 10% methanol solution | 10 ml |
| Potassium bromide | 0.32 g |
| Make up by water to | 5429 ml |
| (Solution B) | |
| Silver nitrate (0.67 moles/L aqueous solution) | 2635 ml |
| (Solution C1) | |
| Potassium bromide | 51.55 g |
| Potassium iodide | 1.47 g |
| Make up by water to | 660 ml |
| (Solution D1) | |
| Potassium bromide | 154.9 g |
| Potassium iodide | 4.41 g |
| $K_3OsCl_6 + K_4[Fe(CN)_6]$ | 50.0 ml |
| (Dopant: each $2 \times 10^{-5}$ moles/mole Ag) | |
| Make up by water to | 1982 ml |
| (Solution E) | |
| Potassium bromide (0.4 moles/L aqueous solution) An amount necessary to controlling the silver electrode potential | |
| (Solution F1) | |
| Potassium hydroxide | 0.71 g |
| Make up by water to | 20 ml |
| (Solution G1) | |
| Acetic acid (56% aqueous solution) | 18.0 ml |
| (Solution H1) | |
| Sodium carbonate anhydrous | 1.72 g |
| Make up by water to | 151 ml |

(*1) Compound A: $HO(CH_2CH_2O)_n(CH(CH_3)CH_2O)_{17}(CH_2CH_2O)_mH$ (m + n = 5 to 7)

One fourth amount of Solution B1 and entire amount of Solution C1 were added to Solution A1 spending 4 minutes and 45 seconds by a double-jet method using the mixing stirrer described in Japanese Patent Examined Publication No. 58-58288 to form nuclei. After 1 minute, the entire amount of Solution F1 was added. In the course of the mixing, pH was optionally controlled using Solution E. After passing of 6 minutes, ¾ amount of Solution B and the entire amount of Solution D1 were added by the double-jet method spending 14 minutes and 15 seconds while controlling the pAg value at 8.09. After stirring for 5 minutes, the entire amount of Solution G to precipitate silver halide emulsion. Supernatant was removed so as to remain 2000 ml of precipitated part, and 10 L of water was added to the remained part and stirred. Then the emulsion was precipitated again. The supernatant was removed so as to remain 1500 ml of precipitated part, and Solution H1 was added to the remained part. And then the temperature of the resultant was raised by 60° C. and stirred further for 120 minutes. Finally, the pH value was adjusted to 5.8 and water was added so that the weight of the mixture was 1161 g per mole of silver. Thus silver halide emulsion was obtained.

The silver halide grain in the above-obtained light-sensitive silver halide emulsion-1 was monodispersed cubic silver iodobromide emulsion having a sphere-equivalent diameter of 0.060 μm, a variation coefficient of the sphere-equivalent diameter of 12% and a [100] face ratio of 92%. Such the data were determined by average of 1,000 grains observed by an electron microscope. The [100] face ratio was determined by Kuberkamung method. The ratio of the silver halide grains having the diameter of from 0.001 μm to 0.050 μm in the light-sensitive silver halide emulsion-1 was 61% by weight of the entire light-sensitive silver halide grains in terms of silver.

<Preparation of Light-sensitive Silver Halide Emulsion-2>

Light-sensitive silver halide emulsion-2 was prepared in the same manner as in light-sensitive Silver Halide Emulsion 1 except that the temperature on the occasion of the initial addition and mixing was changed to 25° C. The emulsion was a monodispersed cubic silver iodobromide emulsion having an average grain size of 0.035 μm, a variation coefficient of grain size of 11% and a ratio of [100] face of 91%. The ratio of the silver halide grains having the diameter of from 0.001 μm to 0.050 μm in the light-sensitive silver halide emulsion-2 was 94% by weight of the entire light-sensitive silver halide grains in terms of silver.

<Preparation of Light-sensitive Silver Halide Emulsion-3>

Light-sensitive silver halide emulsion-3 was prepared in the same manner as in light-sensitive silver halide emulsion-1 except that the temperature on the occasion of the initial addition and mixing was changed to 35° C. The emulsion was a monodispersed cubic silver iodobromide emulsion having an average grain size of 0.040 μm, a variation coefficient of grain size of 12% and a ratio of [100] face of 92%. The ratio of the silver halide grains having the diameter of from 0.001 μm to 0.050 μm in the light-sensitive silver halide emulsion-3 was 87% by weight of the entire light-sensitive silver halide grains in terms of silver.

<<Preparation of Silver Halide Grain-containing Powdered Organic Silver Salt>>

<Preparation of Silver Halide Grain-containing Powdered Organic Silver Salt A-1>

Organic silver salt particles were prepared using non purified behenic acid available on the market as a reagent. According to the result of analysis of the behenic acid by the later-mentioned method, the content of behenic acid was 80% by weight, and arachidic acid and stearic acid were contained in the remaining part. Therefore, a mixture of 130.8 g of behenic acid, 67.7 g of arachidic acid, 43.6 g of stearic acid and 2.3 g of palmitic acid was prepare using chemical reagents of arachidic acid, stearic acid and palmitic acid. The mixture was put into 4720 ml of purified water and dissolved at 80° C. Then 540.2 ml of a 1.5 moles/L aqueous solution of sodium hydroxide was added to the solution, and 6.9 ml of concentrated nitric acid was further added and the solution was cooled by 55° C. Thus a solution of sodium salts of mixed fatty acids was obtained. The subsequent operations were carried out under a light-shielded condition. To the solution of sodium salts of mixed fatty acids, 45.3 g of light-sensitive silver halide Emulsion-1 and 450 ml of purified water were added and stirred for 5 minutes while the temperature of the solution was maintained at 55° C. Then 702.6 ml of a 1 mole/L silver nitrate aqueous solution was added to the resultant solution spending 2 minutes and stirred for 10 minutes to obtain silver halide grain containing organic silver salt dispersion A-1. Thus obtained silver halide grain containing organic silver salt dispersion A-1 was poured to a vessel for washing, and deionized water was added and the mixture was stirred. After the stirring, the mixture was left to separate by floating silver halide grain containing organic silver salt dispersion A-1, and the lower liquid layer containing water-soluble salts was removed. After that, washing and draining off of water were repeated until the electroconductivity of the drained water was attained to 2 μS/cm. Then the silver halide grain containing organic silver salt particles A-1 in a state of cake were obtained by centrifugation. The cake of silver halide grain containing organic silver salt particles A-1 was dried until the moisture content was become to 0.1% by a fluidized bed drying machine Midget Dryer MDF-64, manufactured by Dalton Co., Ltd., in a nitrogen atmosphere under the control of the temperature of hot air at the entrance of the drying machine to obtain silver halide grain-containing powdered organic silver salt A-1. The moisture content of the silver halide grain-containing powdered organic silver salt A-1 was measured by an infrared moisture meter. The amount of behenic acid was measured by the following method; the ratio of the silver behenate contained in the silver halide grain-containing powdered organic silver salt A-1 was 54% by weight. According to the results analysis on the organic acids after mixing, the content of heavy metal was 5 ppm and the iodine value was 1.5.

<Analytical Method of Organic Silver Salt>

The content of silver behenate was measured by the following procedure. Ten milligrams of the organic acid was exactly weighed and put into a 200 ml eggplant-shaped flask, and 15 ml of methanol and 3 ml of 4 moles/L hydrochloric acid were added and dispersed by ultrasonic wave for 1 minute. The dispersion was fluxed for 60 minutes after addition of Teflon® boiling tips. After cooling, 5 ml of methanol was added to wash the adhered matter to the cooler into the eggplant-shaped flask; the washing was repeated tow times. The resultant reaction liquid was extracted two times by adding 100 ml of ethyl acetate and 70 ml of water and separating liquid layers. The extract was dried for 30 minutes by vacuum. Into a 10 ml messflask, 1 ml of benzanthrone was poured as the interior standard, and the extract dissolved in toluene was further put to the messflask and adjust the entire volume to 10 ml by toluene. The resultant solution was subjected to gas chromatography, and the content of each of the organic acids in mole percentage was determined from the area of the peak and percentage by weight was calculated to determine the composition of the entire organic acids.

Thereafter, the amount of free organic acid not forming organic silver salt was measured. About 20 mg of the organic silver salt sample was exactly weighed and 10 ml of methanol was added to the sample. Then the sample was dispersed in methanol by ultrasonic wave for 1 minute. The free organic acids were extracted by filtering the dispersion and the filtrate was dried by evaporation. The extract was subjected to measurement by the gas chromatograph by similar procedure to the foregoing analysis of the organic silver salt. Thus the composition of the free organic acid and the ratio of that to the entire organic acid could be determined. The composition of the organic acids being in the silver salt is determined from the difference between the entire amount of the acids and that of the free acids.

<Preparation of Silver Halide Grain-containing Powdered Organic Silver Salt A-2>

Silver halide grain-containing powdered organic silver salt A-2 was prepared in the same manner as in silver halide grain-containing powdered organic silver salt A-1 except that light-sensitive silver halide emulsion 2 was employed in place of light-sensitive silver halide emulsion-1. The content of silver behenate in silver halide grain-containing powdered organic silver salt A-2 was 55% by weight.

<Preparation of Silver Halide Grain-containing Powdered Organic Silver Salt A-3>

Silver halide grain-containing powdered organic silver salt A-3 was prepared in the same manner as in silver halide grain-containing powdered organic silver salt A-1 except that light-sensitive silver halide emulsion-3 was employed in place of light-sensitive silver halide emulsion-1. The content of silver behenate in silver halide grain-containing powdered organic silver salt A-3 was 54% by weight.

<Preparation of Silver Halide Grain-containing Powdered Organic Silver Salt B-1>

Silver halide grain-containing powdered organic silver salt B-1 was prepared in the same manner as in silver halide grain-containing powdered organic silver salt A-1 except that potassium hydroxide was employed in place of sodium hydroxide. The content of silver behenate in silver halide grain-containing powdered organic silver salt B-1 was 53% by weight.

<Preparation of Silver Halide Grain-containing Powdered Organic Silver Salt B-2>

Silver halide grain-containing powdered organic silver salt B-2 was prepared in the same manner as in silver halide grain-containing powdered organic silver salt A-2 except that potassium hydroxide was employed in place of sodium hydroxide. The content of silver behenate in silver halide grain-containing powdered organic silver salt B-2 was 54% by weight.

<Preparation of Silver Halide Grain-containing Powdered Organic Silver Salt B-3>

Silver halide grain-containing powdered organic silver salt B-3 was prepared in the same manner as in silver halide grain-containing powdered organic silver salt A-3 except that potassium hydroxide was employed in place of sodium hydroxide. The content of silver behenate in silver halide grain-containing powdered organic silver salt B-3 was 54% by weight.

<Preparation of Silver Halide Grain-containing Powdered Organic Silver Salt B-4>

Silver halide grain-containing powdered organic silver salt B-4 was prepared in the same manner as in silver halide grain-containing powdered organic silver salt A-1 except that potassium hydroxide was employed in place of sodium hydroxide and light-sensitive silver halide emulsion-1 was replaced by a mixture of 15% by weight of light-sensitive emulsion-1 and 85% by weight of light-sensitive silver halide emulsion-3. The content of silver behenate in silver halide grain-containing powdered organic silver salt B-1 was 54% by weight.

<Preparation of Silver Halide Grain-containing Powdered Organic Silver Salt C-1>

Organic silver salt particles were prepared using non purified behenic acid available on the market as a reagent. According to the result of analysis of the behenic acid by the afore-mentioned method, the content of behenic acid was 80% by weight, and arachidic acid and stearic acid were contained in the remaining part. Therefore, a mixture of 130.8 g of behenic acid, 67.7 g of arachidic acid, 43.6 g of stearic acid and 2.3 g of palmitic acid was prepare using chemical reagents of arachidic acid, stearic acid and palmitic acid. The mixture was put into 4720 ml of purified water and dissolved at 80° C. Then 540.2 ml of a 1.5 moles/L aqueous solution of potassium hydroxide was added to the solution, and 6.9 ml of concentrated nitric acid was further added and the solution was cooled by 55° C. Thus a solution of potassium salts of mixed fatty acids was obtained. The subsequent operations were carried out under a light-shielded condition. To the solution of potassium salts of mixed fatty acids, 347 ml of i-propanol was added and stirred for 20 minutes, and then 45.3 g of light-sensitive silver halide emulsion 2 and 450 ml of purified water were added and stirred for 5 minutes while the temperature of the solution was maintained at 55° C. Then 702.6 ml of a 1 mole/L silver nitrate aqueous solution was added to the resultant solution spending 2 minutes and stirred for 10 minutes to obtain silver halide grain containing organic silver salt dispersion C-1. Thus obtained silver halide grain containing organic silver salt dispersion C-1 was poured to a vessel for washing, and deionized water was added and the mixture was stirred. After the stirring, the mixture was left to separate by floating silver halide grain containing organic silver salt dispersion C-1, and the lower liquid layer containing water-soluble salts was removed. After that, washing and draining off of water were repeated until the electroconductivity of the drained water was attained to 2 μS/cm. Then the silver halide grain containing organic silver salt particles C-1 in a state of cake were obtained by centrifugation. The cake of silver halide grain containing organic silver salt particles C-1 was dried until the moisture content was become to 0.1% by a fluidized bed drying machine Midget Dryer MDF-64, manufactured by Dalton Co., Ltd., in a nitrogen atmosphere under the control of the temperature of hot air at the entrance of the drying machine to obtain silver halide grain-containing powdered organic silver salt C-1. The moisture content of the silver halide grain-containing powdered organic silver salt C-1 was measured by an infrared moisture meter. The amount of behenic acid was measured by the afore-mentioned method; the ratio of the silver behenate contained in the silver halide grain-containing powdered organic silver salt C-1 was 54% by weight. According to the results analysis on the organic acids after mixing, the content of heavy metal was 5 ppm and the iodine value was 1.5.

<Preparation of Silver Halide Grain-containing Organic Powdered Silver Salt C-2>

Silver halide grain-containing organic powdered silver salt C-2 was prepared in the same manner as in silver halide grain-containing powdered organic silver salt C-1 except that t-butanol was employed in place of i-propanol. The content of silver behenate in silver halide grain-containing powdered organic silver salt C-2 was 54% by weight.

<Preparation of Silver Halide Grain-containing Powdered Organic Silver Salt C-3>

Silver halide grain-containing powdered organic silver salt C-3 was prepared in the same manner as in silver halide grain-containing powdered organic silver salt C-1 except that methyl ethyl ketone was employed in place of i-propanol. The content of silver behenate in silver halide grain-containing powdered organic silver salt C-3 was 53% by weight.

<<Preparation of Light-sensitive Emulsion Dispersion A-1>>

In 1457 g of methyl ethyl ketone, 14.57 g of

Exemplified Compound P-9 listed in Table 1 was dissolved and 500 g of silver halide grain-containing powdered organic silver salt A-1 was gradually added while stirring by a dissolver Dispermat CA-40, manufactured by VMA-Getzmann Co., Ltd., and sufficiently stirred to prepare a preliminary dispersion A-1.

The preliminary dispersion A-1 supplied by a pump into a media type dispersing apparatus Dispermat SL-C12EX, manufactured by VMA-Getzmann Co., Ltd., 80% of the interior volume of which is filled by zirconia beads having a diameter of 0.05 mm, so that the dispersion is stayed in the mill for 1.5 minutes, and dispersed at a circumference speed of 8 m/second to prepare light-sensitive emulsion dispersion A-1. <<Preparation of light-sensitive emulsion dispersions A-2, A-3, B-1 to B-4, and C-1 to C-3>>Light-sensitive emulsion dispersions A-2, A-3, B-1 to B-4, and C-1 to C-3 were prepared in the same manner as in light-sensitive emulsion dispersion A-1 except that silver halide grain-containing powdered organic silver salt A-1 was replace by silver halide grain-containing powdered organic silver salt A-2, A-3, B-1 to B-4, and C-1, C-2 or C-3, respectively.

<<Evaluation of Light-sensitive Emulsion Dispersion>>

(Measurement of Dispersed Particle Diameter of the Powdered Organic Silver Salt)

The diameter of the particle of each of the powdered organic silver salts A-1 through C-3 were measured at 20° C. by dynamic light scattering method using FPAR-1000, manufactured by Ootsuka Denshi Co., Ltd., and the solid ingredient concentration of each samples was 20%.

(Evaluation of Coagulated State)

Ten grams of sample was withdrawn from each of the above-prepared light-sensitive emulsion dispersion A-1 through C-3. To the sample, 80 g of methyl ethyl ketone was added and sufficiently stirred. Exemplified Compound P-9 described Table 1 was added as a binder to the above mixture and stirred to be sufficiently dissolved. The solution was coated on transparent 100 μm poly(ethylene terephthalate) film so as to form a layer having a wet thickness of 100 μm and dried. Thus prepared layer was pasted by an adhesive onto a suitable holder and sliced by a diamond knife in the vertical direction to the support to prepare an ultra thin slice having a thickness of from 0.1 to 0.2 μm. The ultra thin slice was held by a copper mesh and moved onto a carbon layer hydrophilized by glow discharge, and the observed by the light visual field of an electronmicroscope, hereinafter referred to as TEM, with a magnitude of 10,000 times while cooling at −130° C. or less. The image was promptly recorded to a film and printed out as an image.

The number of silver halide grains $N_1$ in a designated volume was visually counted in the image, and the coagulation ratio was calculated by the following equation in which $N_2$ was theoretical number of silver halide grains calculated by the amount of silver halide added to the same volume and the particle diameter. The coagulation ratio was the indicator of the coagulating state. The value nearer 100% represents better dispersion state and smaller coagulation degree. Moreover, the average diameter of the silver halide grains was calculated according to the above-described method. The average particle diameter was defined by the average of the sphere-equivalent diameter of 500 grains of silver halide.

$$\text{Coagulating ratio}=(N_1/N_2)\times 100$$

The measured results according to the above are listed in Table 2.

TABLE 2

| Light-sensitive emulsion dispersion No. | Diameter of dispersion of powdered organic silver salt (nm) | Coagulating ratio (%) | Average diameter of silver halide grain (μm) |
|---|---|---|---|
| A-1 | 832 | 75 | 0.065 |
| A-2 | 814 | 53 | 0.061 |
| A-3 | 791 | 46 | 0.057 |
| B-1 | 574 | 95 | 0.049 |
| B-2 | 536 | 87 | 0.045 |
| B-3 | 523 | 84 | 0.038 |
| B-4 | 581 | 89 | 0.046 |
| C-1 | 475 | 93 | 0.041 |
| C-2 | 318 | 89 | 0.042 |
| C-3 | 458 | 98 | 0.040 |

As is appeared by the results shown in Table 2, the coagulation of the silver halide grains is inhibited so that the number of the grains is near ideal state and the diameter of the powdered organic silver salt is made smaller in the light-sensitive emulsion dispersion prepared using the silver halide grain-containing powdered organic silver salt which is prepared using potassium hydroxide.

EXAMPLE 2

<<Preparation of Support>>

Poly(ethylene terephthalate) film blue tinted at a density of 0.170 with a thickness of 175 μm was subjected to a treatment by corona discharge of 0.5 V·A·min/$m^2$ on one side thereof, and a subbing layer-a was coated by the following subbing coating liquid A on the discharge treated surface so as that the dry layer thickness was 0.2 μm. On the other side of the film, corona discharge of 0.5 V·A·min/$m^2$ was applied and a subbing layer-b was coated by the following subbing coating liquid B on the discharge treated surface so as that the dry layer thickness was 0.1 μm.

(Subbing Layer Coating Liquid A)

To prepare subbing layer coating liquid A, 270 g of latex of copolymer of butyl acrylate/t-butyl acrylate/styrene/2-hydroxyethyl acrylate (30/20/25/25%) having a solid component content of 30%, 0.6 g of surfactant UL-1 and 0.5 g of methyl cellulose were mixed and the following dispersion of silica particles was further added and finally made up to 1,000 ml. The dispersion of silica particles was prepared by dispersing 1.3 g of silica particles, Siloid 350 manufactured by Fuji Silicia Co., Ltd., in 100 g of water and applying an ultrasonic wave for 30 minutes by the use of a dispersing apparatus, Ultrasonic Generator manufactured by Alex Corp., generating ultrasonic of 25 kHz and 600 W.

UL-1

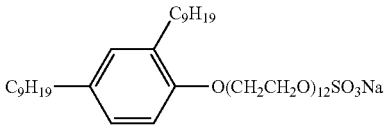

(Subbing Layer Coating Liquid B)

Thirty seven point five grams of the following colloidal tin oxide dispersion, 3.7 g of latex of copolymer of butyl acrylate/t-butyl acrylate/styrene/2-hydroxyethyl acrylate (30/20/25/25%) having a solid component content of 30%, 14.8 g of latex of copolymer of butyl acrylate/styrene/glycidyl methacrylate (40/20/40%) having a solid component content of 30% and 0.1 g of surfactant UL-1 were mixed and made up to 1,000 ml by water. The mixture was referred to as subbing layer coating liquid B.

<Preparation of Colloidal Tin Oxide Dispersion)

Sixty five grams of tin(IV) chloride hydrate was dissolved in 2,000 ml of a water/ethanol mixture to prepare a uniform solution. The solution was boiled to obtain a co-precipitate. The precipitate was taken out by decantation and washed for several times by distillated water. After confirmation of no presence of chloride ion in the washing distillated water of the precipitate by dropping of silver nitrate solution, distillated water is added to the washed precipitation and the total volume was made up to 2,000 ml. Further, 40 ml of 30% ammonia water was added to the resultant liquid and the liquid was heated and concentrated until the volume is reduced to 470 ml to prepare colloidal tin oxide dispersion.

<<Preparation of Sample 101>>

Sample 101 of silver salt photo-thermal photographic dry imaging material was prepared according to the following procedure.

<Coating of Back Surface>

Into 830 g of methyl ethyl ketone, 84.2 g of cellulose acetate butylate CAB381-20 manufactured by Eastman Chemicals Co., Ltd., and 4.5 g of polyester resin Vitel PE2200B, manufactured by Bostic Co., Ltd., were added and dissolved while stirring. To the resultant solution, 0.30 g of Infrared Dye 1, 4.5 g of Fluorinated Surfactant-1 and 1.5 g of fluorinated surfactant Eftop EF-105, manufactured by Jemco Co., Ltd., were added and sufficiently stirred to be dissolved. Finally, 75 g of silica particles Silicia 450, manufactured by Fuji Silicia Co., Ltd., dispersed in methyl ethyl ketone by a dissolver type homogenizer into a concentration of 1% was added to the above-obtained solution and stirred to prepare a back surface coating liquid.

Fluorinated Surfactant-1: $C_9F_{17}O(CH_2CH_2O)_{22}C_9F_{17}$

The back surface coating liquid was coated by an extrusion coater on the surface of the support on which the subbing layer b was provided so that the dry thickness was 3.5 μm, and dried spending for 5 minutes by air having a temperature of 100° C. and a dew point of 10° C.

Infrared Dye 1

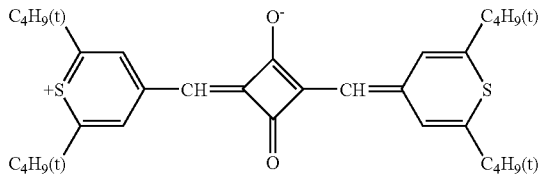

<Coating on the Light-sensitive Layer Side>

(Preparation of Coating Liquids of Each Layers>

(Preparation of Stabilizing Agent Solution)

A stabilizing agent solution was prepared by dissolving 1.0 g of Stabilizing Agent-1 and 0.31 g of potassium acetate in 4.97 g of methanol.

(Preparation of Infrared Sensitizing Dye Solution A)

In 31.3 ml of methyl ethyl ketone, 19.2 mg of infrared sensitizing dye-1, 1.488 g of 2-chlorobenzoic acid, 2.779 g of stabilizing agent-2 and 365 mg of 5-methyl-2-mercapto-benzimidazole were dissolved in dark to prepare infrared sensitizing dye solution A.

(Preparation of Additive Solution-a)

In 110 g of methyl ethyl ketone, 27.98 g of 1,1-bis(2-hydroxy-3,5-dimethylphenyl)-3,5,5-trimethylhexane, which was referred to as reducing agent A, 0.159 g of yellow coloring leuco dye (YA-1), 0.159 g of cyan coloring leeuco dye (CA-12), 1.54 g of 4-methylphthalic acid and 0.48 g of the foregoing infrared dye 1 were dissolved to prepare additive solution-a.

(Preparation of Additive Solution-b)

In 40.9 g of methyl ethyl ketone, 3.56 g fog inhibitor-2 and 3.43 g of phthalazine were dissolved to prepare additive solution-b.

(Preparation of Light-sensitive Layer Coating Liquid A-1)

In an inactive gas atmosphere of 97% of nitrogen gas, 50 g of the foregoing light-sensitive emulsion dispersion A-1 and 15.11 g of methyl ethyl ketone were kept at 21° C. while stirring, and 390 μl of a 10% methanol solution fog inhibitor-1 was added and stirred for 1 hour. To the resultant liquid, 494 μl of a 10% methanol solution of calcium bromide was added and stirred for 20 minutes. Then 17 ml of the stabilizing agent was added to the liquid and stirred for 10 minutes, and 1.32 g of the foregoing infrared sensitizing dye solution A and stirred for 1 hour. After that, the liquid was cooled by 13° C. and further stirred for 30 minutes. To the liquid, 13.31 g of polymer, exemplified compound P-9, was added as a binder resin and stirred for 30 minutes while the temperature of the liquid was held at 13° C., and then 1.084 g of tetrachlorophthalic acid in a state of 9.4 weight % methyl ethyl ketone solution was added and stirred for 15 minutes. While continuing stirring, 12.43 g of additive solution-a, 1.6 ml of Desmodur N3300, 10% methyl ethyl ketone solution of aliphatic isocyanate manufactured by Mobay Co., Ltd., and 4.27 g of additive solution-b were successively added and stirred. Thus light-sensitive layer coating liquid A-1 was prepared.

(Preparation of Surface Protective Layer Coating Liquid)

To 865 ml of methyl ethyl ketone, 96 g of the foregoing cellulose acetate butylate CAB 171-15, 4.5 g of poly(methyl methacrylate) Paraloid A-21, manufactured by Rhom & Haas Co., Ltd., 1.0 g of benzotriazole and 1.0 g of fluorinated surfactant EF-1, manufactured by Jemco Co. Ltd., were added and dissolved while stirring. Then 30 g of the following matting agent dispersion was added and stirred to prepare a surface protective layer coating liquid.

(Preparation of Matting Agent Dispersion)

In 42.5 g of methyl ethyl ketone, 7.5 g of cellulose acetate butylate CBA171-15, manufactured by Eastman Chemicals Co., Ltd., was dissolved, and 5 g of silica particles Sicilia 320, manufactured by Fuji Sicilia Co., Ltd, was further added. The resultant mixture was dispersed by the dissolver type homogenizer at 8,000 rpm for 30 minutes to prepare matting agent dispersion.

(Coating)

The above-prepared light-sensitive layer coating liquid A-1 and the surface protective layer coating liquid were simultaneously coated to form a multiple layer by a known extrusion type coater. The coating was carried out so that the light-sensitive layer has a coated silver amount of 1.7 g/m$^2$ and the surface protective layer has the dry thickness of 2.5 μm. After that, the coated layers were dried for 10 minutes by air having a temperature of 75° C. and a dew point of 10°. Thus Sample 101 was prepared.

<<Preparation of Samples 102 through 140>>

Samples 101 through 143 were prepared in the same manner as in Sample 101 except that the kind of the light-sensitive emulsion dispersion, the kind of reducing agent in the additive solution-a, the amount of the fog inhibitor-2 and the addition of the stabilizing agent in the additive solution-b and the species of polymer were changed as shown in Table 3.

AFP-2, AFP-6 and AFP-17 were copolymers synthesized from decane butyrals (#2000-L, polymerization degree of approximately 300) each having Exemplified Compounds Stabilizing agent-1

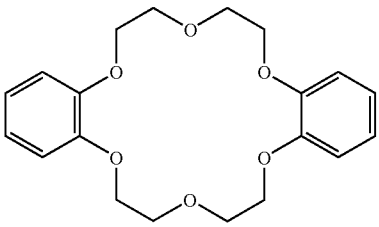

Stabilizing agent-2

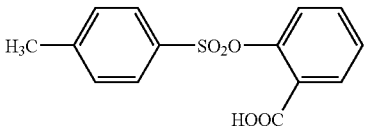

Infrared sensitizing dye-1

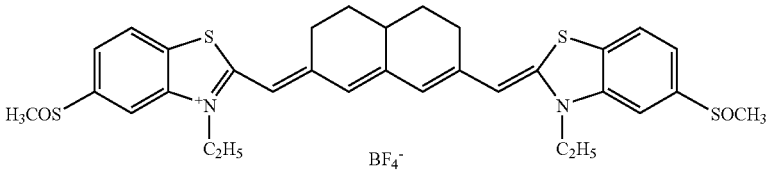

Fog inhibitor-2

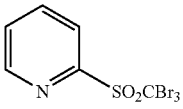

Fog inhibitor-1

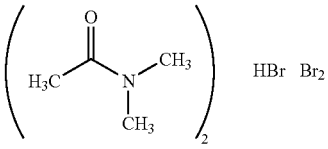

AF-2, AF-6, AF-12, AF-16 and AF-17 as repeating unit, respectively. The synthesis was performed according to that described in Synthesizing Example 4.

to 75°. In such the case, a good image having smaller density unevenness and unexpectedly higher sharpness compared with the case of angle of 90°.

TABLE 3

| Sample No. | Light-sensitive emulsion dispersion No. | Additive solution-a Reducing agent | Composition of additive solution-b: Additive 1 Fog inhibitor | Additive 1 Adding amount (g) | Additive 2 Compound | Additive 2 Adding amount (g) | Additive 3 Compound | Additive 3 Adding amount (g) | Binder | Remarks |
|---|---|---|---|---|---|---|---|---|---|---|
| 101 | A-1 | A | *1 | 3.56 | — | — | — | — | P-9 | Comp. |
| 102 | A-2 | A | *1 | 3.56 | — | — | — | — | P-9 | Comp. |
| 103 | A-3 | A | *1 | 3.56 | — | — | — | — | P-9 | Comp. |
| 104 | B-1 | A | *1 | 3.56 | — | — | — | — | P-9 | Inv. |
| 105 | B-2 | A | *1 | 3.56 | — | — | — | — | P-9 | Inv. |
| 106 | B-3 | A | *1 | 3.56 | — | — | — | — | P-9 | Inv. |
| 107 | B-4 | A | *1 | 3.56 | — | — | — | — | P-9 | Inv. |
| 108 | C-1 | A | *1 | 3.56 | — | — | — | — | P-9 | Inv. |
| 109 | C-2 | A | *1 | 3.56 | — | — | — | — | P-9 | Inv. |
| 110 | C-3 | A | *1 | 3.56 | — | — | — | — | P-9 | Inv. |
| 111 | A-2 | A | *1 | 3.56 | AFP-2 | 3.50 | — | — | P-9 | Comp. |
| 112 | B-2 | A | *1 | 5.34 | — | — | — | — | P-9 | Inv. |
| 113 | B-2 | A | *1 | 3.56 | AFP-2 | 3.50 | — | — | P-9 | Inv. |
| 114 | B-2 | A | *1 | 2.13 | AFP-2 | 3.50 | — | — | P-9 | Inv. |
| 115 | B-2 | A | *1 | 2.13 | AFP-6 | 3.50 | — | — | P-9 | Inv. |
| 116 | B-2 | A | *1 | 2.13 | AFP-12 | 3.50 | — | — | P-9 | Inv. |
| 117 | B-2 | A | *1 | 2.13 | AFP-16 | 3.50 | — | — | P-9 | Inv. |
| 118 | B-2 | A | *1 | 2.13 | AFP-17 | 3.50 | — | — | P-9 | Inv. |
| 119 | A-2 | A | *1 | 3.56 | AF-8 | 1.80 | — | — | P-9 | Comp. |
| 120 | B-2 | A | *1 | 3.56 | AF-8 | 1.80 | — | — | P-9 | Inv. |
| 121 | B-2 | A | *1 | 2.13 | AF-8 | 1.80 | — | — | P-9 | Inv. |
| 122 | B-2 | A | *1 | 2.13 | AF-12 | 1.80 | — | — | P-9 | Inv. |
| 123 | B-2 | A | *1 | 2.13 | AF-13 | 1.80 | — | — | P-9 | Inv. |
| 124 | B-2 | A | *1 | 2.13 | AF-17 | 1.80 | — | — | P-9 | Inv. |
| 125 | B-2 | A | *1 | 2.13 | AF-23 | 1.80 | — | — | P-9 | Inv. |
| 126 | B-2 | A | *1 | 2.13 | AF-27 | 1.80 | — | — | P-9 | Inv. |
| 127 | B-2 | A | *1 | 2.13 | AF-28 | 1.80 | — | — | P-9 | Inv. |
| 128 | A-2 | A | *1 | 3.56 | — | — | — | — | P-1 | Comp. |
| 129 | B-2 | A | *1 | 3.56 | — | — | — | — | P-1 | Inv. |
| 130 | B-2 | A | *1 | 1.80 | AF-12 | 1.80 | — | — | P-1 | Inv. |
| 131 | B-2 | A | *1 | 1.00 | AFP-6 | 3.50 | AF-12 | 1.80 | P-9 | Inv. |
| 132 | B-2 | A | *1 | 1.80 | AFP-6 | 3.50 | — | — | P-1 | Inv. |
| 133 | B-2 | A | *1 | 1.00 | AFP-6 | 3.50 | AF-12 | 1.80 | P-1 | Inv. |
| 134 | B-4 | A | *1 | 1.00 | AFP-6 | 3.50 | AF-12 | 1.50 | P-1 | Inv. |
| 135 | B-4 | A | *1 | 1.80 | AFP-6 | 3.50 | — | — | P-1 | Inv. |
| 136 | C-1 | A | *1 | 1.80 | AFP-6 | 3.50 | — | — | P-1 | Inv. |
| 137 | C-3 | A | *1 | 1.80 | AFP-6 | 3.50 | — | — | P-1 | Inv. |
| 138 | B-2 | 1-1 | *1 | 3.56 | — | — | — | — | P-9 | Inv. |
| 139 | B-2 | 1-1 | *1 | 3.56 | — | — | — | — | P-1 | Inv. |
| 140 | B-2 | 1-1 | *1 | 1.00 | AFP-6 | 3.50 | — | — | P-9 | Inv. |
| 141 | B-2 | 1-1 | *1 | 1.00 | AFP-6 | 3.50 | — | — | P-1 | Inv. |
| 142 | B-2 | 1-7 | *1 | 1.00 | AFP-6 | 3.50 | — | — | P-1 | Inv. |
| 143 | B-2 | 1-9 | *1 | 1.00 | AFP-6 | 3.50 | — | — | P-1 | Inv. |

Comp.: Comparative
Inv.: Inventive
*1: Fog inhibitor-2

<<Evaluation of Silver Salt Photo-thermal Photographic Dry Imaging Material>>

The above-prepared Samples 101 through 143 were subjected to the following evaluation.

[Exposure and Developing Treatment]

The above-prepared samples were each exposed on the side of the light-sensitive layer through an optical wedge by the scanning of laser light by an exposing apparatus which has a semiconductor laser as a light source emitting light of vertically multiple mode having a wavelength of 800 to 820 nm. On the occasion of the exposure, the angle of exposing laser beam with the sample surface to be exposed was made Thereafter, the sample was developed by an automatic developing apparatus of FIG. 1 having a heat drum and a cooling zone in which the protective layer of the sample was contacted with the surface of the drum. The development was carried out in a room conditioned at 23° C. and 50% RH.

[Measurement of Sensitivity, Fog Density and the Maximum Density]

The optical density of thus obtained gradation wedge silver image was measured by a densitometer and a characteristic curve was drawn in which the density D of the silver image was on the vertical line and the logarithm LogE of the exposing light amount E was on the horizontal line. The sensitivity was determined on the characteristic curve, which was defined by the reciprocal value of the relative exposure amount necessary to form a density 0.1 on the minimum density or fog density. Moreover, the maximum density and the minimum density or fog density were determined. The sensitivity and the maximum density are listed in Table 4 as the relative values when those of Sample 101 are each set at 100.

[Measurement of Thermal Transition Point After Thermal Development]

The thermal transition point after thermal development was measured according to the following procedure.

<Measurement of Thermal Transition Point>

Each of the light-sensitive layer coating liquids the same as those coated on each of the samples were respectively coated on Teflon® Plates by a wire bar and dried so as the coated samples each have the same condition. The coated samples were each exposed and developed in the same manner ad above-described and the layer was peeled off from the Teflon plate. Ten milligrams of peeled sample was put in an aluminum pan, and the thermal transition point of each of the samples was measured according to the method of JIS K 7121 referential to American National Standard Institute employing a differential scanning calorimeter Exstar 6000 manufactured by Seiko Denshi Co., Ltd. On the occasion of the measurement, the sample was heated from 0 to 200° C. in a rate of 10° C./minute and cooled by 0° C. in a rate of 20° C./minute. Such the procedure was repeated two times.

[Evaluation of Image Storing Ability After Development]

The thermally developed samples the same as those used for measuring the sensitivity, fog and maximum density were subjected to the following evaluations.

(Evaluation of Storage Ability of the Minimum Density $D_{min}$ Portion)

The thermally developed samples were each irradiated for 3 days by a white fluorescent lamp so that the illuminance at the sample surface was 500 lux, under a condition of 45° C. and 55% of RH. The minimum density of the sample after irradiation by the fluorescent light $D_2$ and that of the not irradiated sample $D_1$ were measured and the variation ratio in percentage of minimum density was calculated by the following equation as the index of the storage ability of the minimum density portion.

$$\text{Variation ratio of } D_{min}=(D_2/D_1)\times 100\ (\%)$$

(Evaluation Storage Ability of Image at the Maximum Density $D_{max}$ Portion)

The thermally developed sample was stood for 3 days under conditions of 25° C. and 45° C., and the maximum density of each of the samples was measured and the variation ratio of the maximum density was calculated the following as the index of the storage ability of the image.

$$\text{Variation ratio of } D_{max}=(D_{max} \text{ of the sample stored at } 45°/D_{max} \text{ of the sample stored at } 25°\ C.)\times 100\ (\%)$$

(Evaluation of Tone of Silver Image)

The wedge image portion of each of the thermally developed sample was measured by CM-3600d manufactured by Minolta Co., Ltd. and v* and u* values were calculated. The measuring was carried out in the transmission mode under the condition of the light source of F7 and the visual field angle of 10°. The values of v* and u* were plotted on a graph in which the v* was measured on the horizontal axis and the u* was measured on the vertical axis, and the linear regression line was drawn. And then the double decision $R^2$, the slice and the slant were determined.

(Evaluation of Unevenness of Image Density)

The sample was uniformly exposed according to the foregoing procedure so as to form a density of 1.5 when the sample was developed under the foregoing condition. On the occasion of the development of the uniformly exposed sample, the temperature and the speed of the development were varied. The cooling fun 125 was controlled so that the surface temperature of the sample output on the accumulating portion 160 of the developing apparatus of FIG. 1 was not more than 40° C.

Thus prepared samples were visually observed and the unevenness of the density was evaluated according to the following norms. The samples ranked into Levels A and B were judged as acceptable for the practical use.

A: Unevenness of the image density was almost not observed.

B: Unevenness of the image density was slightly observed; acceptable for the practical use.

C: Weak unevenness of the image density was observed; there was anxiety for the practical use.

D: Unevenness was observed a little; the quality of image caused problems in the practical use.

E: Strong unevenness was observed; the quality of image caused remarkable problems in the practical use.

Thus obtained results are listed in Table 4.

TABLE 4

| Sample | Thermal transition point | Fog | Relative | | Density variation ratio (%) | | Tone of silver image | | | | |
|---|---|---|---|---|---|---|---|---|---|---|---|
| No. | (° C.) | density | sensitivity | *1 | *2 | *1 | *3 | Slice | Slant | *4 | Remarks |
| 101 | 42 | 0.201 | 100 | 100 | 140 | 77 | 0.48 | −5.87 | 0.41 | C | Comp. |
| 102 | 42 | 0.234 | 78 | 92 | 146 | 78 | 0.53 | −3.58 | 0.42 | D | Comp. |
| 103 | 43 | 0.245 | 76 | 89 | 153 | 77 | 0.51 | −3.10 | 0.44 | E | Comp. |
| 104 | 43 | 0.199 | 111 | 106 | 135 | 81 | 0.78 | −4.84 | 0.58 | B | Inv. |
| 105 | 44 | 0.198 | 95 | 105 | 137 | 82 | 0.80 | −2.31 | 0.78 | B | Inv. |
| 106 | 44 | 0.200 | 88 | 100 | 139 | 84 | 0.81 | −1.96 | 0.83 | B | Inv. |
| 107 | 43 | 0.191 | 97 | 106 | 137 | 85 | 0.83 | −2.04 | 0.81 | B | Inv. |
| 108 | 44 | 0.193 | 94 | 106 | 134 | 84 | 0.83 | −2.30 | 0.84 | B | Inv. |
| 109 | 42 | 0.197 | 90 | 104 | 138 | 80 | 0.67 | −3.48 | 0.71 | B | Inv. |
| 110 | 44 | 0.191 | 95 | 101 | 134 | 85 | 0.84 | −2.21 | 0.83 | B | Inv. |
| 111 | 43 | 0.233 | 86 | 90 | 144 | 76 | 0.57 | −4.63 | 0.47 | D | Comp. |
| 112 | 42 | 0.193 | 90 | 96 | 135 | 80 | 0.62 | −1.23 | 0.68 | B | Inv. |
| 113 | 44 | 0.192 | 94 | 106 | 131 | 86 | 0.89 | −2.08 | 0.88 | B | Inv. |
| 114 | 43 | 0.193 | 97 | 111 | 130 | 88 | 0.88 | −2.32 | 0.86 | B | Inv. |

TABLE 4-continued

| Sample No. | Thermal transition point (° C.) | Fog density | Relative sensitivity | *1 | Density variation ratio (%) *2 | *1 | *3 | Tone of silver image Slice | Slant | *4 | Remarks |
|---|---|---|---|---|---|---|---|---|---|---|---|
| 115 | 44 | 0.189 | 96 | 112 | 127 | 87 | 0.85 | −2.35 | 0.87 | B | Inv. |
| 116 | 42 | 0.191 | 95 | 111 | 126 | 88 | 0.91 | −2.03 | 0.89 | B | Inv. |
| 117 | 43 | 0.192 | 94 | 109 | 128 | 84 | 0.86 | −2.05 | 0.85 | B | Inv. |
| 118 | 42 | 0.194 | 93 | 108 | 127 | 84 | 0.84 | −2.14 | 0.84 | B | Inv. |
| 119 | 43 | 0.221 | 75 | 87 | 141 | 76 | 0.48 | −4.65 | 0.52 | D | Comp. |
| 120 | 43 | 0.191 | 90 | 100 | 130 | 83 | 0.86 | −2.30 | 0.78 | B | Inv. |
| 121 | 43 | 0.193 | 95 | 106 | 131 | 83 | 0.89 | −2.10 | 0.89 | B | Inv. |
| 122 | 42 | 0.191 | 96 | 110 | 128 | 85 | 0.90 | −2.03 | 0.91 | A | Inv. |
| 123 | 41 | 0.193 | 93 | 106 | 130 | 81 | 0.88 | −2.15 | 0.90 | B | Inv. |
| 124 | 42 | 0.195 | 94 | 106 | 132 | 83 | 0.86 | −2.20 | 0.91 | B | Inv. |
| 125 | 43 | 0.196 | 95 | 106 | 130 | 84 | 0.83 | −2.30 | 0.89 | B | Inv. |
| 126 | 42 | 0.190 | 94 | 105 | 134 | 84 | 0.76 | −2.67 | 0.81 | B | Inv. |
| 127 | 43 | 0.191 | 95 | 106 | 132 | 83 | 0.81 | −2.30 | 0.88 | B | Inv. |
| 128 | 53 | 0.236 | 72 | 88 | 143 | 79 | 0.54 | −4.30 | 0.56 | D | Comp. |
| 129 | 52 | 0.199 | 94 | 105 | 136 | 85 | 0.78 | −2.67 | 0.81 | B | Inv. |
| 130 | 53 | 0.189 | 97 | 109 | 124 | 93 | 0.94 | −1.80 | 0.88 | A | Inv. |
| 131 | 42 | 0.187 | 98 | 114 | 118 | 85 | 0.94 | −1.56 | 0.93 | A | Inv. |
| 132 | 52 | 0.189 | 98 | 115 | 122 | 96 | 0.96 | −1.65 | 0.92 | A | Inv. |
| 133 | 53 | 0.185 | 98 | 115 | 119 | 97 | 0.96 | −1.65 | 0.94 | A | Inv. |
| 134 | 52 | 0.184 | 100 | 116 | 117 | 97 | 0.93 | −1.43 | 0.95 | A | Inv. |
| 135 | 52 | 0.187 | 98 | 112 | 120 | 93 | 0.92 | −1.45 | 0.94 | A | Inv. |
| 136 | 52 | 0.189 | 97 | 111 | 123 | 91 | 0.89 | −1.98 | 0.91 | A | Inv. |
| 137 | 52 | 0.187 | 96 | 112 | 121 | 92 | 0.89 | −1.90 | 0.89 | A | Inv. |
| 138 | 43 | 0.189 | 99 | 108 | 119 | 87 | 0.94 | −1.31 | 0.94 | A | Inv. |
| 139 | 54 | 0.182 | 99 | 109 | 115 | 99 | 0.94 | −1.41 | 0.95 | A | Inv. |
| 140 | 44 | 0.186 | 99 | 110 | 115 | 85 | 0.97 | −1.45 | 0.96 | A | Inv. |
| 141 | 53 | 0.188 | 99 | 113 | 117 | 97 | 0.96 | −1.30 | 0.95 | A | Inv. |
| 142 | 52 | 0.187 | 98 | 112 | 116 | 98 | 0.97 | −1.40 | 0.94 | A | Inv. |
| 143 | 52 | 0.187 | 98 | 111 | 115 | 97 | 0.98 | −1.50 | 0.94 | A | Inv. |

*1; Maximum density
*2; Minimum density
*3; Dou-ble decision $R^2$
*4; Unevenness of desity
Comp.; Comparative
Inv.; Inventive As is shown in Table 4, the silver salt photo-thermal photographic dry imaging materials according to the invention are lower in the fog and superior in the storage ability after development compared with the comparative examples even though the sensitivity and the maximum density are almost equal. The formation density unevenness caused by the thermal development is inhibited, and the tone of the silver image is preferable cold tone. Therefore, it is under stood that the output image suitable for image diagnosis can be obtained.

What is claimed is:

1. A silver salt photo-thermal photographic dry imaging material comprising on a support:

a light-sensitive layer containing light-insensitive silver salt of aliphatic carboxylic acid particles, a light-sensitive emulsion having light-sensitive silver halide grains, a silver ion reducing agent and a binder, wherein the light-sensitive emulsion contains silver halide particles having diameters of from 0.001 μm to 0.050 μm in the ratio of 50% or more by weight in terms of silver of the entire light-sensitive silver halide grains contained in the imaging material, the light-sensitive silver halide grains are present in an amount of 0.01 to 0.2 grams per square meter of coated silver, the number average particle diameter of the light-insensitive silver salt of aliphatic carboxylic acid is from 0.01 μm to 0.60 μm, and wherein the light-insensitive silver salt of aliphatic carboxylic acid particles are produced by mixing an alkali metal salt of aliphatic carboxylic acid with the light-sensitive silver halide grains, and the alkali metal salt of aliphatic carboxylic acid is prepared by adding potassium hydroxide to an aliphatic carboxylic acid.

2. The silver salt photo-thermal photographic dry imaging material of claim 1, wherein the light-insensitive silver salt of aliphatic carboxylic acid particles are produced by reacting a solution containing silver ions, the light-sensitive halide grains, and a solution containing the alkali metal salt of aliphatic carboxylic acid in the presence of a water-miscible organic solvent.

3. The silver salt photo-thermal photographic dry imaging material of claim 1, further comprising:

a polymer which has at least one repeating unit of aliphatic monomer having a halogen radical releasable group.

4. The silver salt photo-thermal photographic dry imaging material of claim 3, the aliphatic monomer having a halogen radical releasable group is represented by the following Formula 1:

Formula 1

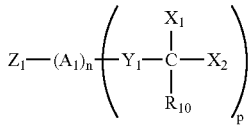

wherein $X_1$ and $X_2$ are each independently a halogen atom; $R_{10}$ is a hydrogen atom or a halogen atom; $Y_1$ is a di-valent linking group; p is an integer of from 1 to 3; $A_1$ is an alkylene group, a cycloalkylene group, an alkenylene group or an alkynylene group; n is 0 or 1; and $Z_1$ is an ethylenic unsaturated group, an ethyleneimino group or an epoxy group.

5. The silver salt photo-thermal photographic dry imaging material of claim 3, the aliphatic monomer having a halogen radical releasable group is represented by the following Formula 2:

Formula 2

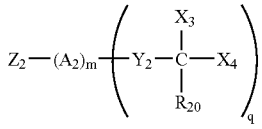

wherein $X_3$ and $X_4$ are each a halogen atom, $R_{20}$ is a hydrogen atom, a halogen atom or a substituent, $Y_2$ is an —N($R_3$)CO— group or an —OCO— group, $R_3$ is a hydrogen atom, a halogen atom or a substituent, q is 1, 2 or 3, $A_2$ is an aromatic group or a heterocyclic group, m is 0 or 1, $Z_2$ is an ethylenic unsaturated group, an ethyleneimino group or an epoxy group.

6. The silver salt photo-thermal photographic dry imaging material of claim 1, further comprising:

a compound represented by the following Formula 3:

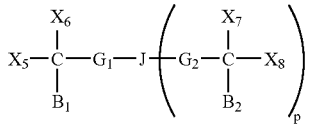

wherein $X_5$, $X_6$, $X_7$ and $X_8$ are each a halogen atom, $B_1$ and $B_2$ are each independently a hydrogen atom, a halogen atom or a substituent, p is an integer of from 1 to 3, J is a alkylene group, a cycloalkylene group, an alkenylene group, an alkynylene group, $G_1$ and $G_2$ are each a linking group, and when both of $G_1$ and $G_2$ are —$SO_2$— groups, p is 2 or 3.

7. The silver salt photo-thermal photographic dry imaging material of claim 1, wherein the silver ion reducing agent is at least one compound selected from the compounds represented by the following Formulas A-1, A-2 or A-3

Formula A-1

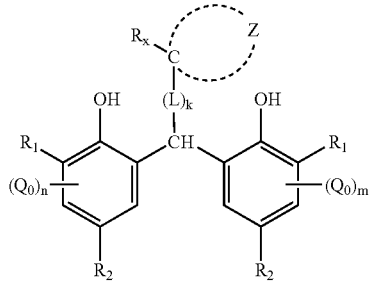

wherein Z is a group of atoms necessary for forming a 3- to 10-member ring, $R_x$ is a hydrogen atom or an alkyl group, $R_1$, $R_2$, $Q_0$ is each a group capable of substituting on the berizene ring, L is a divalent linking group, k is 0 or 1, and n and m are each an integer of from 0 to 2, Formula A-2

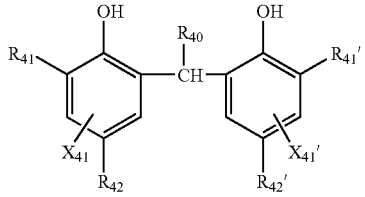

wherein $R_{40}$ represents the following Formula A, and $R_{43}$ through $R_{45}$ are each a hydrogen atom or a substituent, when C in Formula A does not form any ring with $R_{43}$ through $R_{45}$, $R_{40}$ contains an ethylene group or an acetylene group, these groups may have a substituent, when C in formula A forms a ring with one of $R_{43}$ through $R_{45}$, $R_{40}$ has an ethylene or an acetylene group out of the ring, these groups may have a substituent, and $R_{41}$, $R_{41'}$, $R_{42}$, $R_{42'}$, $X_{41}$ and $X_{41'}$ are each a hydrogen atom or a substituent, Formula A

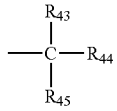

Formula A-3

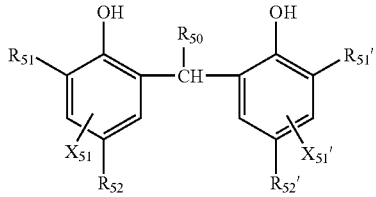

wherein $R_{50}$ represents a hydrogen atom or a substituent, and $R_{51}$, $R_{51'}$, $R_{52}$, $R_{52'}$, $X_{51}$ and $X_{51'}$ are each a hydrogen atom or a substituent, provided that at least one of $R_{51}$, $R_{51'}$, $R_{52}$, $R_{52'}$, $X_{51}$ and $X_{51'}$ contains an ethylene group or an acetylene group, these groups may have a substituent.

8. The silver salt photo-thermal photographic dry imaging material of claim 1, comprising:

the silver ion reducing agent represented by above Formula A-1 in a combination with a compound represented by the following Formula A-4

Formula A-4

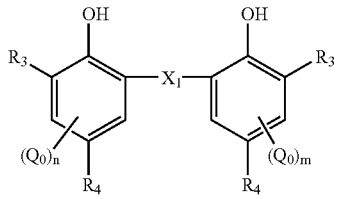

wherein $X_1$ is a chalcogen atom or a CHR group, R in the CHR is a hydrogen atom, a halogen atom or an alkyl group, $R_3$ is an alky group, and the two groups represented by $R_3$ may be the same as or different from each other, provided that at least one of them is a secondary or tertiary alkyl group, $R_3$ may be for a saturated ring together with $(Q_0)_n$ or $(Q_0)_m$, $R_4$ is a hydrogen atom or a group capable of substituting on the benzene ring, plural $R_3$ and $R_4$ may be the same as or different from each other, and $Q_0$ is the synonym of that in Formula A-1.

9. The silver salt photo-thermal photographic dry imaging material of claim 1, wherein decision coefficient (double decision) $R^2$ of the linear regression line is from 0.998 to 1.000, said linear regression line is prepared by measuring at the optical density of the silver images of 0.5, 1.0, 1.5 and the minimum density and plotting the values of u* and v* at each of the densities on a two dimensional graph of the (L*u*v*) color space of IEC 1976 having the horizontal axis of u* and the vertical axis of v* after thermal development, and the value of v* at the crossing point of the linear regression line with the horizontal axis is from −5 to 5 and the slant v*/u* of the line is from 0.7 to 2.5.

10. The silver salt photo-thermal photographic dry imaging material of claim 9, comprising a tone controlling agent.

11. The silver salt photo-thermal photographic dry imaging material of claim 10, wherein the tone controlling agent is a compound containing a carboxylic acid.

12. The silver salt photo-thermal photographic dry imaging material of claim 9, comprising a leuco dye.

13. The silver salt photo-thermal photographic dry imaging material of claim 1, wherein the thermal transition point after the thermal developing treatment of the light-sensitive layer in a temperature of not less than 100° C. is from 46° C. to 200° C.

14. The silver salt photo-thermal photographic dry imaging material of claim 13, comprising a binder of glass transition point from 70° C. to 105° C.

* * * * *